United States Patent [19]

Wachi et al.

[11] Patent Number: 4,915,007

[45] Date of Patent: Apr. 10, 1990

[54] PARAMETER SETTING SYSTEM FOR ELECTRONIC MUSICAL INSTRUMENT

[75] Inventors: Masatada Wachi; Kosei Terada; Naota Katada; Tsuyoshi Futamase; Toshiaki Sato, all of Hamamatsu, Japan

[73] Assignee: Yamaha Corporation, Hamamatsu, Japan

[21] Appl. No.: 13,559

[22] Filed: Feb. 11, 1987

[30] Foreign Application Priority Data

| | | | |
|---|---|---|---|
| Feb. 13, 1986 | [JP] | Japan | 61-29749 |
| Feb. 13, 1986 | [JP] | Japan | 61-29750 |
| Feb. 13, 1986 | [JP] | Japan | 61-29752 |
| Feb. 13, 1986 | [JP] | Japan | 61-29777 |

[51] Int. Cl.[4] ..... G10H 1/06; G10H 1/42; G10H 7/00

[52] U.S. Cl. ..... 84/622; 84/629; 84/635; 84/477 R; 84/DIG. 12

[58] Field of Search ..... 84/477 R, 478, 1.11, 84/1.19, 1.03, DIG. 12, 1.28, 1.01

[56] References Cited

U.S. PATENT DOCUMENTS

| | | | |
|---|---|---|---|
| 4,132,139 | 1/1979 | Amano | 84/DIG. 12 X |
| 4,358,980 | 11/1982 | Imamura | 84/477 R X |
| 4,416,179 | 11/1983 | Wachi | 84/1.19 |
| 4,483,231 | 11/1984 | Hirano | 84/1.19 |
| 4,484,506 | 11/1984 | Sato | 84/477 R X |
| 4,538,495 | 9/1985 | Sato | 84/477 R X |
| 4,548,119 | 10/1985 | Wachi et al. | 84/DIG. 9 X |
| 4,624,170 | 11/1986 | Ohno et al. | 84/1.19 X |

*Primary Examiner*—Stanley J. Witkowski

*Attorney, Agent, or Firm*—Spensley Horn Jubas & Lubitz

[57] ABSTRACT

An electronic musical instrument has a parameter setting system for setting a parameter necessary for controlling a musical characteristic which is a tone color or a musical effect such as a vibrato in a musical tone generating section. The parameter setting system comprises a memory (RAM) for storing a plurality of sets of parameters each set including, for example, a vibrato delay parameter and a vibrato speed parameter. When one of tone-color selection switches on a control panel is depressed, the set of parameters corresponding to the depressed tone-color selection switch are read and supplied to the musical tone generating section to thereby control the vibrato of the musical tone. The selected set of parameters in the RAM can be changed by the player through menu selection switches and data-up and data-down switches to desired values. The system may include a quit switch for restoring the set of parameters precedingly selected. The RAM may further store parameters for controlling another musical effect such as a tremolo. In this case, selection switches for selecting one of the vibrato and the tremolo are provided on the control panel, and parameters related to the selected musical effect are read from the RAM so that those parameters can be changed by the player.

28 Claims, 51 Drawing Sheets

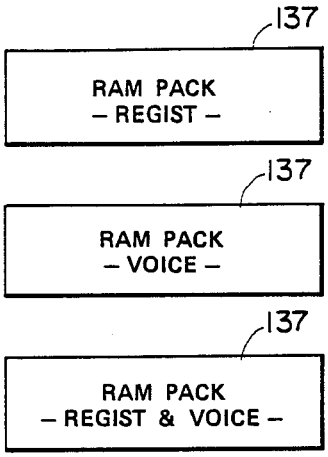
FIG.52(A)
FIG.52(B)
FIG.52(C)
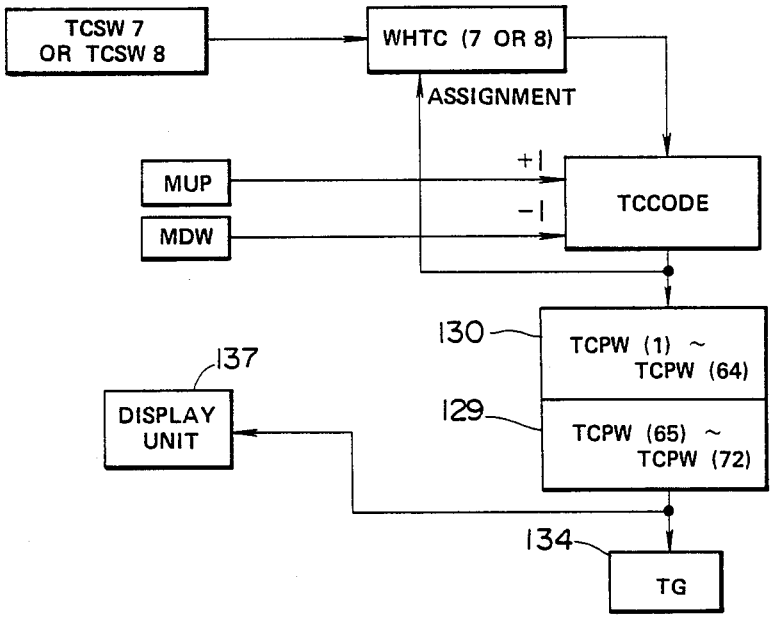
FIG.53

PARAMETER SETTING SYSTEM FOR ELECTRONIC MUSICAL INSTRUMENT

BACKGROUND OF THE INVENTION

1. Field of the Invention

This invention relates generally to an electronic musical instrument and more particularly to a parameter setting system for an electronic musical instrument for setting parameters used in generating a musical tone of desired characteristics.

2. Prior Art

In general, a musical tone generating section of an electronic musical instrument generates a musical tone in accordance with various parameters which determine various characteristics of a tone including a tone color and musical effects and which are previously set to desired values. For example, when it is required that a vibrato effect be applied to a musical tone, parameters relating to a delay, a speed and a depth of the vibrato effect must be set in advance respectively to desired values. The delay parameter determines the time period in terms of "msec" to lapse from the depression of key to the beginning of application of the vibrato effect. The speed parameter determines the cycle of the vibrato waveform. And, the depth parameter determines the amplitude of the vibrato waveform. Parameters necessary for applying other musical effects such as a tremolo, a celeste and a portamento to a musical tone must also be set to desired values previously. It would be further necessary to set parameters for determining a shape of the envelope waveform to a desired value.

With most of the conventional electronic musical instruments, when a tone color of a musical tone to be generated is selected, parameters determining tonal characteristics other than a tone color and corresponding to the selected tone color are automatically set to predetermined values. And, the freedom had been quite limited for the performer to change the parameters. Further, operating members or buttons are exclusively provided for the respective parameters so that many operating members are required to increase the number of the parameters which can be controlled by the performer. Such conventional electronic musical instrument is disclosed, for example, in Japanese Utility Model Application Laid-Open No. 56-38392.

Recently, it has developed an electronic musical instrument in which a certain operating member or members are commonly used for selectively controlling the respective different parameters and in which such parameters can be set to desired values by the performer himself as disclosed in Japanese Patent Application Laid-Open No. 60-149089. This is often called Multi-Menu System.

However, this newly developed conventional electronic musical instrument is still disadvantageous in the following respects.

When a tone color is selected by a performer through operating one of tone color selection switches, the parameter setting system is not always in a state to control the parameters corresponding or related to the selected tone color among the many states each bringing the different parameter sets into a controllable condition. Therefore, after selecting a tone color, the performer has to set the parameter setting system to a state that the parameters corresponding to the selected tone color are controllable.

Even if the parameters has been changed by the performer himself, the new parameters are not always better for the performer than the precedingly selected parameters. More specifically, it is not known to the performer whether the parameters newly selected are appropriate until the performer actually plays a music with the new parameters. Therefore, when the performer plays a music after changing the parameters by operating parameter setting buttons concerned, it is frequent that the performer knows that the parameters precedingly selected had been better than the parameters newly selected. In such a case, the performer must again operate the parameter setting buttons to restore the precedingly-selected parameters. However, such a frequent operation of the parameter setting buttons is very troublesome, and it is significantly difficult to perfectly restore the precedingly-selected parameters.

The conventional parameter setting system is so constructed that the changes of parameters for different musical effects can be achieved through a common set of switch means to minimize the number of switch means. However, the conventional parameter setting system suffers from a deficiency that the change of musical parameters can not be achieved in a quick manner.

SUMMARY OF THE INVENTION

It is therefore an object of the present invention to provide a parameter setting system for an electronic musical instrument through which the performer can easily set the parameters for a musical tone to desired values.

It is another object of the present invention to provide a parameter setting system for an electronic musical instrument which is automatically brought into a parameter setting mode when a tone color of a musical tone is selected.

It is a further object of the invention to provide a parameter setting system for an electronic musical instrument which can restore the precedingly-selected parameters by simple operation of switch means even after the parameters have been changed.

It is a still further object of the invention to provide a parameter setting system for an electronic musical instrument in which a change of parameters and/or a change of musical effect can be achieved in a quick manner with the minimized number of switch means.

According to a first aspect of the present invention, there is provided a parameter setting system for an electronic musical instrument having tone generating means for generating a musical tone of a selectable characteristic comprising first memory means for storing a parameter for controlling a characteristic of the musical tone; parameter changing means, responsive to the selection of the selectable characteristic, having a manually operable member for causing the parameter in the memory means to change in accordance with an operation of the member; reading means for reading the parameter from the memory means; and tone control means responsive to the read parameter for cooperating with the tone generating means to control the characteristic of the musical tone.

The parameter setting system may further comprise second memory means; first switch means for outputting a first operation signal when manually operated; first transfer means responsive to the first operation signal for transferring the parameter stored in the first memory means to the second memory means; second switch means for outputting a second operation signal when manually operated; and second transfer means responsive to the second operation signal for transferring the parameter contained in the second memory means to the first memory means.

According to a second aspect of the present invention, there is provided a parameter setting system for an electronic musical instrument having tone generating means for generating a musical tone comprising a plurality of tone control means cooperative with the tone generating means for respectively controlling characteristics of the musical tone; first memory means having a plurality of storage areas corresponding respectively to the plurality of tone control means each for storing a parameter for determining a respective one of the characteristics of the musical tone; characteristic selection means having a plurality of manually operable members corresponding respectively to the storage areas for outputting a characteristic selection signal corresponding to one of the plurality of manually operable members which was operated last of all; parameter changing means having switch means and responsive to the characteristic selection signal for causing the parameter in one of the plurality of storage areas corresponding to the last operated member to change in accordance with a manual operation of the switch means; and reading means responsive to the characteristic selection signal for reading the parameter from the one storage area and for supplying the read parameter to a corresponding one of the plurality of tone control means to thereby control that characteristic of the musical tone corresponding to the last operated member.

According to a third aspect of the present invention, there is provided a parameter setting system for an electronic musical instrument having tone generating means for generating a musical tone comprising memory means for storing a plurality of parameters each for determining a characteristic of the musical tone; parameter switch means; assigning means for assigning a desired one of the plurality of parameters to the parameter switch means; reading means responsive to an output of the parameter switch means for reading the parameter assigned to the parameter switch means from the memory means; and tone control means cooperative with the tone generating means for controlling the characteristic of the musical tone in accordance with the read parameter.

BRIEF DESCRIPTION OF THE DRAWINGS

FIG. 52(A) is an illustration showing a message displayed on the display unit 137 of the multi-menu switch section 123 of FIG. 36;

FIG. 52(B) is an illustration showing another message displayed on the display unit 137 of FIG. 36;

FIG. 52(C) is an illustration showing a further message displayed on the display unit 137 of FIG. 36;

FIG. 53 is a diagrammatical illustration showing the flow of information in a mode for assigning the tone color to the white switch;

DESCRIPTION OF THE PREFERRED EMBODIMENTS OF THE INVENTION

Figure 1:
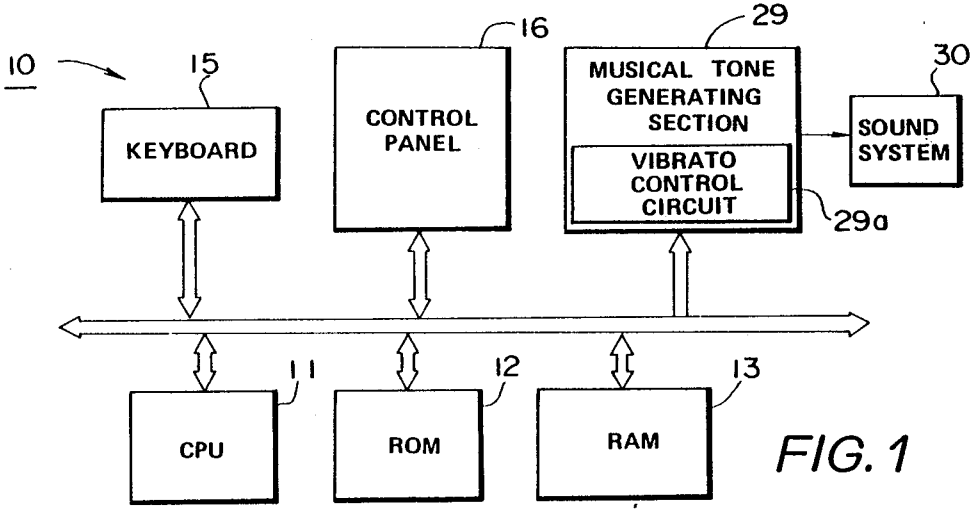
FIG. 1 is a block diagram of an electronic musical instrument 10 provided in accordance with a first embodiment of the invention.
Figure 2:
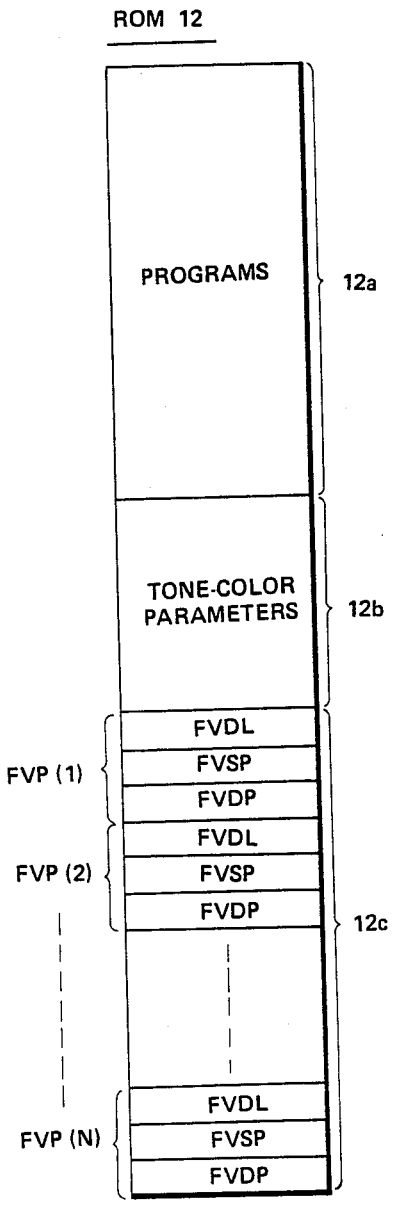
FIG. 2 is a memory map of the ROM 12 of the instrument 10 of FIG. 1.

FIG. 1 shows an electronic musical instrument 10 incorporating a parameter setting system provided in accordance with a first embodiment of the present invention. This electronic musical instrument 10 is so designed that any one of musical effects such as a vibrato, a tremolo and a celeste can be applied to a musical tone to be generated. However, only the construction and operation of the portion of the electronic musical instrument 10 relating to the vibrato effect will be hereinafter described. In FIG. 1, shown at 11 and 12 are a central processing unit (CPU) and a ROM, respectively. The ROM 12 comprises, as shown in FIG. 2, three storage areas 12*a* to 12*c*, wherein the storage area 12*a* stores programs to be executed by the CPU 11, the storage area 12*b* stores tone-color parameters, and the storage area 12*c* stores N sets of factory-preset vibrato parameters FVP(1) to FVP(N). The factory-preset vibrato parameters FVP(1) to FVP(N) are those vibrato parameters which are preset at the factory in the manufacturing process. The parameter FVP(1) is a parameter corresponding to a tone color represented by a tone-color code TC of "1", and the parameter FVP(N) is a parameter corresponding to a tone color represented by the tone-color code TC of "N". This is true of the other parameters FVP(2) to FVP(N-1). Each of the parameters FVP(1) to FVP(N) is composed of a delay parameter FVDL, a speed parameter FVSP and a depth parameter FVDP.

Figure 3:
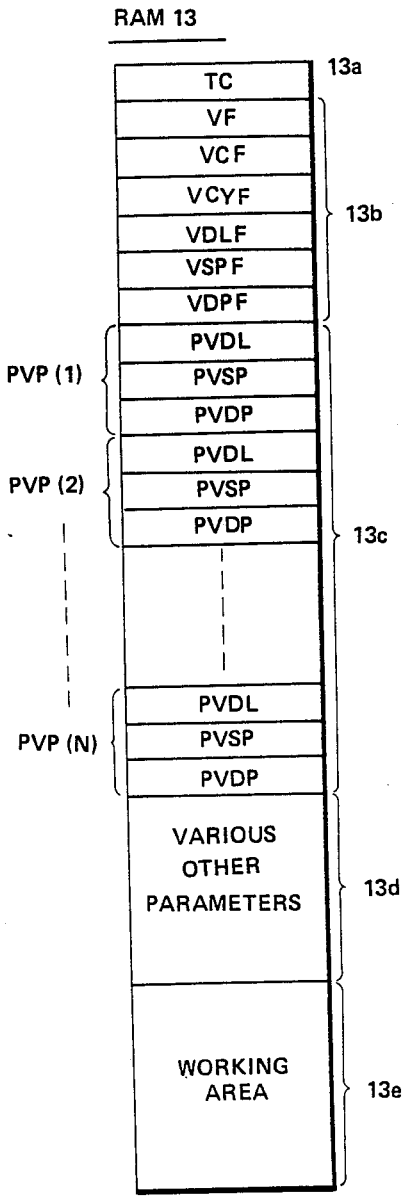
FIG. 3 is a memory map of the RAM 13 of the instrument 10 of FIG. 1.

A RAM 13 is provided for storing data and comprises, as shown in FIG. 3, a register 13*a* for storing the tone-color code TC, a flag area 13*b* for storing various kinds of flags, a vibrato parameter area 13*c* for storing N sets of player vibrato parameters PVP(1) to PVP(N), parameter area 13*d* for storing various kinds of parameters other than the vibrato parameters, and a working area 13e. In this case, the flag area 13b stores the following flags:

(a) Vibrato Flag VF

A flag which is "1" when the vibrato parameters are to be set and is "0" when the other parameters are to be set;

(b) Vibrato Copy Menu Flag VCF

A flag which is "1" when a vibrato copy menu (late described) is displayed on an LC display unit 19, and is "0" when such display is not effected;

(c) Vibrato Copy Yes Flag VCYF

A flag which is "1" in the case of "Copy Yes" as later described, and is "0" in the case of "Copy No";

(d) Vibrato Delay Menu Flag VDLF

A flag which is "1" when a delay parameter PVDL of the vibrato parameter is to be set and is otherwise "0";

(e) Vibrato Speed Menu Flag VSPF

A flag which is "1" when a speed parameter PVSP of the vibrato parameter is to be set and is otherwise "0"; and (f) Vibrato Depth Menu Flag VDPF A flag which is "1" when a depth parameter PVDP of the vibrato parameter is to be set and is otherwise "0".

The player vibrato parameters PVP(1) to PVP(N) are those vibrato parameters which are set by the player. The parameters PVP(1) to PVP(N) correspond respectively to the tone-color codes TC(1) to TC(N), and each of the parameters PVP(1) to PVP(N) is composed of the delay parameter PVDL, the speed parameter PVSP and the depth parameter PVDP.

Referring again to FIG. 1, a keyboard 15 comprises a plurality of keys each of which is provided with a key switch for detecting an operation state the corresponding key. A control panel 16 comprises, as shown in detail in FIG. 4, a multi-menu unit 18 which includes the LC (liquid crystal) display unit 19, menu selection switches 20L, 20U, 20D and 20R, a pair of data switches 21D and 21U, and an enter switch 22. The multi-menu unit 18 is provided for setting parameters, and, in this electronic musical instrument 10, various parameters inclusive of the vibrato parameter can be set through this multi-menu unit 18. A multi-menu switch unit 24 comprises a plurality of switches for designating the parameters to be set by the multi-menu unit 18. A control unit 25 comprises other control means such as a tone-volume control lever and a musical effect ON/-OFF switch which have no relation to the multi-menu unit 18. A tone-color selection switch unit 26 comprises tone-color selection switches 27 and LED indicators 28 corresponding respectively to the tone-color selection switches 27. When a tone color is selected by depressing one of the tone-color selection switches 27, that LED indicator 28 corresponding to the selected tone color comes on.

A musical tone generating section 29 comprises a plurality of tone generating channels each for forming a musical tone signal and a vibrato control circuit 29a. The musical tone signal outputted from the musical tone generating section 29 is supplied to a sound system 30. The sound system 30 amplifies the supplied musical tone signal and outputs a musical tone from a loudspeaker incorporated therein.

The operation of the electronic musical instrument 10 will now be described with reference to flow charts shown in FIGS. 5 to 12.

Figure 5:
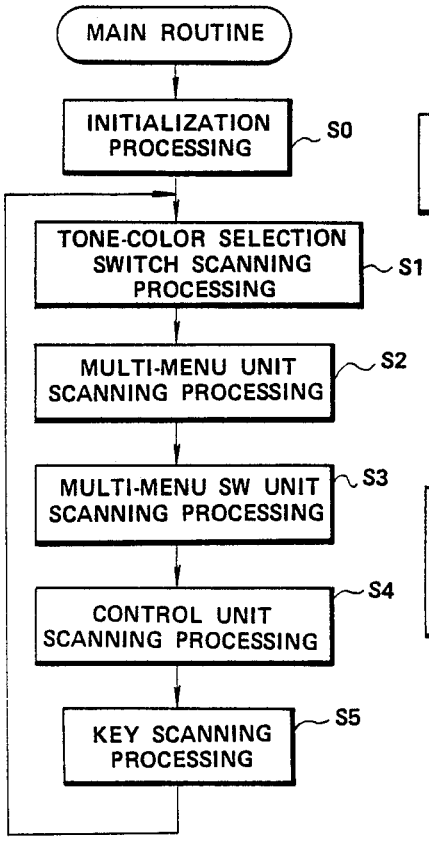
FIG. 5 is a flow chart of a main routine executed by the CPU 11 of the instrument 10 of FIG. 1.

FIG. 5 shows a main routine executed by the CPU 11. As shown, the main routine includes various processings which will hereunder be described one by one in the order of execution.

(I-i) Initialization Processing S0

When power is supplied to the electronic musical instrument 10, the CPU 11 starts to execute the main routine from this initialization processing S0. More, specifically, the CPU 11 clears various registers provided in the musical tone generating section 29, and transfers the factory-preset vibrato parameters FVP(1) to FVP(N) contained in the storage area 12c (FIG. 2) of the ROM 12 to the area 13c (FIG. 3) of the RAM 13.

(I-ii) Tone-Color Selection Switch Scanning Processing S1

Figure 4:
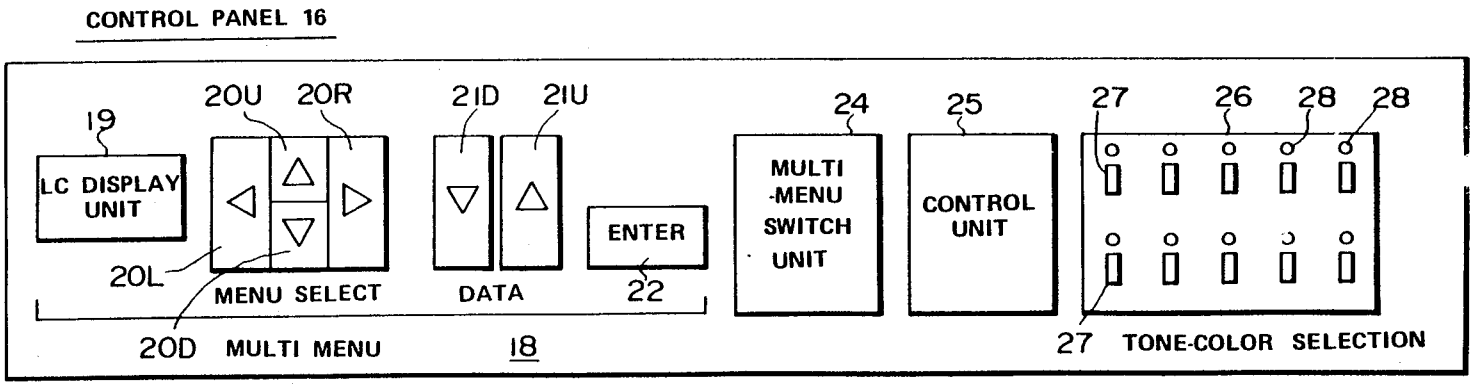
FIG. 4 is an diagrammatical illustration of the control panel 16 of the instrument 10 of FIG. 1.

The CPU 11 carries out this processing S1 by first sequentially scanning the tone-color selection switches 27 provided in the tone-color selection switch unit 26 (FIG. 4). The CPU 11 then determines, in accordance with the result of the scanning, whether there has been a change of operation-state (or an event) of the switches 27.

Figure 6:
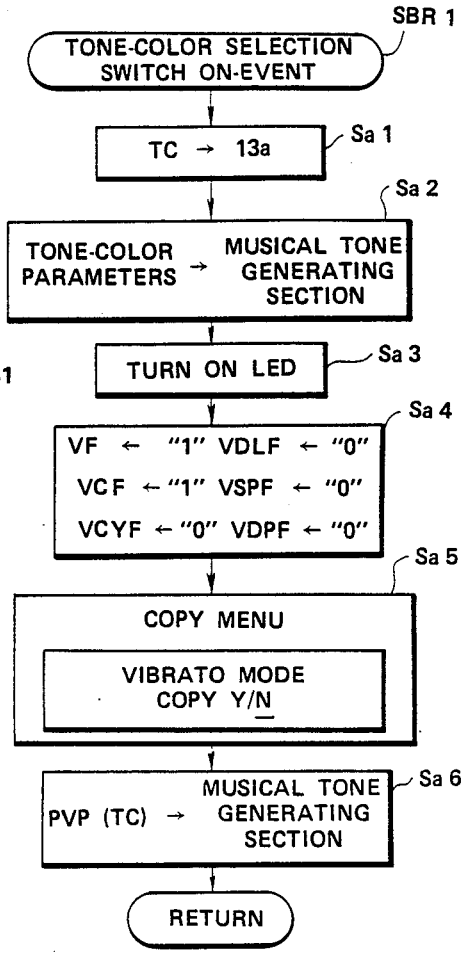
FIG. 6 is a flow chart of a subroutine SBR1 which is executed in response to an ON event of the tone-color selection switch 27 of FIG. 4.

When an ON-event of any one of the switches 27 is detected, the CPU 11 executes a subroutine SBR1 shown in FIG. 6. In the subroutine SBR1, the CPU 11 first stores at step Sa1 the tone-color code TC, corresponding to that tone-color selection switch 27 of which ON-event has just been detected, into the register 13a (FIG. 3) of the RAM 13. The processing then proceeds to step Sa2 at which the tone-color parameters corresponding to the tone-color selection switch 27 which has been turned on are read from the storage area 12b of the ROM 12. The tone-color parameters thus read from the area 12b are outputted to the musical tone generating section 29. At the next step Sa3, the LED indicator 28 corresponding to the above tone-color selection switch 27 is turned on and the other LED indicators 28 are turned off. Then, the processing proceeds to step Sa4 at which each of the vibrato flag VF and the vibrato copy menu flag VCF in the area 13b is set to "1", and at the same time each of the vibrato copy yes flag VCYF, the vibrato delay menu flag VDLF, the vibrato speed menu flag VSPF and the vibrato depth menu flag VDPF is set to "0". At the next step Sa5, the following menu is displayed on the LC display unit 19:

VIBRATO MODE

COPY Y/N

The above menu is hereunder referred to as a "copy menu". The meaning of this copy menu is: "The instrument 10 is now in the mode for setting parameters for the vibrato effect. Do you use the factory-preset vibrato parameter, or do you wish to change the vibrato parameter (or do you use the player vibrato parameter)?"The bar indicated just under the character "N" is a cursor. Then, the processing proceeds to the next step Sa6 at which the player vibrato parameter PVP corresponding to the tone-color code TC contained in the register 13a is read from the area 13c (FIG. 3) and supplied to the vibrato control circuit 29a in the musical tone generating section 29. Thus, the factory-preset vibrato parameter FVP(TC) is set in the musical tone generating section 29 in this case (refer to the processing S0). The processing then returns to the main routine. In this condition, when the player performs a music on the keyboard 15, the musical tone generated is given the vibrato effect determined by the factory-preset vibrato parameter FVP(TC). Thus, the player can confirm the vibrato effect applied based on the factory-preset vibrato parameter FVP(TC) by his ear.

(I-iii) Multi-Menu Unit Scanning Processing S2

The CPU 11 carries out this processing at the step S2 of FIG. 5 in which the switches 20L, 20U, 20D, 20R, 21U, 21D and 22 are sequentially scanned. The CPU 11 then detects ON events of these switches 20L to 20R, 21U, 21D and 22 in accordance with the results of the scanning. The CPU 11 performs one of the following processings in accordance with the kind of the switch of which ON event has been detected:

(I-iii-1) Menu Selection Switch 20L

Figure 7:
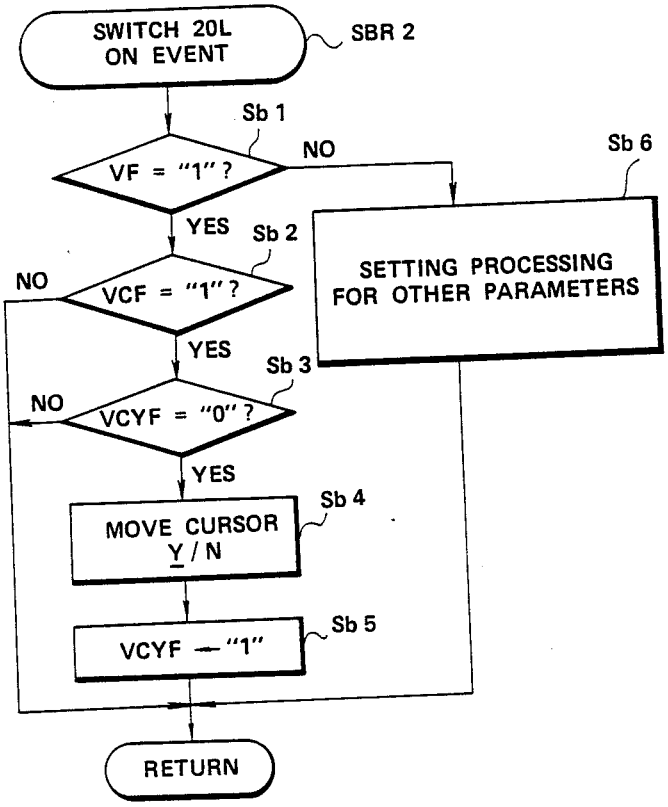
FIG. 7 is a flow chart of a subroutine SBR2 which is executed in response to an ON event of the switch 20L of FIG. 4.

When an ON event of this switch 20L has been detected, the CPU 11 executes a subroutine SBR2 shown in FIG. 7. At the first step Sb1, the CPU 11 determines whether the vibrato flag VF (FIG. 3) is in the "1" state. If the result of the determination is "Yes", that is to say, if the instrument 10 is in the vibrato parameter setting mode, the processing proceeds to step Sb2 at which it is further determined whether the vibrato copy menu flag VCF is "1". If the result of the determination is "Yes", that is, the copy menu is displayed on the LC display unit 19, the processing proceeds to step Sb3 at which it is determined whether the vibrato copy yes flag VCYF is "1". The vibrato copy yes flag VCYF is rendered "1" when the cursor is displayed just under the character "Y" of the copy menu, that is, in the case of "Copy Yes". On the other hand, when the cursor is displayed just under the character "N", that is, in the case of "Copy No", the vibrato copy yes flag VCYF is rendered "0". If the result of the determination at the step Sb3 is "Yes", that is to say, if the cursor is displayed just under the character "N", the processing proceeds to step Sb4 at which the cursor is moved so as to be displayed just under the character "Y". At the next step Sb5, the CPU 11 stores "1" into the area **13*b*** as the vibrato copy yes flag VCYF. Then, the processing returns to the main routine.

On the other hand, if the result of the determination at the step Sb1 is "No", that is, if the instrument 10 is in a mode for setting parameters other than the vibrato parameter, the processing proceeds to step Sb6. At the step Sb6, a processing for the ON event is performed with respect to the other parameters in a manner described above for the vibrato parameter. If the result of the determination at the step Sb2 is "No", that is, the copy menu is not displayed, the processing returns to the main routine. Similarly, if the result of the determination at the step Sb3 is "No", that is, the cursor is displayed just under the character "Y", the processing returns to the main routine.

As will be appreciated from the above, when the switch 20L is turned on in the vibrato parameter setting mode, the cursor is caused to be displayed just under the character "Y" of the copy menu.

(I-iii-2) Menu Selection Switch 20R

Figure 8:
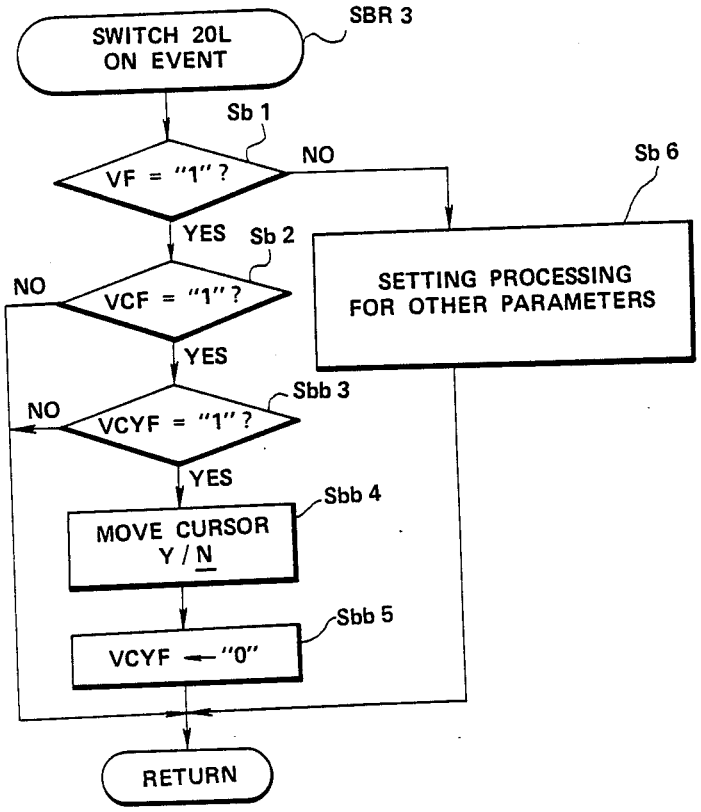
FIG. 8 is a flow chart of a subroutine SBR3 which is executed in response to an ON event of the switch 20R of FIG. 4.
Figure 9:
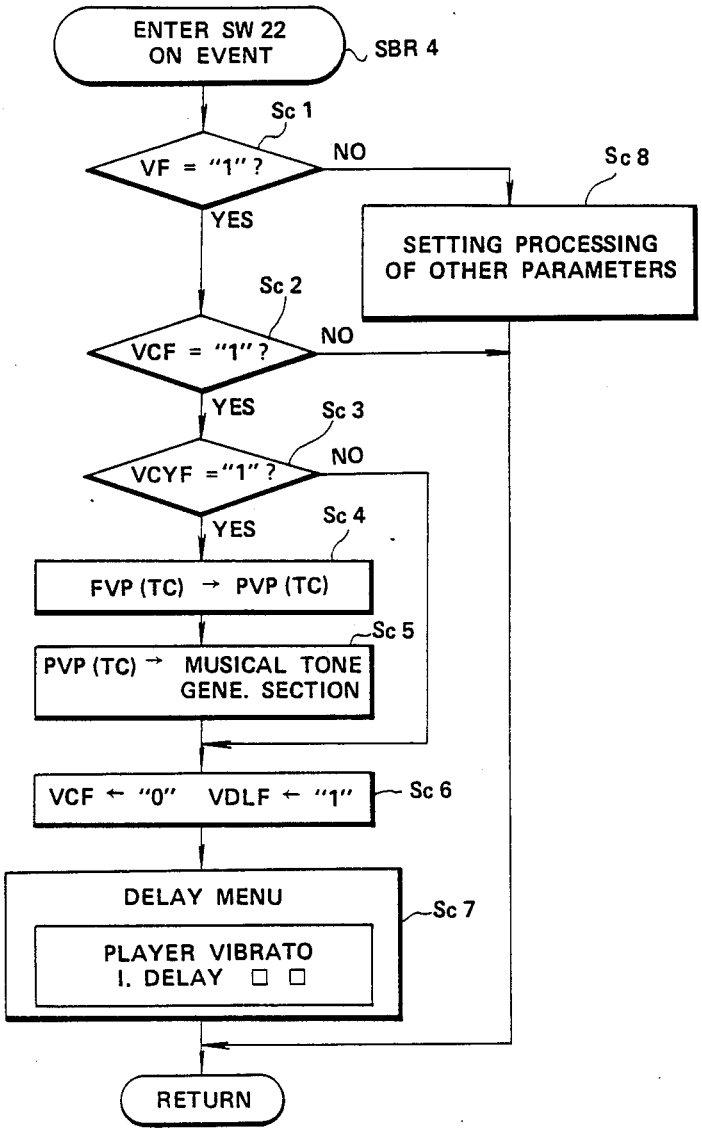
FIG. 9 is a flow chart of a subroutine SBR4 which is executed in response to an ON event of the switch 22 of FIG. 4.

When an ON event of the switch 20R is detected, the CPU 11 executes a subroutine SBR3 shown in FIG. 8. The processing performed in this subroutine SBR3 is substantially equal to that in the aforesaid subroutine SBR2, and is different therefrom only in the following respects. At step Sbb3, it is determined whether the vibrato copy yes flag VCYF is "1", and, at step Sbb4, the cursor is moved to just under the character "N". Furthermore, at step Sbb5, the vibrato copy yes flag VCYF is rendered "0". Thus, when the switch 20R is turned on in the vibrato parameter setting mode, the cursor in the copy menu is moved so as to be displayed just under the character "N".

(I-iii-3) Enter Switch 22

The player turns on this enter switch 22 after selecting the cursor position in the copy menu by operating the switch 20L or the switch 20R. When the ON event is detected, the CPU 11 executes a subroutine SBR4 shown in FIG. 9. The CPU 11 first determines, at step Sc1 of this subroutine SBR4, whether the vibrato flag VF is "1". If the result of this determination is "Yes", the processing proceeds to step Sc2 at which it is determined whether the vibrato copy flag VCF is "1". If the result of the determination is "Yes", the processing proceeds to step Sc3 at which it is further determined whether the vibrato copy yes flag VCYF is "1". If the result of this determination is "Yes", that is to say, if the player has selected the factory-preset vibrato parameter, the processing proceeds to step Sc4. At this step Sc4, the factory-preset vibrato parameter FVP corresponding to the tone-color code TC in the register **13*a* (FIG. 3), i.e., the factory-preset vibrato parameter FVP(TC), is read from the area 12*c* of the ROM 12 and stored into the area 13*c* of the RAM 13 as the player vibrato parameter PVP(TC). At the next step Sc5, the player vibrato parameter PVP(TC) is outputted to the vibrato control circuit 29*a* of the musical tone generating section 29. As a result, the factory-preset vibrato parameter is set in the vibrato control circuit 29*a*. At the next step Sc6, the vibrato copy menu flag VCF and the vibrato delay menu flag VDLF are rendered "0" and "1", respectively. The vibrato delay menu flag VDLF is thus rendered "1", so that the instrument 10 is brought into the delay parameter setting mode. At the next step Sc7, the following menu is displayed on the LC display unit 19**, this menu being hereinafter referred to as a "delay menu".

PLAYER VIBRATO

1. DELAY ▯▯

The delay parameter PVDL of the player vibrato parameter PVP(TC) is displayed at the ▯▯. Then, the processing returns to the main routine. On the other hand, if the result of the determination at the step Sc1 is "No", the processing proceeds to step Sc8 at which a processing for the enter-switch ON event is performed with respect to the other parameters in a manner described above for the vibrato parameter. If the result of the determination at the step Sc2 is "No", the processing returns to the main routine. On the other hand, if the result of the determination at the step Sc3 is "No", the steps Sc4 and Sc5 are skipped and the processing proceeds to the step Sc6.

Thus, when the player turns on one of the tone-color selection switches 27, subsequently selects the cursor position in the copy menu, and then turns on the enter switch 22, the results of the determinations at the steps Sc1 and Sc2 both become "Yes", so that the processing proceeds to the step Sc3. When the player has selected the "Y" by the cursor, the processings of the steps Sc4 and Sc5 are performed, and then the processings of the steps Sc6 and Sc7 are performed. On the other hand, when the player has selected the "N" by the cursor, the steps Sc4 and Sc5 are skipped, and the processings of the steps Sc6 and Sc7 are performed. The processing of the step Sc7 is performed to set the delay parameter to a desired value. More specifically, the player sets the delay parameter to a desired value by operating the data switches 21U and 21D in the following manner.

(I-iii-4) Data Switch 21U

Figure 10:
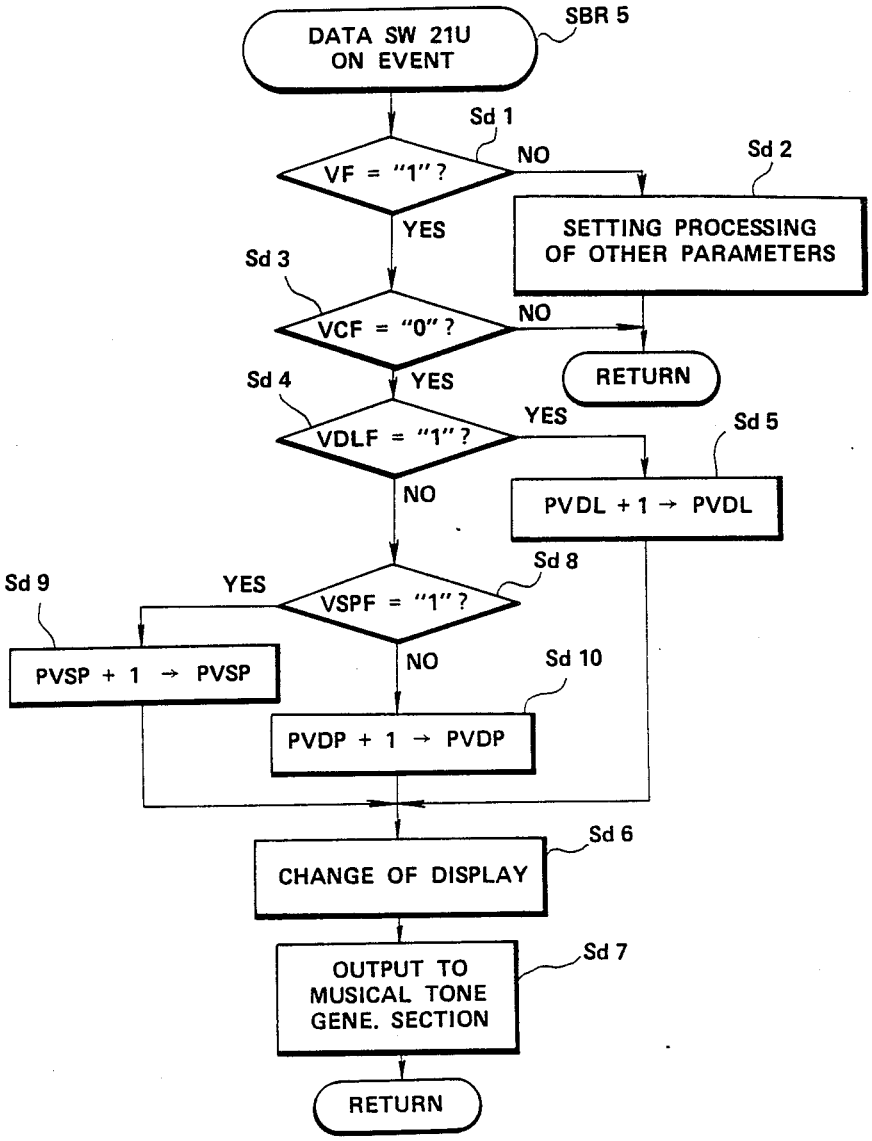
FIG. 10 is a flow chart of a subroutine SBR5 which is executed in response to an ON event of the switch 21U of FIG. 4.

When an ON event of this data switch 21U is detected, the CPU 11 executes a subroutine SBR5 shown in FIG. 10. The CPU 11 first determines, at step Sd1 of this subroutine SBR5, whether the vibrato flag VF is "1". If the result of this determination is "No", the processing proceeds to step Sd2 at which an ON event processing of the data switch 21U is performed with respect to the other parameters. Then, the processing returns to the main routine. On the other hand, if the result of the determination at the step Sd1 is "Yes", the processing proceeds to step Sd3. At this step Sd3, it is determined whether the vibrato copy menu flag VCF is "0". When the result of this determination is "No", the processing returns to the main routine, while when the result i "Yes", the processing proceeds to step Sd4. At this step Sd4, it is determined whether vibrato delay menu flag VDLF is "1". If the result of this determination is "Yes", the processing proceeds to step Sd5 at which the delay parameter PVDL of the player vibrato parameter PVP(TC) in the area 13*c* (FIG. 3) is incremented by one. Then, the processing proceeds to step Sd6 at which the above parameter PVD is outputted to the LC display unit 19. As a result, the value displayed in the delay menu at the [][] is changed. Then, the processing proceeds to the next step Sd7 at which the parameter PVDL is outputted to the vibrato control circuit 29*a* of the musical tone generating section 29.

Thus, if the data switch 21U is turned on once during the time when the delay menu is displayed (or when the flag VDLF is "1"), the value of the player vibrato parameter PVDL is incremented by one. If the data switch 21U is turned on twice, the value of the parameter PVDP is incremented by two. Thus, the value of the parameter PVDL is incremented by one each time the data switch 21U is turned on.

On the other hand, if the result of the determination at the step Sd4 is "No", the processing proceeds to step Sd8 at which it is determined whether the vibrato speed flag VSPF is "1". If the result of this determination is "Yes", the processing proceeds to step Sd9 at which the speed parameter PVSP of the player vibrato parameter PVP(TC) is incremented by one. On the other hand, if the result of the determination at the step Sd8 is "No", the processing proceeds to step Sd10 at which the depth parameter PVDP of the player vibrato parameter PVP(TC) is incremented by one. The processing proceeds from the step Sd9 or Sd10 to the step Sd6. The processings performed at the steps Sd8 to Sd10 will be more fully described later.

The maximum value of each of the parameters PVDL, PVSP and PVDP is predetermined. Therefore, when each of the parameters PVDL, PVSP and PVDP reaches its maximum value by the operation of the data switch 21U, the parameter will not be increased any more even if the data switch 21U is further operated.

(I-iii-5) Data Switch 21D

When an ON event of the data switch 21D is detected, the CPU 11 executes a subroutine SBR6 (not shown). This subroutine SBR6 is substantially equal to the above-described subroutine SBR5 and differs therefrom only in that in each of the steps Sd5, Sd9 and Sd10 the corresponding data to be processed is not incremented but decremented by one. More specifically, for example, when the data switch 21D is turned on once during the time when the delay menu is displayed, that is, during the time when the flag VDLF is "1", the delay parameter PVDL is decremented by one. When the data switch 21D is turned on twice, three times and so on, the parameter PVDL is decreased by two, three and so on. This is true of the parameters PVSP and PVDP. The minimum value of each of the parameters PVDL, PVSP and PVDP is predetermined. Therefore, when each of the parameters PVDL, PVSP and PVDP reaches its minimum value, the parameter will not be decreased any more even if the switch 21D is further operated.

After the delay parameter PVDL has thus been set to a desired value by the operation of the data switches 21U and 21D, the player sets the speed parameter PVSP to a desired value. In this case, the player first turns on the menu selection switch 20U.

(I-iii-6) Menu Selection Switch 20U

Figure 11:
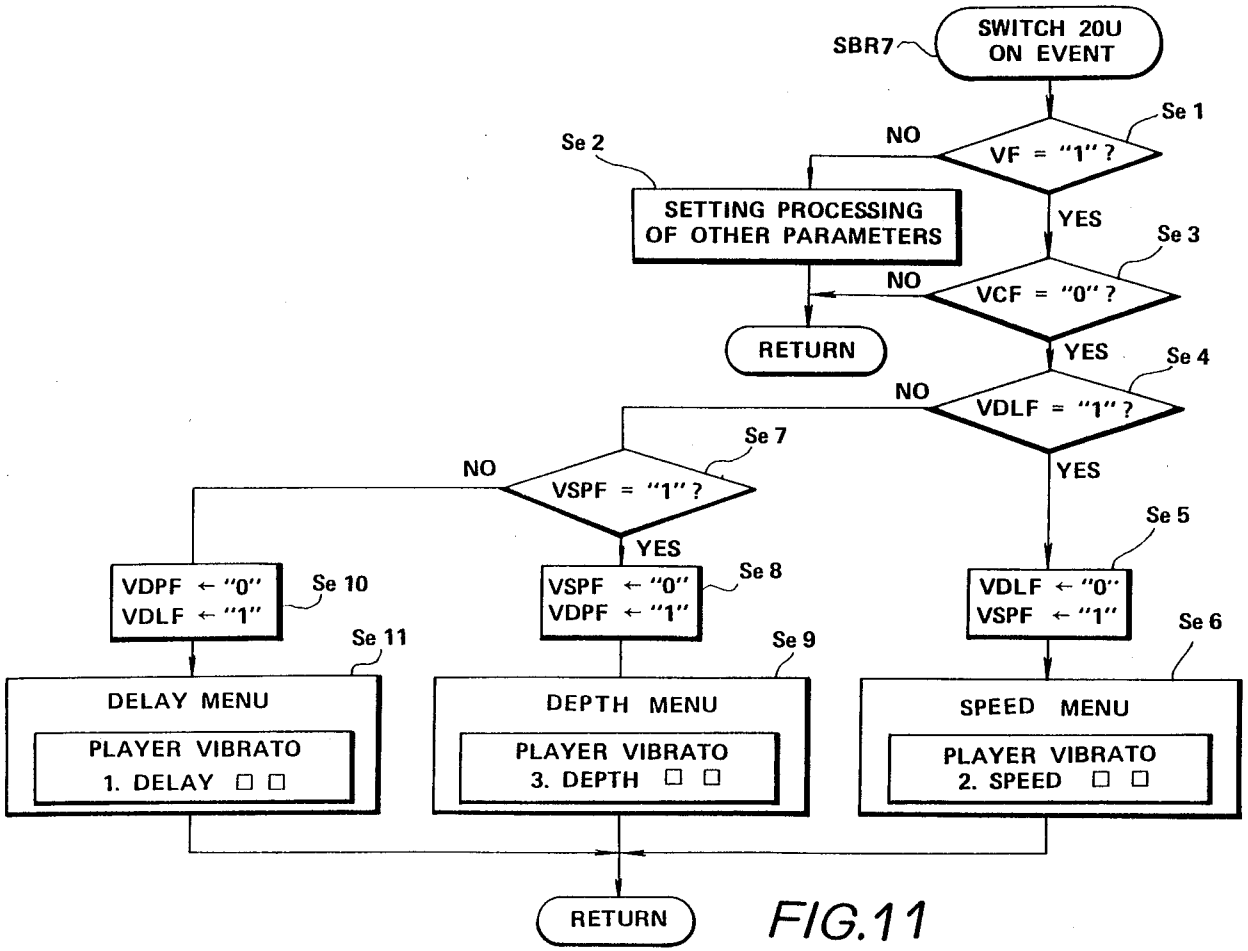
FIG. 11 is a flow chart of a subroutine SBR7 which is executed in response to an ON event of the switch 20U of FIG. 4.
Figure 12:
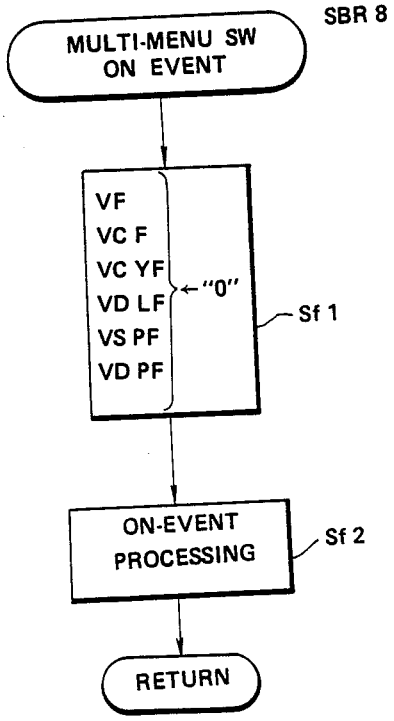
FIG. 12 is a flow chart of a subroutine SBR8 which is executed in response to an ON event of a switch of the multi-menu switch unit 24 of FIG. 4.

When an ON event of this switch 20U is detected, the CPU 11 executes a subroutine SBR7 shown in FIG. 11. The CPU 11 first determines, at step Se1, whether the vibrato flag VF is "1". If the result of this determination is "No", the processing proceeds to step Se2 at which a processing for setting other parameters is carried out, and the processing then returns to the main routine. On the other hand, if the result of the determination is "Yes", the processing proceeds to step Se3 at which it is determined whether the vibrato copy menu flag VCF is "0". If the result of the determination is "No", the processing returns to the main routine. On the other hand, if the result of the determination is "Yes", the processing proceeds to step Se4 at which it is further determined whether the vibrato delay menu flag VDLF is "1". If the result of this determination is "Yes", the processing proceeds to step Se5. At this step Se5, the vibrato delay menu flag VDLF and the vibrato speed menu flag VSPF are rendered "0" and "1", respectively. The vibrato speed menu flag VSPF is thus rendered "1", so that the instrument 10 is brought into the speed data setting mode. Then, the processing proceeds to the next step Se6, at which the following menu (hereinafter referred to as a "speed menu") is displayed on the LC display unit 19:

PLAYER VIBRATO

2. SPEED [][]

Displayed at the [][] of this speed menu is the speed parameter PVSP of the player vibrato parameter PVP(TC). The processing then returns to the main routine. Thus, when the switch 20U is turned on once after the setting of the delay parameter PVDL has been completed, the speed flag is rendered "1", and at the same time the above speed menu is displayed. In this condition, the player sets the speed parameter PVSP to a desired value by operating the data switches 21U and 21D in a manner described above for the delay parameter PVDL. In this case, the result of the determination at the step Sd8 becomes "Yes", so that the processing of the step Sd9 is performed.

After completing the setting of the speed parameter PVSP, the player sets the depth parameter PVDP to a desired value in the following manner. In this case, the player again turns on the switch 20U.

When the switch 20U is turned on, the CPU 11 again executes the subroutine SBR7. This time, the processing proceeds through the steps Se1 and Se3 to the step Se4 at which it is determined that the flag VDLF is not "1"

(see the step Se5), so that the processing proceeds to step Se7. At this step Se7, it is determined whether the vibrato speed menu flag VSPF is "1". In this case, the result of the determination becomes "Yes", so that the processing proceeds to step Se8 at which the vibrato speed menu flag VSPF and the vibrato depth menu flag VDPF are rendered "0" and "1", respectively. At the next step Se9, the following menu (hereinafter referred to as a "depth menu") is displayed on the LC display unit 19:

PLAYER VIBRATO

3. DEPTH ▯▯

Displayed at the ▯▯ of this depth menu is the depth parameter PVDP of the player vibrato parameter PVP(TC). Then, the processing returns to the main routine.

Thus, when the player turns on the switch 20U once after completing the setting of the speed parameter PVSP, the vibrato depth menu flag VDPF is rendered "1", and at the same time the above depth menu is displayed. In this condition, the player sets the depth parameter PVDP to a desired value by operating the data switches 21U and 21D in a manner described above for the setting of the delay parameter PVDL. In this case, the results of determination at the steps Sd4 and Sd8 both become "No", so that the processing of the step Sd10 is performed. In this manner, the parameters PVDL, PVSP and PVDP are set respectively to desired values.

When the player turns on the switch 20U after completing the setting of the depth parameter PVDP, the CPU 11 again executes the subroutine SBR7. This time, the processing proceeds through the steps Se1, Se3 and Se4 to the step Se7 at which it is determined that the vibrato speed menu flag VSPF is not "1" (see the step Se8). Therefore, the processing proceeds from the step Se7 to step Se10 at which the vibrato depth menu flag VDPF and the vibrato delay menu flag VDLF are rendered "0" and "1", respectively. The the processing proceeds to the next step Se11 at which the delay menu is again displayed to enable the setting of the delay parameter PVDL. When the switch 20U is again turned on, the speed menu is displayed. In this manner, each time the switch 20U is turned on, the displayed menu is changed from the speed menu to the depth menu, from the depth menu to the delay menu, and so on.

(I-iii-7) Menu Selection Switch 20D

Each time the switch 20D is turned on, the menu displayed on the LC display unit 19 is changed in the reversed order, that is to say, from the delay menu to the depth menu, from the depth menu to the speed menu, from the speed menu to the delay menu, an so on. The processing performed by the CPU 11 in response to each ON event of the switch 20D is substantially equal to that of the subroutine SBR7, and therefore a description thereof is omitted.

The foregoing is the detail of the multi-menu unit scanning processing S2.

(I-iv) Multi-Menu Switch Unit Scanning Processing S3

The CPU 11 starts to carry out this processing S3 by scanning the respective switches of the multi-menu switch unit 24 to detect ON events of the switches based on the result of the scanning. When an ON event of any of the switches is detected, the CPU 11 executes a subroutine SBR8 shown in FIG. 12. At the first step Sf1 of this subroutine SBR8, the CPU 11 clears all the flags relating to the vibrato, namely, the vibrato flag VF, the copy menu flag VCF, the copy yes flag VCYF, the delay menu flag VDLF, the speed menu flag VSPF and the depth menu flag VDPF. Once the processing of the step Sf1 is performed, the vibrato parameters can not be changed thereafter. Then, the processing proceeds to the next step Sf2 at which the CPU 11 performs various processings to set the parameter corresponding to the switch of which ON event has been detected, such processings including the display of parameter on the LC display unit 19.

(I-v) Control Unit Scanning Processing S4

The CPU 11 starts to carry out this processing S3 by scanning outputs of the respective control means of the control unit 25 to detect events of the control means based on the result of the scanning. When an event of any of the control means is detected, the CPU 11 executes a processing provided correspondingly to the event of the control means. For example, a parameter (data representative of ON or OFF of a musical effect, data representative of a tone volume, or the like) corresponding to the control means of which event has been detected is outputted to the musical tone generating section 29.

(I-vi) Key Scanning Processing S5

The CPU 11 starts to carries out this processing S5 by scanning the key switches of the keyboard 15 (FIG. 1) to detect an ON or an OFF event of any of the keys based on the result of the scanning. The CPU 11 performs a processing for assigning the key whose ON event has just been detected to one of the plurality of tone generating channels, and then outputs a key code representative of the key, channel data representative of the assigned tone generating channel and a key-ON signal representative of the ON event of the key to the musical tone generating section 29. As a result, the musical tone signal corresponding the key whose ON event has been detected is formed by the musical tone generating section 29, and outputted to the sound system 30. When an OFF event of key has been detected, the CPU 11 detects the tone generating channel to which the key corresponding to the OFF event has been assigned. Then, the CPU 11 outputs channel data representative of the detected tone generating channel and a key-OFF signal representative of the OFF event of the key to the musical tone generating section 29. As a result, the musical tone signal corresponding to the OFF event key begins to decay.

After completing the above-described processing S5, the CPU 11 again performs the tone-color selection switch scanning processing S1. Thereafter, the CPU 11 continues to perform the processings in the aforesaid manner.

Modified forms of the above-described first embodiment will now be briefly described.

The first embodiment is described particularly as to the setting of the vibrato parameter. It will be however evident that the parameter setting system according to the present invention can also be so designed that other parameters such as a parameter relating to other musical effects, a tone color itself and/or an envelope waveform are brought into a changeable state.

With the arrangement of the first embodiment, N sets of player vibrato parameters PVP(1) to PVP(N) are provided correspondingly to the respective tone colors. To save the memory capacity, the RAM 13 may be modified to store only one set of player vibrato parameter or to store a few sets of player vibrato parameters each set for a group of tone colors.

The first embodiment is so designed that each circuit section thereof is controlled by the corresponding control program. Each circuit section of the system may alternatively be controlled by a hardware provided for the section.

With the arrangement of the first embodiment, the change of each parameter is performed by operating the data switches (or up and down switches) 21U and 21D. Each parameter may alternatively be changed through a ten-key or a potentiometer.

The first embodiment may be modified to have a switch for controlling the ON/OFF of the vibrato effect to enable the vibrato parameter to be changed only when the switch is turned on.

With the arrangement of the first embodiment when the tone-color selection switch 27 is operated, the instrument 10 is automatically brought into the vibrato parameter setting mode. The first embodiment may be modified to be subsequently brought into a setting mode for other parameters such as a tremolo and an envelope in such a case. According to one example of such a modification, when the enter switch 22 is turned on after the setting, for example, of the vibrato speed, the setting of the tremolo speed, tremolo depth and so on is enabled.

A second embodiment of the invention will now be described.

An electronic musical instrument $10_2$ incorporating a parameter setting system according to the second embodiment of the invention is similar to the above-described electronic musical instrument 10 shown in FIG. 1, but differs from the instrument 10 in the following respects.

Figure 13:
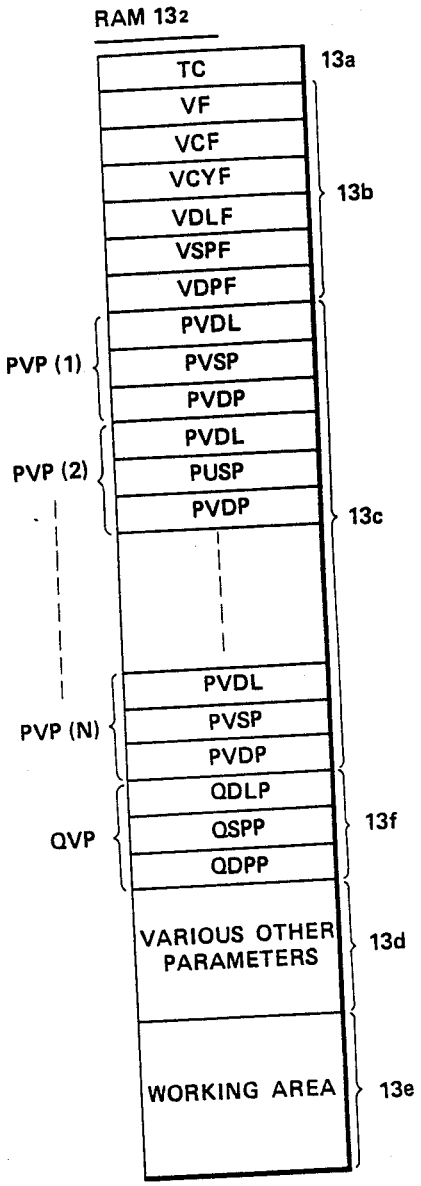
FIG. 13 is a memory map of a RAM $\mathbf{13}_2$ of an electronic musical instrument $\mathbf{10}_2$ provided in accordance with a second embodiment of the invention.

As shown in FIG. 13, a RAM 132 of this instrument $10_2$ is similar in structure to the RAM 13 of FIG. 3, but further comprises a storage area 13*f* for storing a quit vibrato parameter QVP. The quit parameter QVP is the parameter which has been precedingly selected by the player. More specifically, when the player changes the vibrato parameter (or selects a new vibrato parameter), the precedingly selected vibrato parameter is automatically stored in the area 13*f* as the quit vibrato parameter QVP. This quit vibrato parameter QVP is composed of a delay parameter QDLP, a speed parameter QSPP and a depth parameter QDPP.

Figure 14:
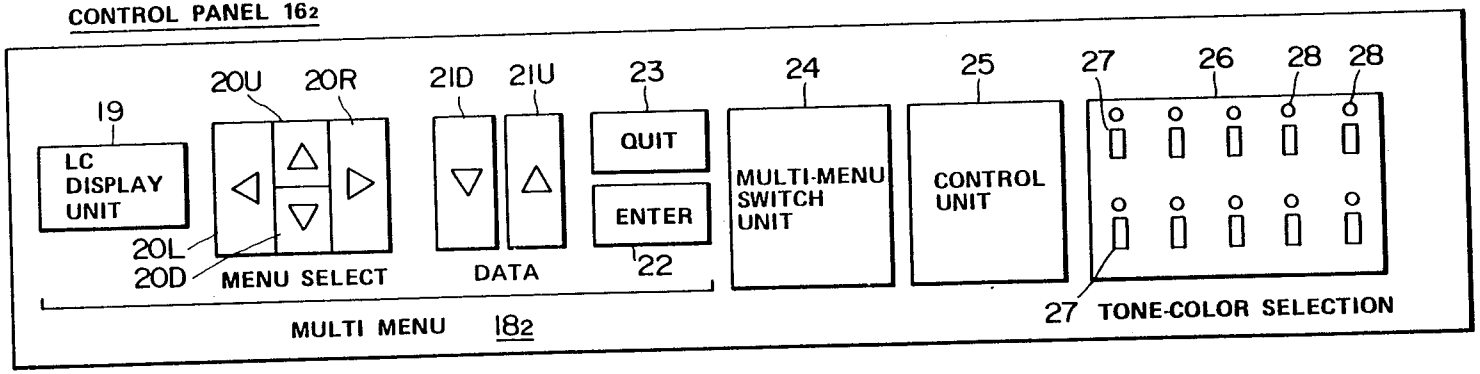
FIG. 14 is a diagrammatic illustration showing a control panel $\mathbf{16}_2$ of the second embodiment of the invention.

A control panel $16_2$ of the instrument $10_2$ according to this second embodiment further comprises, as shown in FIG. 14, a quit switch 23 at a multi-menu unit $18_2$.

The operation of this second embodiment will now be described with reference to flow charts.

Figure 15:
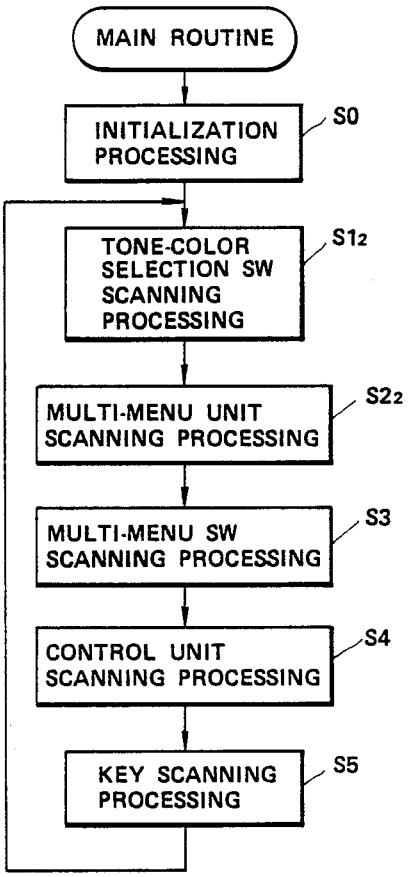
FIG. 15 is a flow chart of a main routine of the second embodiment of the invention.

FIG. 15 shows a main routine of this second embodiment which is substantially identical to that shown in FIG. 5. Steps of this main routine will now be described one by one.

(II-i) Initialization Processing S0

This initialization processing S0 is identical to that of the first embodiment.

(II-ii) Tone-Color Selection Switch Scanning Processing $S1_2$

Figure 16:
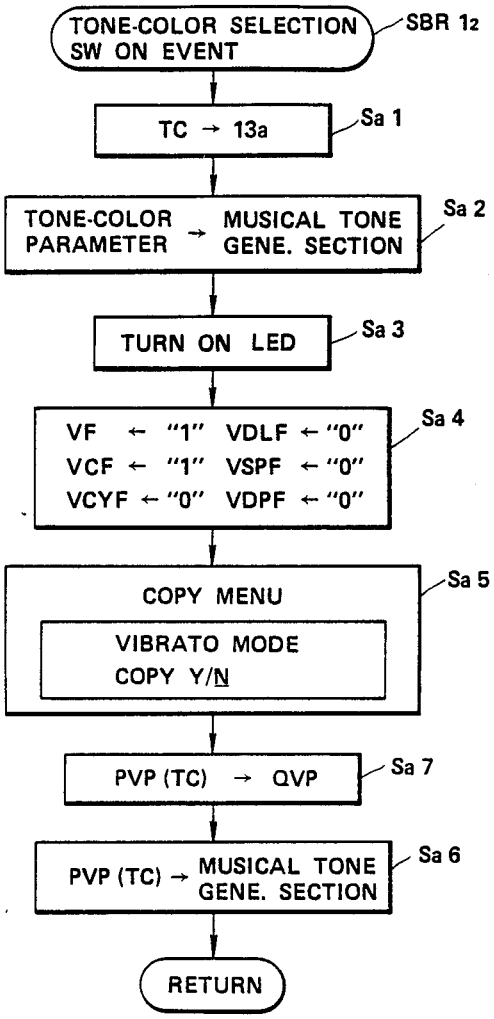
FIG. 16 is a flow chart of a subroutine SBR$\mathbf{1}_2$ which is executed in response to an ON event of the tone-color selection switch 27 of FIG. 14.

This tone-color selection switch scanning processing $S1_2$ is similar to that of the first embodiment. When an ON event of any of the tone-color selection switches 27 is detected, the CPU 11 executes a subroutine $SBR1_2$ shown in FIG. 16. This subroutine $SBR1_2$ differs from the subroutine SBR1 of FIG. 6 in that it comprises additional step Sa7 between the steps Sa5 and Sa6. At the step Sa7, the player vibrato parameter PVP(TC) corresponding to the tone-color code TC contained in the register 13*a* is stored into the storage area 13*f* as the quit vibrato parameter QVP. By this processing, the vibrato parameter before changing is temporarily stored in the storage area 13*f*.

(II-iii) Multi-Menu Unit Scanning Processing $S2_2$

The CPU 11 begins to carry out this processing $S2_2$ by first scanning the switches 20L, 20U, 20D, 20R, 21U, 21D, 22 and 23 to detect ON events of these switches. The CPU 11 then performs a processing in accordance with the kinds of the switches of which ON events have been detected, as follows.

(II-iii-1) Menu Selection Switch 20L

Figure 17:
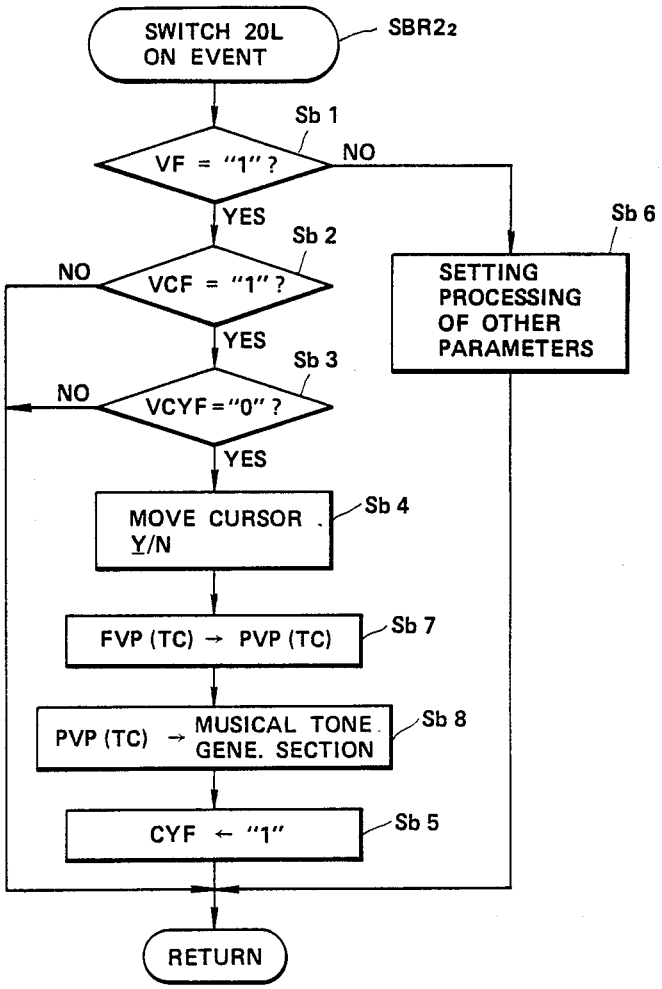
FIG. 17 is a flow chart of a subroutine SBR$\mathbf{2}_2$ which is executed in response to an ON event of the switch 20L of FIG. 14.

When an ON event of the switch 20L is detected, the CPU 11 executes a subroutine $SBR2_2$ shown in FIG. 17. This subroutine $SBR2_2$ is similar to the subroutine SBR2 of FIG. 7 but further comprises, between the steps Sb4 and Sb5, steps Sb7 and Sb8. At the step Sb7, the factory-preset vibrato parameter corresponding to the tone-color code TC contained in the register 13*a*, that is, the parameter FVP(TC), is stored into the area 13*c* as the player vibrato parameter PVP(TC). The processing then proceeds to the next step Sb8 at which the player vibrato parameter PVP(TC) is outputted to the vibrato control circuit 29*a* of the musical tone generating section 29. Thus, when the cursor is displayed just under the character "Y", the factory-preset vibrato parameter FVP(TC) is set in the musical tone generating section 29.

(II-iii-2) Menu Selection Switch 20R

Figure 18:
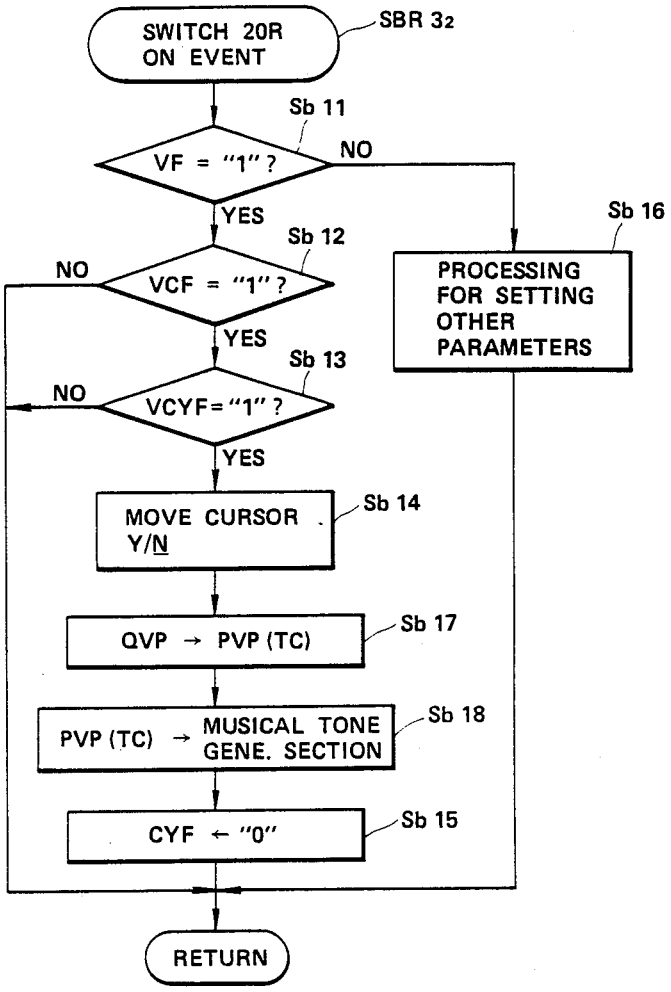
FIG. 18 is a flow chart of a subroutine SBR$\mathbf{3}_2$ which is executed in response to an ON event of the switch 20R of FIG. 14.

When an ON event of the switch 20R is detected, the CPU 11 executes a subroutine $SBR3_2$ shown in FIG. 18. This subroutine $SBR3_2$ is similar to the subroutine SBR3 of FIG. 8 but further comprises, between the steps Sb14 and Sb15, steps Sb17 and Sb18. At the step Sb17, the quit vibrato parameter QVP is read from the area 13*f* and stored into the area 13*c* as the player vibrato parameter PVP(TC). The quit vibrato parameter QVP contained in the area 13*f* is that player vibrato parameter PVP(TC) which was transferred from the area 13*c* at the step Sa7 (FIG. 16) of the subroutine $SBR1_2$, so that the player vibrato parameter PVP(TC) resumes its previous value, that is, the value taken before the tone-color selection switch 27 is turned on. At the next step Sb18, the player vibrato parameter PVP(TC) is outputted to the vibrato control circuit 29*a* of the musical tone generating section 29.

Thus, by selecting "Copy Yes" or "Copy No" by properly operating the menu selection switches 20L and 20R in the copy menu mode after the turning-on operation of the tone-color selection switch 27, the player can cause the musical tone to be generated with any of the vibrato effects based on the factory vibrato parameter FVP(TC) and the player vibrato parameter PVP(TC). Therefore, the player can determine by his ear which of the parameters FVP(TC) and PVP(TC) is better.

(II-iii-3) Enter Switch 22

After selecting the cursor position in the copy menu by operating the switches 20L and 20R, the player turns on this enter switch 22 to determine which of the vibrato parameters FVP(TC) and PVP(TC) should be used. When an ON event of the enter switch 22 is detected, the CPU 11 executes a subroutine SBR42 shown in FIG. 19. This subroutine SBR42 is similar to the subroutine SBR4 of FIG. 9 but is different therefrom in that a new step Sc9 is provided in place of the steps Sc4 and Sc5. More specifically, if the result of the determination at the step Sc3 is "Yes", that is to say, if the player has selected the factory-preset vibrato parameter, the processing proceeds to the step Sc9. At the step Sc9, the factory-preset vibrato parameter corresponding to the tone-color code TC, that is, the parameter FVP(TC), is read from the area 12*c* of the ROM 12 and stored into the area 13*f* as the quit vibrato parameter QVP.

Thus, when the player turns on the tone-color selection switch 27, subsequently selects the cursor position of the copy menu and then turns on the enter switch 22, the results of determination at the steps Sc1 and Sc2 both become "Yes", so that the processing proceeds to the step Sc3. If the player has selected "Y" by the cursor, the processing of the step Sc9 is carried out. As a result, the vibrato parameter selected by the player (the parameter FVP(TC) or the parameter PVP(TC)) is stored into the area 13*f* as the quit vibrato parameter QVP. If the player has selected "N", that is, if the result of the determination at the step Sc3 is "No", the step Sc9 is skipped, so that the player vibrato parameter PVP(TC) is not stored into the area 13*f*. The reason for this is that the player vibrato parameter PVP(TC) has already been stored in the area 13*f* by the processing of the aforesaid step Sa7 of FIG. 16.

(II-iii-4) Data Switch 21U

When an ON event of the data switch 21U is detected, the CPU 11 executes the subroutine SBR5 mentioned in the first embodiment.

(II-iii-5) Data Switch 21D

When an ON event of the data switch 21*d* is detected, the CPU 11 executes the subroutine SBR6 (not shown) mentioned in the first embodiment. This subroutine SBR6 differs from the above-described subroutine SBR5 only in that in each of the steps Sd5, Sd9 and Sd10 the corresponding data to be processed is not incremented but decremented by one.

(II-iii-6) Menu Selection Switch 20U

When an ON event of the menu selection switch 20U is detected, the CPU 11 executes the subroutine SBR7 described above for the first embodiment.

(II-iii-7) Menu Selection Switch 20D

Each time the switch 20D is turned on, the menu displayed on the LC display unit 19 is changed in the reversed order, that is to say, from the delay menu to the depth menu, from the depth menu to the speed menu, from the speed menu to the delay menu, an so on.

Thus, the player sequentially sets the parameters PVDL, PVSP and PVDP to desired values by operating the data switches 21U and 21D while performing the menu selection by operating the menu selection switches 20U and 20D. Then, the player performs a music on the keyboard 15. If the player finds through the performed music that the precedingly selected parameters were preferable to the newly selected parameters, then the player turns on the quit switch 23.

(II-iii-8) Quit Switch ON Event

Figure 19:
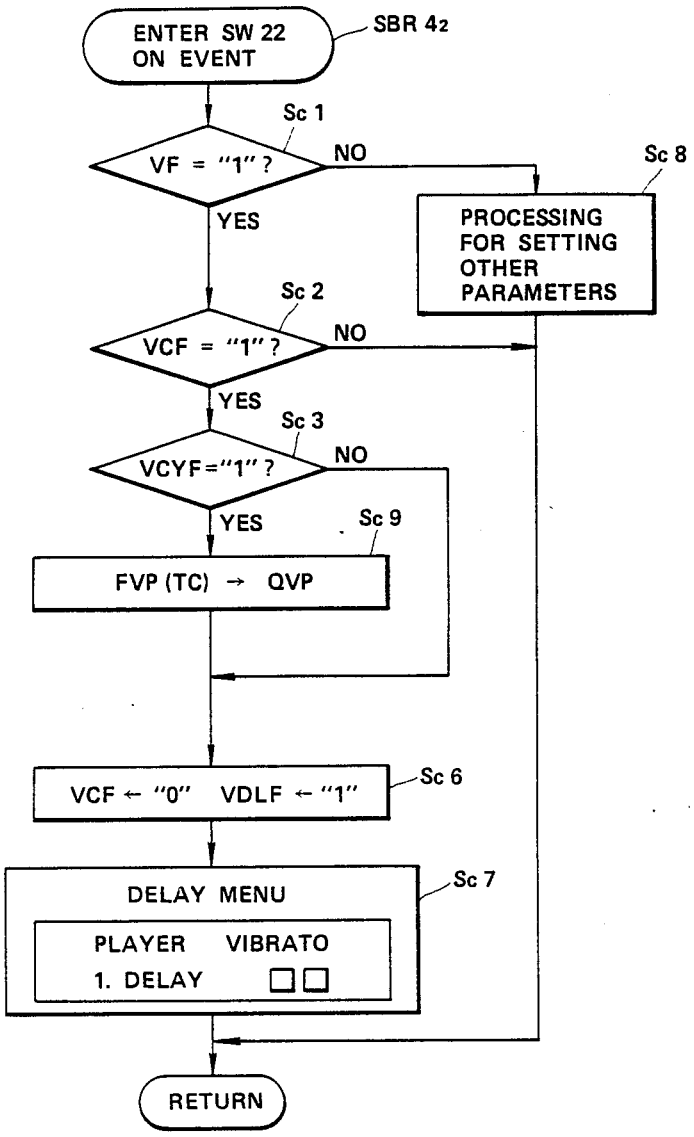
FIG. 19 is a flow chart of a subroutine SBR$\mathbf{4}_2$ which is executed in response to an ON event of the switch 22 of FIG. 14.
Figure 20:
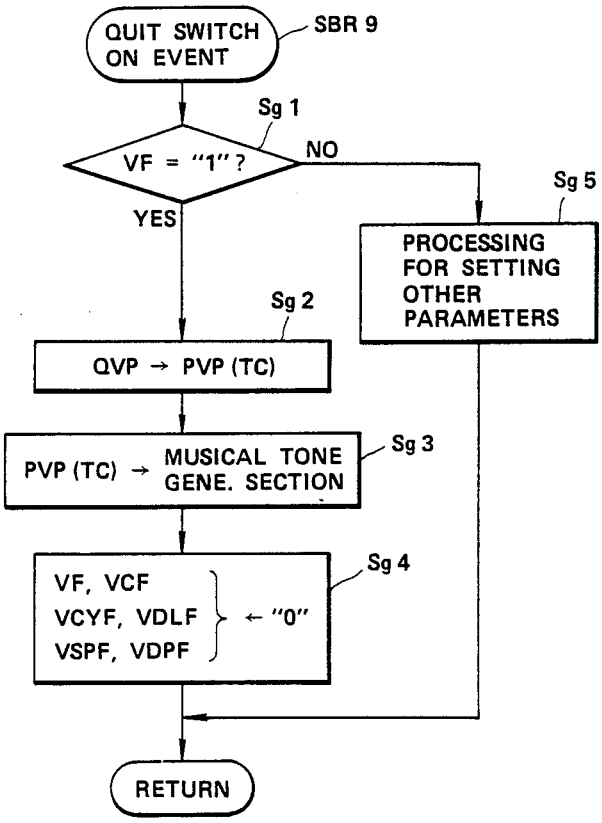
FIG. 20 is a flow chart of a subroutine SBR9 which is executed in response to an ON event of the quit switch 23 of FIG. 14.

When an ON event of this quit switch 23 is detected, the CPU 11 executes a subroutine SBR9 shown in FIG. 20. At the first step Sg1 of this subroutine SBR9, it is determined whether the vibrato flag VF is "1". If the result of this determination is "Yes", the processing proceeds to step Sg2, at which the quit vibrato parameter QVP is read from the area 13*f* and stored into the area 13*c* as the player vibrato parameter PVP(TC). At the next step Sg3, the above player vibrato parameter PVP(TC) is outputted to the vibrato control circuit 29*a* of the musical tone generating section 29. In this case, the area 13*f* for the parameter QVP is loaded at the step Sc9 (FIG. 19) or the step Sa7 (FIG. 16) with the previous factory-preset vibrato parameter FVP(TC) or the previous player vibrato parameter PVP(TC) (i.e., the vibrato parameter before changing by the operation of the data switches 21U and 21D), so that the previous vibrato parameter or the quit vibrato parameter QVP is set in the musical tone generating section 29 by the above-described steps Sg2 and Sg3. At the next step Sg4, the CPU 11 clears all the flags relating to the vibrato, namely, the vibrato flag VF, the vibrato copy menu flag VCF, the vibrato copy yes flag VCYF, the vibrato delay menu flag VDLF, the vibrato speed menu flag VSPF and the vibrato depth menu flag VDPF. This processing prevents the vibrato parameter from being changed thereafter. Then, the processing returns to the main routine. If the result of the determination at the step Sg1 is "No", the processing proceeds to step Sg5. At this step Sg5, a processing for the ON event of the quit switch 23 is performed with respect to other parameters, and the processing then returns to the main routine.

(II-iv) Multi-Menu Switch Unit Scanning Processing S3

This processing S3 is identical to that in the first embodiment.

(II-v) Control Unit Scanning Processing S4

This processing S4 is identical to that in the first embodiment.

(II-vi) Key Scanning Processing S5

This processing S5 is also identical to that in the first embodiment.

The foregoing is the operation of the instrument $10_2$ according to the second embodiment of the invention.

With the arrangement of this second embodiment, when the enter switch 22 is turned on after "Copy Yes" has been selected, the factory-preset vibrato parameter FVP(TC) is stored into the area 13*f* as the quit vibrato parameter QVP at the step Sc9 of FIG. 19. Therefore, if the quit switch 23 is then turned on after the speed parameter or the like has been changed, the vibrato parameter is restored to the factory-preset vibrato parameter FVP(TC). The second embodiment may be modified so that the vibrato parameter is restored to the vibrato parameter selected at the time when the tone-color selection switch 27 was turned on. This modification can be done by changing the processing of the step Sc9 to "No Operation".

The second embodiment is so designed that each of the parameters is set to a desired value through the multi-menu unit 18. Alternatively, each parameter may be set to a desired value through an individual parameter setting switch.

It should also be noted that the electronic musical instruments to which this invention can be applied include not only a keyboard electronic musical instrument but also a tone source module, a rhythm machine, a musical effect apparatus, and an automatic musical playing apparatus.

A third embodiment of the invention will now be described.

An electronic musical instrument $10_3$ incorporating a parameter setting system according to the third embodiment of the invention is so designed that any of two musical effects (a vibrato and a tremolo, in this case) can be selected by a simple operation. The instrument $10_3$ is generally similar to the above-described electronic musical instrument 10 shown in FIG. 1, but differs therefrom in the following respects.

Figure 21:
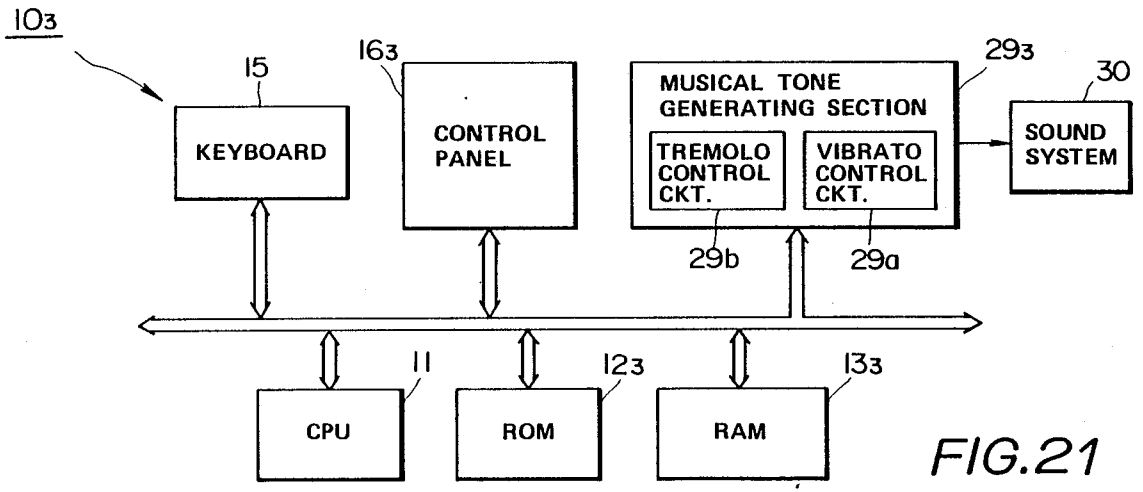
FIG. 21 is a block diagram of an electronic musical instrument $\mathbf{10}_3$ provided in accordance with a third embodiment of the invention.

As shown in FIG. 21, the electronic musical instrument $10_3$ comprises a musical tone generating section $29_3$ which is similar to the musical tone generating section 29 of FIG. 1 but further comprises a tremolo control circuit **29*b*. This tremolo control circuit 29*b* is responsive to a tremolo activation flag TR in the "1" state to give the generating musical tone signal a tremolo effect determined by a tremolo parameter supplied thereto. Similarly, the vibrato control circuit 29*a*** is responsive to a vibrato activation flag VI in the "1" state to give the generating musical tone signal a vibrato effect determined by a vibrato parameter supplied thereto.

Figure 22:
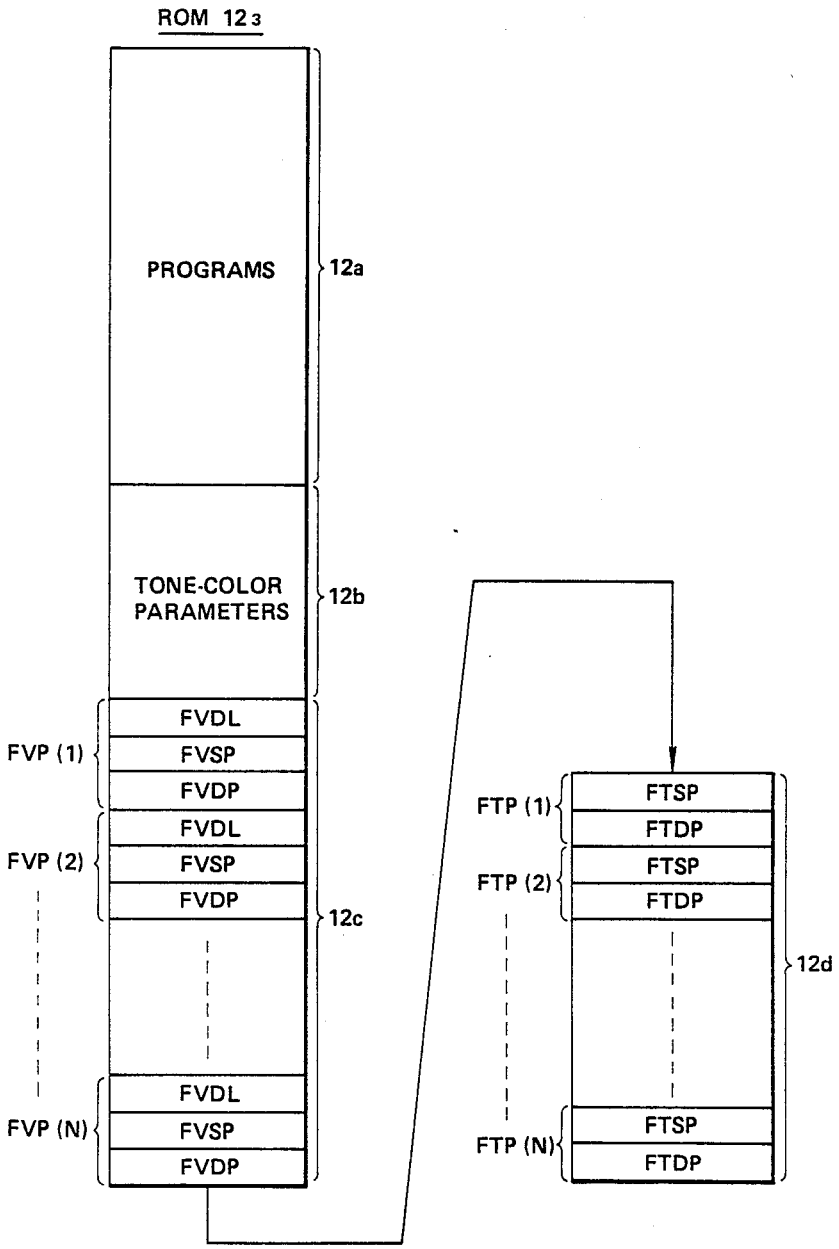
FIG. 22 is a memory map of the ROM $\mathbf{12}_3$ of the instrument $\mathbf{10}_3$ of FIG. 21.

As shown in FIG. 22, a ROM 123 of this instrument $10_3$ is similar to the ROM 12 of the first embodiment, but further comprises a storage area **12*d* in which N sets of factory-preset tremolo parameters FTP(1**) to FTP(N) are stored.

The factory-preset tremolo parameters FTP(1) to FTP(N) are those tremolo parameters which were stored in the ROM $12_3$ at the factory during the manufacturing process. In this case, the parameter FTP(1) corresponds to the tone-color code TC of "1", and the parameter FTP(N) corresponds to the tone-color code TC of "N". This is true of the other tremolo parameters FTP(2) to FTP(N-1). Each of the parameters FTP(1) to FTP(N) is composed of a tremolo speed parameter FTSP and a tremolo depth parameter FTDP.

Figure 23:
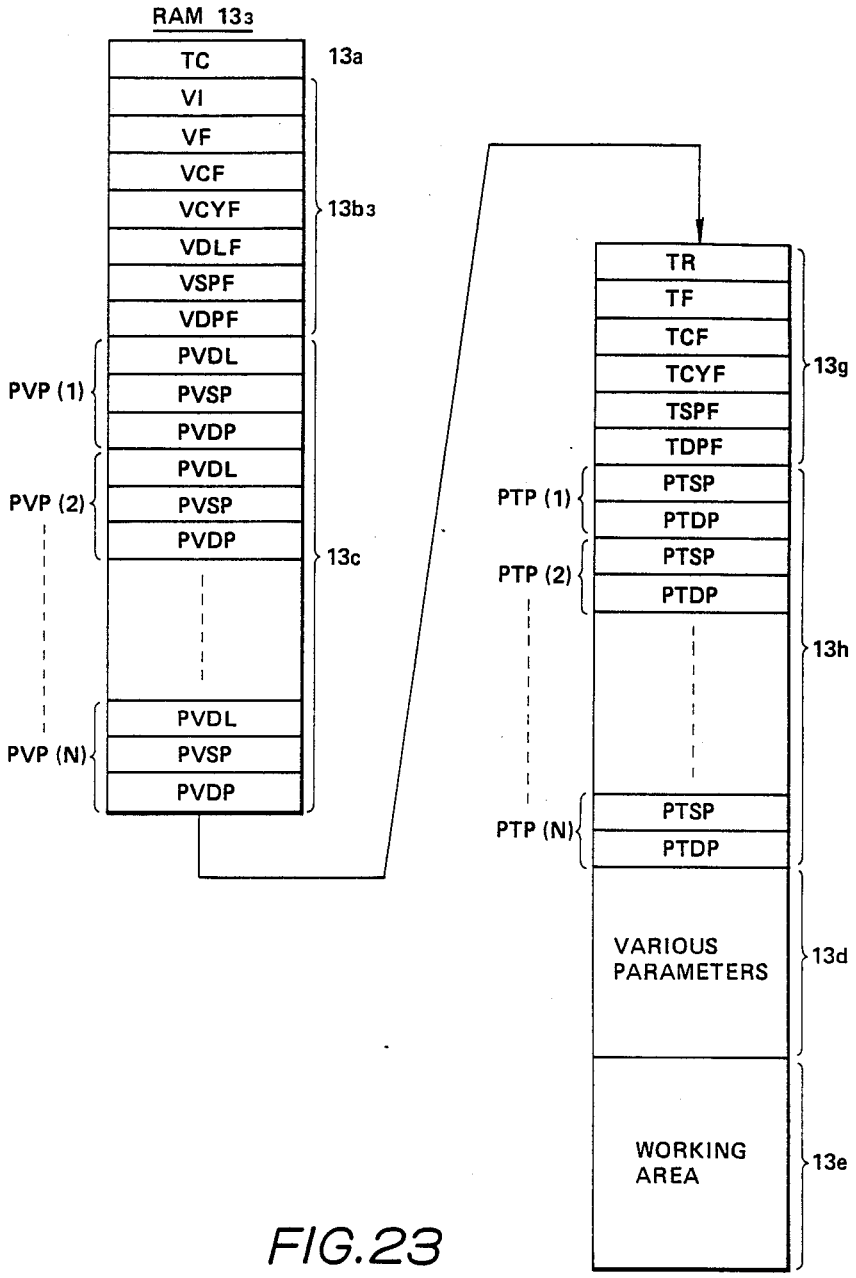
FIG. 23 is a memory map of the RAM $\mathbf{13}_3$ of the instrument $\mathbf{10}_3$ of FIG. 21.

FIG. 23 shows a RAM 133 of this instrument $10_3$ which is similar to the RAM 13 of the first embodiment, but further comprises a tremolo flag area **13*g* for storing various flags for the tremolo effect and a tremolo parameter area 13*h* for storing N sets of player tremolo parameters PTP(1**) to PTP(N). Also, a vibrato flag area $13b_3$ further stores a vibrato activation flag VI which is "1" when the vibrato effect is activated and is "0" when disabled.

The tremolo flag area **13*g*** stores the following flags:

(a) Tremolo Activation Flag TR

A flag which is rendered "1" when the tremolo effect is to be applied to the generating musical tone, and is rendered "0" otherwise;

(b) Tremolo Flag TF

A flag which is rendered "1" in a mode for setting the tremolo parameter, and is rendered "0" in a mode for setting parameters other than the tremolo parameter;

(c) Tremolo Copy Menu Flag TCF

A flag which is rendered "1" when a tremolo copy menu (later described) is displayed on the LC display unit 19 and is rendered "0" when such display is not effected;

(d) Tremolo Copy Yes Flag TCYF

A flag which is "1" in the case of "Copy Yes" as later described, and is "0" in the case of "Copy No";

(e) Tremolo Speed Menu Flag TSPF

A flag which is "1" when a speed parameter PTSP of the tremolo parameter is set and is otherwise "0"; and (f) Tremolo Depth Menu Flag TDPF A flag which is "1" when a tremolo depth parameter PTDP of the tremolo parameter is set and is otherwise "0".

The player tremolo parameters PTP(1) to PTP(N) are those tremolo parameters which are set by the player. The parameters PTP(1) to PTP(N) correspond respectively to the tone-color codes TC(1) to TC(N), and each of the parameters PTP(1) to PTP(N) is composed of the tremolo speed parameter PTSP and the tremolo depth parameter PTDP.

Figure 24:
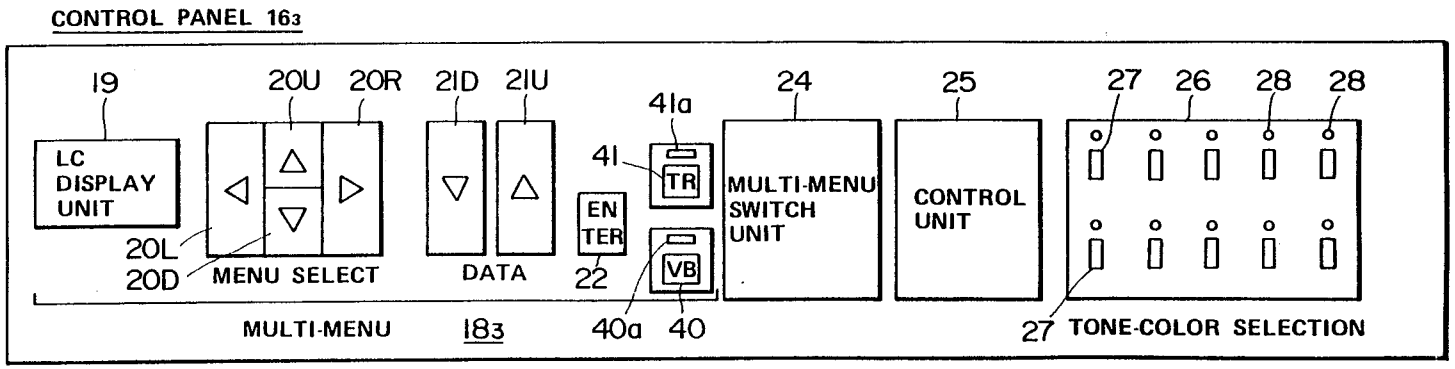
FIG. 24 is a diagrammatic illustration showing the control panel $\mathbf{16}_3$ of the instrument $\mathbf{10}_3$ of FIG. 21.

A control panel $16_3$ of the instrument $10_3$ according to this third embodiment is similar to the control panel 16 of FIG. 2, but further comprises, at a multi-menu unit $18_3$, a vibrato switch 40, a tremolo switch 41, and LED indicators **40*a* and 41*a* disposed adjacent respectively to the switches 40 and 41, as shown in FIG. 24**.

The vibrato switch 40 and the tremolo switch 41 are provided for controlling the ON and OFF of the vibrato effect and the tremolo effect, respectively. Each of the switches 40 and 41 is composed of an unlock-type switch. The LED indicator **40*a* is lit only when a processing for the vibrato effect is performed, and the LED indicator 41*a*** is lit only when a processing for the tremolo effect is performed.

The operation of this third embodiment will now be described with reference to flow charts.

Figure 25:
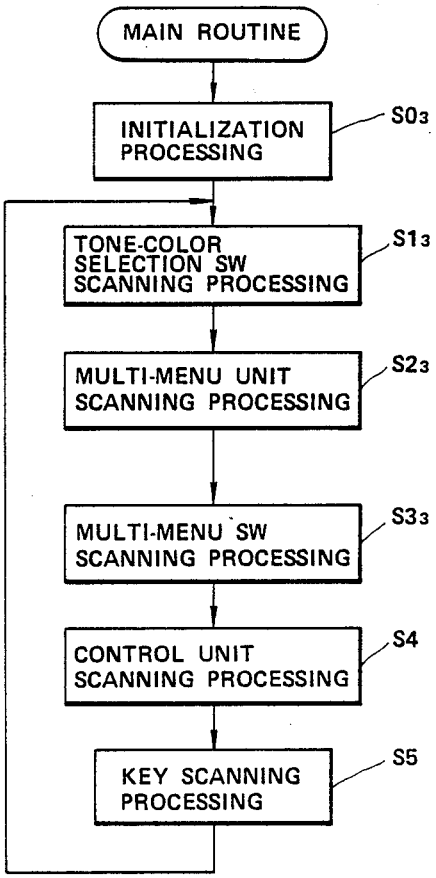
FIG. 25 is a flow chart of a main routine executed by the CPU 11 of FIG. 21.

FIG. 25 shows a main routine of this third embodiment which is similar to that shown in FIG. 5, but differs therefrom in the following respects.

(III-i) Initialization Processing $S0_3$

This initialization processing $S0_3$ is similar to that of the first embodiment, but further initializes the flags in the areas $13b_3$ and **13*g*. Furthermore, the factory-preset vibrato parameters VP(1) to FVP(N) are transferred from the area 12*d* to the player vibrato parameter area 13*c*, and, at the same time, the factory-preset tremolo parameters FTP(1) to FTP(N) are transferred from the area 12*d* to the player tremolo parameter area 13*h***.

(III-ii) Tone-Color Selection Switch Scanning Processing $S1_3$

The CPU 11 carries out this processing $S1_3$ by first sequentially scanning the tone-color selection switches 27 (FIG. 24). The CPU 11 then determines in accordance with the result of the scanning whether there have been changes of operation-state (or events) of the switches 27.

When an ON-event of any one of the switches 27 is detected, the CPU 11 reads the tone-color parameters, corresponding to the tone color of that tone-color selection switch 27 of which ON-event has just been detected, from the area **12*b* of the ROM $12_3$ and outputs the tone-color parameters to the musical tone generating section 29. Then, the LED indicator 28 corresponding to the above tone-color selection switch 27 is turned on and the other LED indicators 28** are turned off.

(II-iii) Multi-Menu Unit Scanning Processing $S2_3$

The CPU 11 begins to carry out this processing $S2_3$ by first scanning the tremolo switch 41 and the vibrato switch 40 and then scanning the switches 20L, 20U, 20D, 20R, 21U, 21D and 22 to detect ON events of these switches. The CPU 11 then performs a processing in accordance with the kinds of the switches of which ON events have been detected, as follows.

(II-iii-1) Tremolo Switch 41

Figure 26:
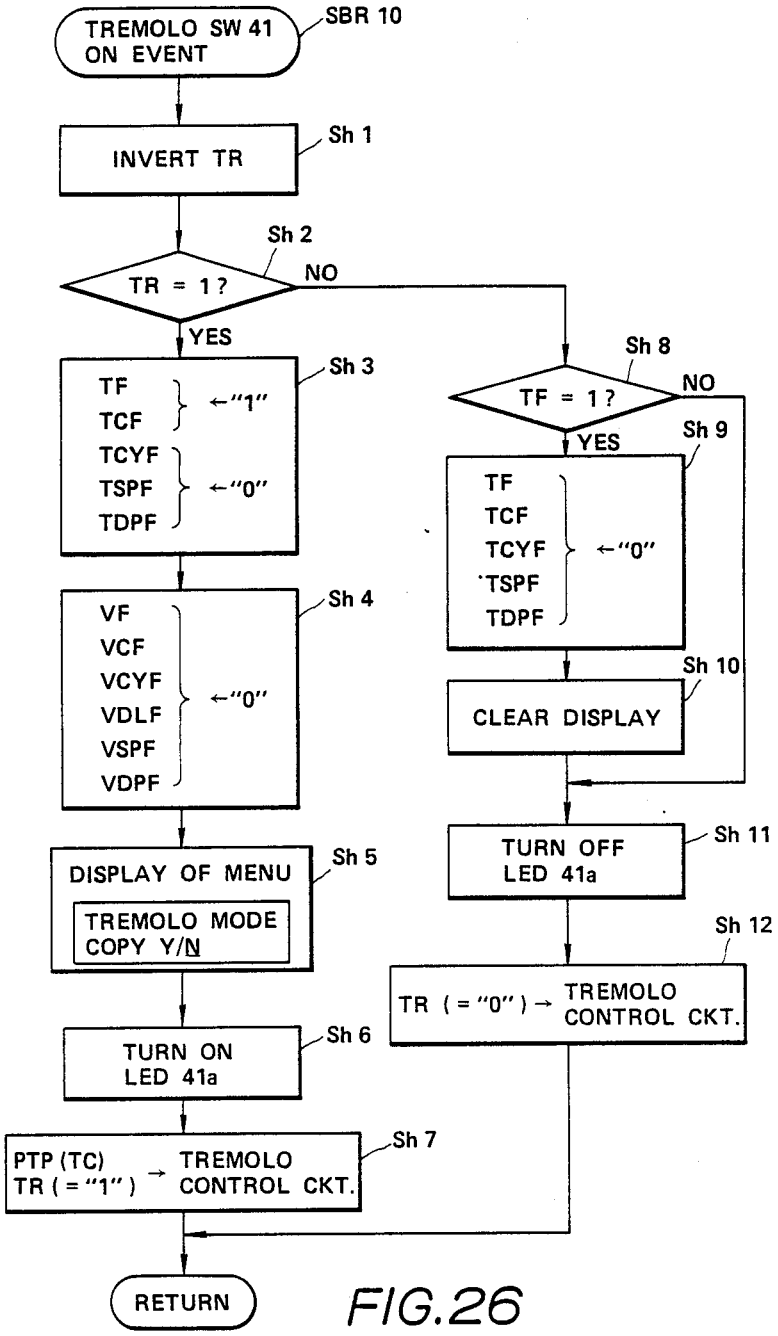
FIG. 26 is a flow chart of a subroutine SBR10 which is executed in response to an ON event of the tremolo switch 41 of the control panel $\mathbf{16}_3$ of 24.

When an ON event of this tremolo switch 41 is detected, the CPU 11 executes a subroutine SBR10 shown in FIG. 26. At the first step Sh1, the tremolo activation flag TR is inverted. When the processing of this step Sh1 is performed immediately after the initialization processing $S0_3$, the flag TR is changed from "0" to "1". At the next step Sh2, it is determined whether the tremolo activation flag TR is "1". If the result of the determination is "Yes", a processing for the tremolo is performed at steps Sh3 to Sh7.

The processings of the steps Sh3 to Sh7 are as follows:

At the step Sh3, the flags TF and TCF are both rendered "1", while the flags TCYF, TSPF and TDPF are all rendered "0". The flags TF and TCF are thus rendered "1" at this step Sh3 so that the system is brought into a tremolo parameter setting mode and as well as into a tremolo copy menu mode. At the next step Sh4, all the flags relating to the vibrato, namely, the flags VF, VCF, VCYF, VDLF, VSPF and VDPF, are cleared so that the setting/display of the tremolo parameter and the setting/display of the vibrato parameter do not contend with each other. At the next step Sh5, the following menu is displayed on the LC display unit 19:

TREMOLO MODE

L. COPY Y/N

This menu will be hereinafter referred to as a "tremolo copy menu". The meaning of this tremolo copy menu is:

"The system is now in the mode for setting parameters for the tremolo effect. Do you use the factory-preset tremolo parameter or do you wish to change the parameter?"

At the next step Sh6, the LED indicator 41*a* is lit to indicate the player that the application of the tremolo effect has begun. At the next step Sh7, the player tremolo parameter corresponding to the tone-color code TC in the register 13*a*, i.e., the player tremolo parameter PTP(TC), is read from the area 13*h*, and this player tremolo parameter PTP(TC) is outputted to the tremolo control circuit 29*b* together with the tremolo activation flag TR of "1". In the first execution of the processing of the step Sh7 after the initialization processing $S0_3$, the tremolo parameter set in the tremolo control circuit 29*b* is the factory-preset tremolo parameter FTP(TC). Then, the processing returns to the main routine. If the player performs a music on the keyboard 15 in this condition, the musical tone generated is given a tremolo effect determined by the factory-preset tremolo parameter FTP(TC), so that the player can ascertain the tremolo effect by his ear. If a processing for changing the parameter as later described has already been performed, the parameter outputted at this step Sh7 is the newly selected parameter.

On the other hand, if the result of the determination at the step Sh2 is "No", the processing proceeds to step Sh8, at which it is determined whether the tremolo flag TF is "1". If the result of this determination is "Yes", the processing proceeds to step Sh9 at which all the flags relating to the tremolo, that is, the flags TF, TCF, TCYF, TSPF and TDPF, are cleared. At the next step Sh10, the menu displayed on the LC display unit 19 is cleared. Then, the LED indicator 41*a* is turned off at next the step Sh11. On the other hand, if the result of the determination at the step Sh8 is "No", the processing proceeds directly to the step Sh11 to turn off the LED indicator 41*a*. When the processing of this step Sh11 is completed, the processing proceeds to step Sh12, at which the tremolo activation flag TR in the state of "0" is outputted to the tremolo control circuit 29*b* to prevent the tremolo effect from being applied to the musical tone. Then, the processing returns to the main routine.

(III-iii-2) Vibrato Switch 40

Figure 27:
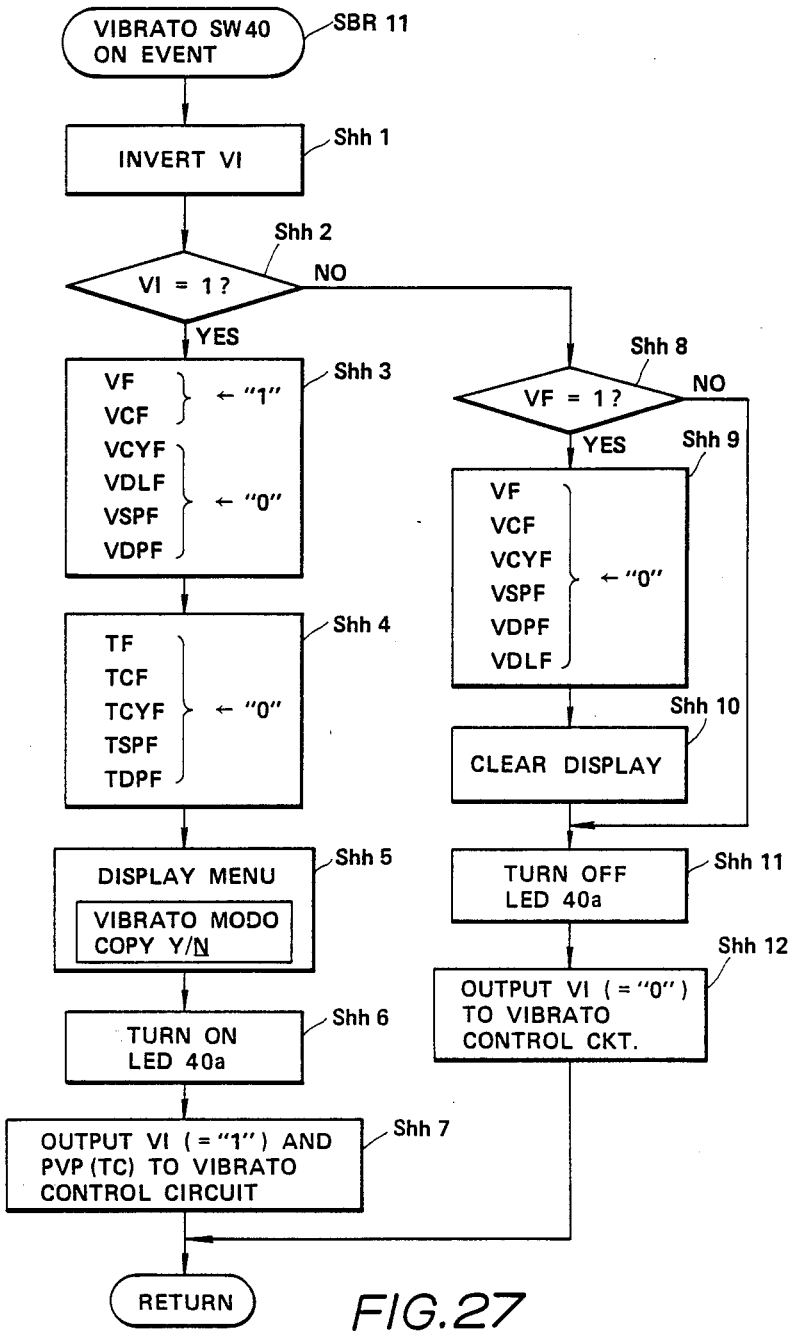
FIG. 27 is a flow chart of a subroutine SBR11 which is executed in response to an ON event of the vibrato switch 40 of FIG. 24.

When an ON event of this vibrato switch 40 is detected, the CPU 11 executes a subroutine SBR11 shown in FIG. 27 which is similar to the above-described subroutine SBR10 of FIG. 26. At the first step Shh1, the vibrato activation flag VI is inverted. At the next step Shh2, it is determined whether the vibrato activation flag VI is "1". If the result of the determination is "Yes", the processing proceeds to step Shh3, at which the flags VF and VCF are both rendered "1", while the flags VCYF, VDLF, VSPF and VDPF are all rendered "0". At the next step Shh4, all the flags relating to the tremolo, namely, the flags TF, TCF, TCYF, TSPF and TDPF, are cleared. At the next step Shh5, the vibrato menu is displayed on the LC display unit 19 as:

VIBRATO MODE

COPY Y/N

At the next step Shh6, the LED indicator 40*a* is lit to indicate the player that the application of the vibrato effect has begun. At the next step Shh7, the player vibrato parameter PVP(TC) is outputted to the vibrato control circuit 29*a* together with the vibrato activation flag VI of "1". Then, the processing returns to the main routine. On the other hand, if the result of the determination at the step Shh2 is "No", the processing proceeds to step Shh8, at which it is determined whether the vibrato flag VF is "1". If the result of this determination is "Yes", the processing proceeds to step Shh9 at which all the flags VF, VCF, VDLF, VCYF, VSPF and VDPF are cleared. At the next step Shh10, the menu displayed on the LC display unit 19 is cleared. Then, the LED indicator 40*a* is turned off at next the step Shh11. On the other hand, if the result of the determination at the step Shh8 is "No", the processing proceeds directly to the step Shh11 to turn off the LED indicator 40*a*. When the processing of this step Shh11 is completed, the processing proceeds to step Shh12, at which the vibrato activation flag VI in the state of "0" is outputted to the vibrato control circuit 29*a* to prevent the vibrato effect from being applied to the musical tone. Then, the processing returns to the main routine.

(III-iii-3) Menu Selection Switch 20L

Figure 28:
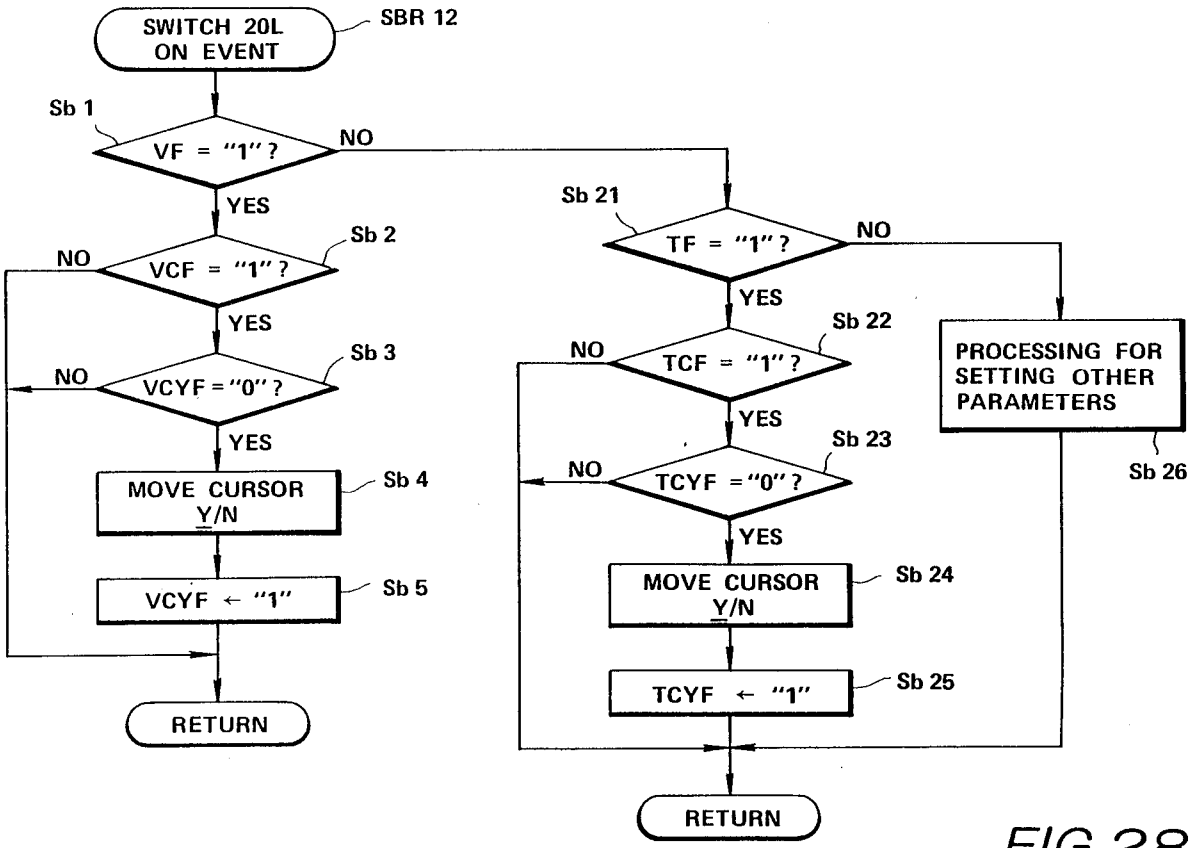
FIG. 28 is a flow chart of a subroutine SBR12 which is executed in response to an ON event of the switch 20L of FIG. 24.

When an ON event of the switch 20L is detected, the CPU 11 executes a subroutine SBR12 shown in FIG. 28. This subroutine SBR12 is identical to the subroutine SBR2 of FIG. 7 except for the following. Specifically, if the result of the determination at the step Sb1 is "No", the processing proceeds to step Sb21 at which it is determined whether the tremolo flag TF (FIG. 23) is "1". If the result of this determination is "Yes", that is, if the instrument $10_3$ is in the mode for setting the tremolo parameter, the processing proceeds to step Sb22. At this step Sb22, it is determined whether the tremolo copy menu flag TCF is "1". If the result of this determination is "Yes", that is, if the tremolo copy menu is displayed on the LC display unit 19, the processing proceeds to step Sb23 at which it is further determined whether the tremolo copy yes flag TCYF is "0". The tremolo copy yes flag TCYF is a flag which is rendered "1" when the cursor is displayed just under the character "Y" ("Copy Yes"), and is rendered "0" when the cursor is displayed just under the character "N" ("Copy No"). If the result of the determination at the step Sb23 is "Yes", that is to say, if the cursor is displayed just under the character "N", the processing proceeds to step Sb24 to move the cursor to just under the character "Y". At the next step Sb25, a "1" is written into the area 13*g* as the tremolo copy yes flag TCYF. The processing then returns to the main routine. On the other hand, if the result of the determination at the step Sb22 is "No", that is, if the tremolo copy menu is not displayed, or if the result of the determination at the step Sb23 is "No", that is, if the cursor is displayed just under the character "Y", the processing directly returns to the main routine.

If the result of the determination at the step Sb21 is "No", that is to say, if the mode is not the vibrato parameter setting mode nor the tremolo parameter setting mode, the processing proceeds to step Sb26. At this step Sb26, a processing for the ON event of the switch 20L is performed with respect to parameters other than the vibrato and tremolo parameters. Then, the processing returns to the main routine.

Thus, in the vibrato or tremolo parameter setting mode, the cursor is moved to just under the character "Y" of the copy menu when the switch 20L is turned on.

(III-iii-4) Menu Selection Switch 20R

Figure 29:
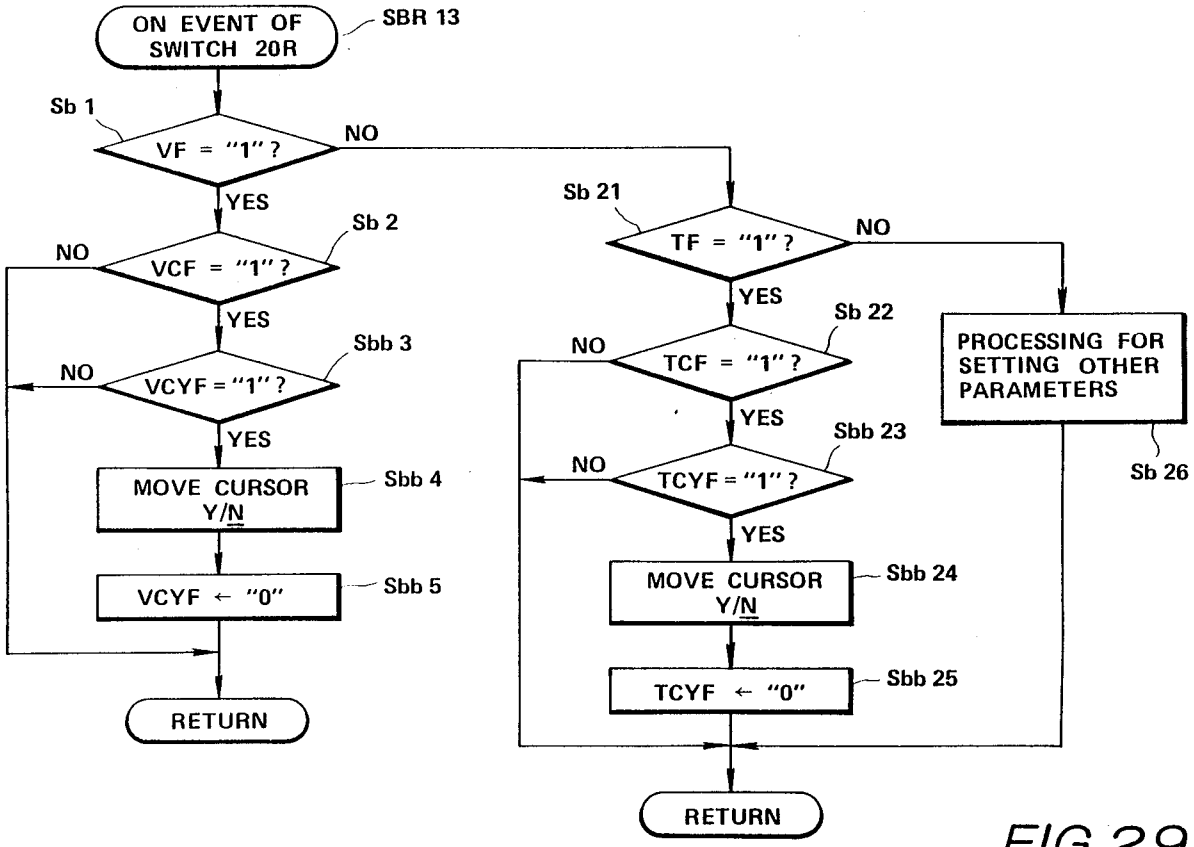
FIG. 29 is a flow chart of a subroutine SBR13 which is executed in response to an ON event of the switch 20R of FIG. 24.

When an ON event of the switch 20R is detected, the CPU 11 executes a subroutine SBR13 shown in FIG. 29. The processing performed in this subroutine SBR13 is substantially equal to that in the aforesaid subroutine $SBR1_2$, and is different therefrom only in the following respects. At step Sbb3, it is determined whether the vibrato copy yes flag VCYF is "1", and, at step Sbb4, the cursor is moved to just under the character "N". Furthermore, at step Sbb5, the vibrato copy yes flag VCYF is rendered "0". In addition, At step Sbb23, it is determined whether the tremolo copy yes flag TCYF is "1", and, at step Sbb24, the cursor is moved to just under the character "N". Furthermore, at step Sbb25, the tremolo copy yes flag TCYF is rendered "0". Thus, when the switch 20R is turned on in any of the vibrato parameter setting mode and the tremolo parameter setting mode, the cursor is moved to just under the character "N".

(III-iii-5) Enter Switch 22

Figure 30:
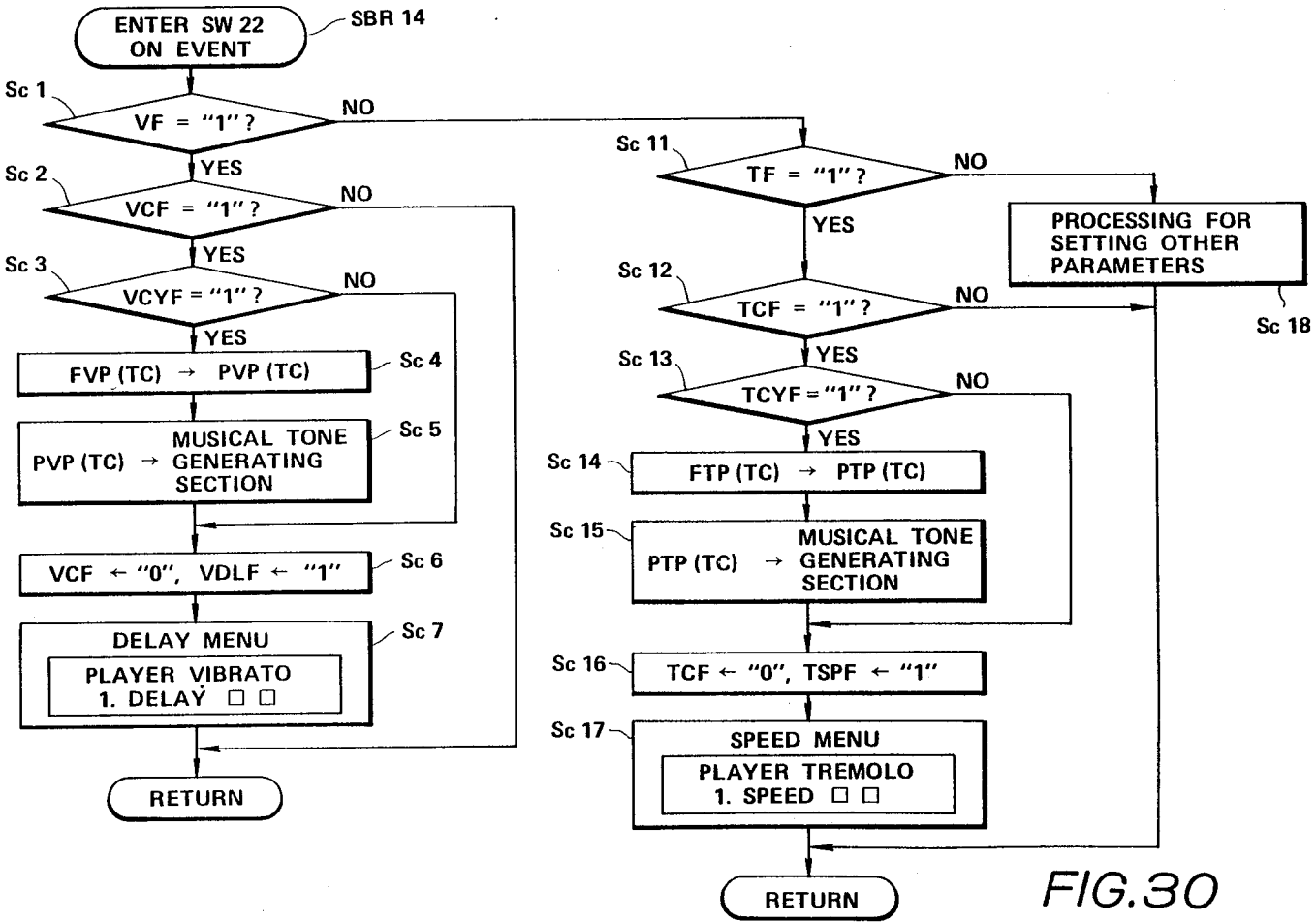
FIG. 30 is a flow chart of a subroutine SBR14 which is executed in response to an ON event of the enter switch 22 of FIG. 24.

After selecting the cursor position of the vibrato or tremolo copy menu by operating the switches 20L and 20R, the player turns on this enter switch 22 to determine which of the vibrato parameters FVP(TC) and PVP(TC) or which of the tremolo parameters FTP(TC) and PTP(TC) should be used. When an 0N event of the enter switch 22 is detected, the CPU 11 executes a subroutine SBR14 shown in FIG. 30. This subroutine SBR14 is identical to the subroutine SBR4 of FIG. 9 except for the following. Specifically, if the result of the determination at the step Sc1 is "No", the processing proceeds to step Sc11. At the step Sc11, it is determined whether the tremolo flag TF is "1". If the result of this determination is "Yes", the processing proceeds to step Sc12 at which it is determined whether the tremolo copy menu flag TCF is "1". If the result of this determination is "Yes", it is further determined whether the tremolo copy yes flag TCYF is "1". If the result of this determination is "Yes", that is to say, if the player has selected the factory-preset tremolo parameter, the processing proceeds to step Sc14. At this step Sc14, the factory-preset tremolo parameter corresponding to the tone-color code TC in the register 13*a* (FIG. 23), i.e., the parameter FTP(TC), is read from the area 12*d* of the ROM $12_3$, and stored into the area 13*h* of the RAM $13_3$ as the player tremolo parameter PTP(TC). At the next step Sc15, the above player tremolo parameter PTP(TC) is outputted to the tremolo control circuit 29*b* of the musical tone generating section $29_3$. As a result, the factory-preset tremolo parameter FTP(TC) is set in the tremolo control circuit 29*b*. At the next step Sc16, the tremolo copy menu flag TCF and the tremolo speed menu flag TSPF are rendered "0" and "1", respectively. The tremolo speed menu flag TSPF is thus rendered "1", so that the instrument $10_3$ is brought into a mode for setting the tremolo speed parameter. At the next step Sc7, the following menu is displayed on the LC display unit 19:

PLAYER TREMOLO

1. SPEED ▯▯

The above menu is hereinafter referred to as a "tremolo speed menu", wherein the tremolo speed parameter PTSP of the player tremolo parameter PTP(TC) is displayed at the ▯▯. Then, the processing returns to the main routine.

If the result of the determination at the step Sc12 is "No", the processing directly returns to the main routine. On the other hand, if the result of the determination at the step Sc13 is "No", the steps Sc14 and Sc15 are skipped and the processing proceeds to the step Sc16.

If the result of the step Sc11 is "No", the processing proceeds to step Sc18 at which a processing for the ON event of the enter switch 22 is performed with respect to the other parameters.

Thus, when the player turns on the tone-color selection switch 27, subsequently selects the cursor position of the copy menu, and then turns on the enter switch 22, the factory-preset vibrato parameter FVP(TC) or the factory-preset tremolo parameter FTP(TC) is transferred to the RAM $13_3$ in the case of the cursor position being at the character "Y", whereas, in the case of the cursor position being at the character "N", no parameter is transferred and the vibrato delay menu or the tremolo speed menu is displayed.

(III-iii-6) Data Switch 21U

Figure 31:
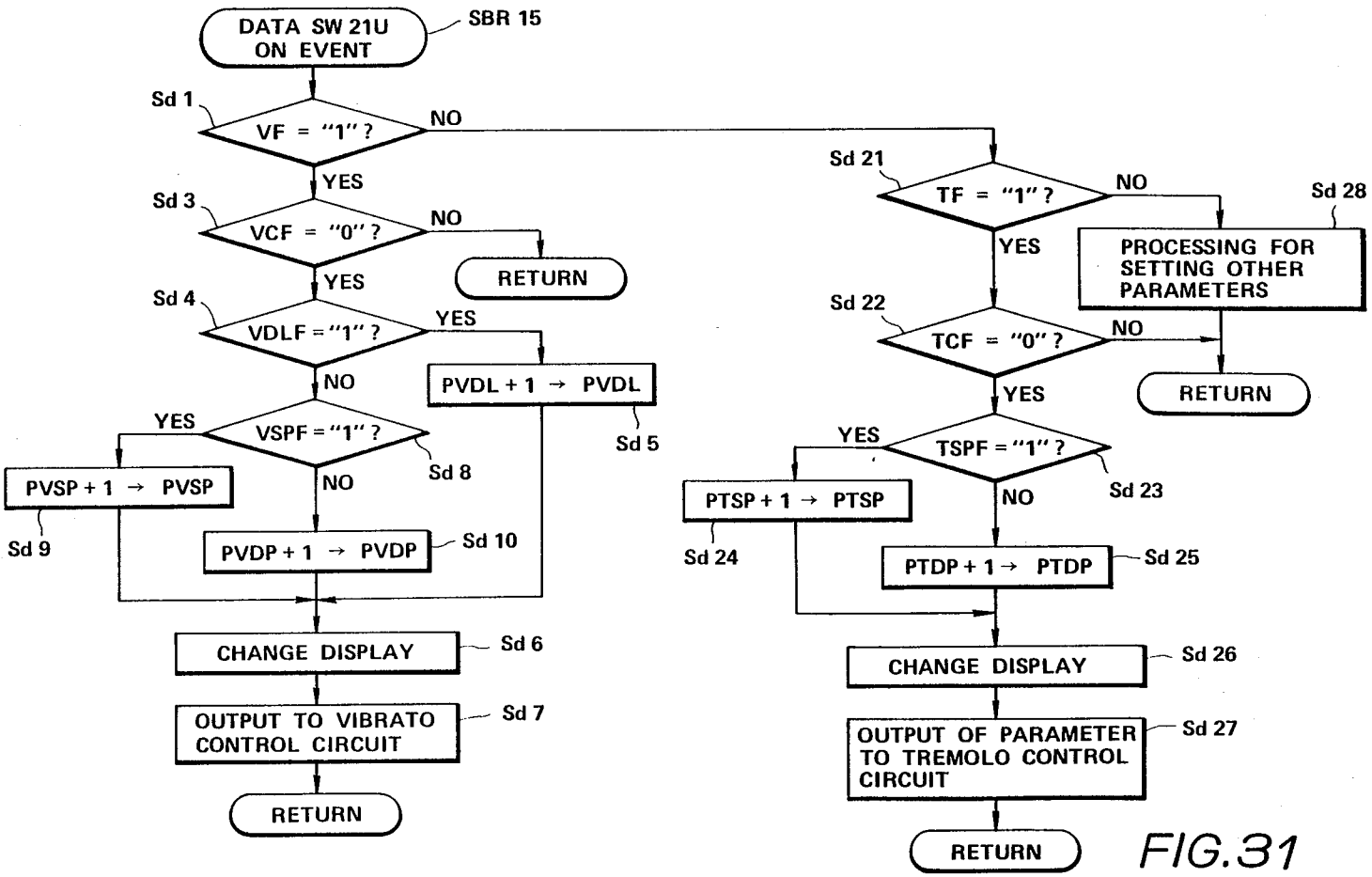
FIG. 31 is a flow chart of a subroutine SBR15 which is executed in response to an ON event of the data switch 21U of FIG. 24.

When an ON event of the data switch 21U is detected, the CPU 11 executes a subroutine SBR15 shown in FIG. 31. This subroutine SBR15 is identical to the subroutine SBR5 of FIG. 10 except for the following. Specifically, if the result of the determination at the step Sd1 is "No", the processing proceeds to step Sd21, at which it is determined whether the tremolo flag TF is "1". If the result of this determination is "Yes", the processing proceeds to step Sd22 at which it is determined whether the tremolo copy menu flag TCF is "0". If the result of this determination is "No", the processing returns to the main routine. On the other hand, if the result of the determination is "Yes", the processing proceeds to step Sd23 at which it is further determined whether the tremolo speed menu flag TSPF is "1". If the result of this determination is "Yes", the processing proceeds to step Sd24 at which the tremolo speed parameter PTSP of the player tremolo parameter PTP(TC) is incremented by one. On the other hand, if the result of the determination at the step Sd23 is "No", the processing proceeds to step Sd25 at which the tremolo depth parameter PTDP of the player tremolo parameter PTP(TC) is incremented by one. The processing then proceeds from the step Sd24 or the step Sd25 to step Sd26 at which the above-mentioned parameter PTDP or the parameter PTSP is outputted to the LC display unit 19. As a result, the value displayed at the ▯▯ of the tremolo speed menu or the tremolo depth menu is changed. Then, the processing proceeds to step Sd27 at which the above parameter is outputted to the tremolo control circuit 29*b*.

Thus, each time the data switch 21U is turned on during the time when the tremolo speed menu is displayed (TSPF="1"), the player tremolo speed parameter PTSP is incremented by one. On the other hand, each time the switch 21U is turned on during the time when the tremolo depth menu is displayed, the player tremolo depth parameter PTDP is incremented by one.

If the result of the determination at the step Sd21 is "No", the processing proceeds to step Sd28, at which a processing for the ON event of the switch 21U is performed with respect to the other parameters. Then, the processing returns to the main routine.

The maximum values of the parameters PTSP and PTDP are predetermined, so that when the parameters PTSP and PTDP reach their maximum values, these parameters will not be increased any more even if the switch 21U is further turned on.

(III-iii-7) Data Switch 21D

When an ON event of the data switch 21D is detected, the CPU 11 executes a subroutine SBR16 (not shown). This subroutine SBR16 is identical to the above-described subroutine SBR15 except that a decrement operation is performed at each of the steps Sd5, Sd9, Sd10, Sd24 and Sd25. More specifically, when the data switch 21D is turned on once during the time, for example, when the tremolo speed menu is displayed (TSPF="1"), the player tremolo speed parameter PTSP is decremented by one. When the switch 21D is turned on twice, three times and so on, the parameter PTSP is decreased by two, three and so on. This is true of the other parameters PVDL, PVSP, PVDP and PTDP.

The minimum value of each of the parameters PVDL, PVSP, PVDP, PTSP and PTDP is predetermined, so that when these parameters reach their respective minimum values, they will not be decreased any more even if the switch 21D is further turned on.

(III-iii-8) Menu Selection Switch 20U

Figure 32:
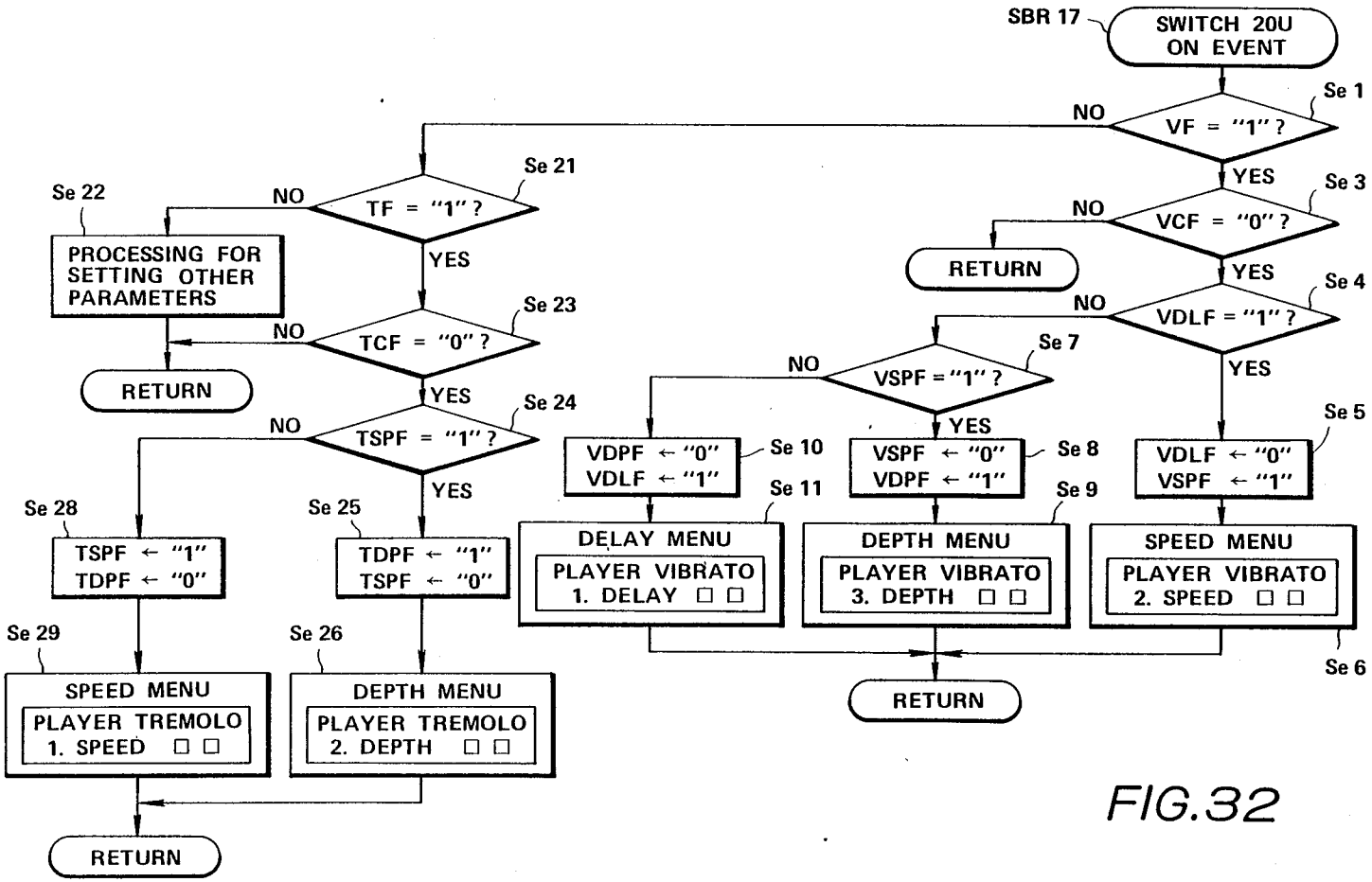
FIG. 32 is a flow chart of a subroutine SBR17 which is executed in response to an ON event of the switch 20U of FIG. 24.
Figure 33:
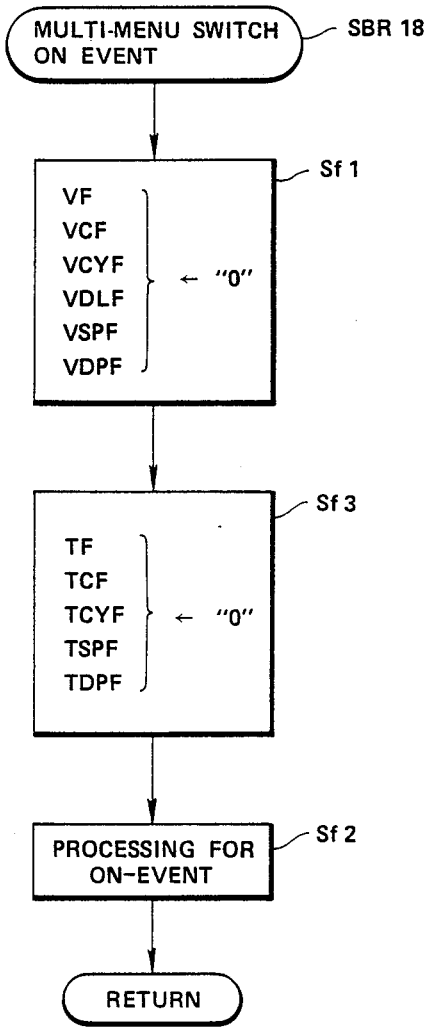
FIG. 33 is a flow chart of a subroutine SBR18 which is executed in response to an ON event of a switch of the multi-menu switch unit 24 of FIG. 24.

When an ON event of the menu selection switch 20U is detected, the CPU 11 executes a subroutine SBR17 shown in FIG. 32. This subroutine SBR17 is identical to the subroutine SBR7 of FIG. 11 except for the following.

If the result of the determination at the step Se1 is "No", the processing proceeds to step Se21, at which it is determined whether the tremolo flag TF is "1". If the result of this determination is "No", the processing proceeds to step Se22 at which a processing for the other parameters is performed, and the processing then returns to the main routine. On the other hand, if the result of the determination at the step Se21 is "Yes", the processing proceeds to step Se23 at which it is determined whether the tremolo copy menu flag TCF is "0". If the result of this determination is "No", the processing returns to the main routine. On the other hand, if the result of the determination at the step Se23 is "Yes", the processing proceeds to step Se24 at which it is further determined whether the tremolo speed flag TSPF is "1". If the result of this determination is "Yes", the processing proceeds to step Se25 at which the tremolo depth flag TDPF is rendered "1", while the tremolo speed flag TSPF is rendered "0". The tremolo depth flag TDPF is thus rendered "1", so that the instrument $10_3$ is brought into a mode for setting the tremolo depth parameter. Then, the processing proceeds to step Se26 at which the following menu is displayed on the LC display unit 19:

PLAYER TREMOLO

2. DEPTH ▯▯

This menu will be hereinafter referred to as a "tremolo depth menu". The processing then returns to the main routine.

Thus, when the player turns on the switch 20U once after the tremolo speed parameter PTSP has been set, the tremolo depth menu flag TDPF is rendered "1" with the tremolo depth menu being displayed if the vibrato menu flag VF is "0". I this condition, the player sets the tremolo depth parameter PTDP to a desired value by operating the data switches 21U and 21D in a manner described above for the tremolo speed parameter PTSP. In this case, the result of the determination at the step Sd23 of FIG. 31 becomes "No", so that the processing of the step Sd25 is performed.

When the player turns on the switch 20U after the depth parameter PTDP has been set, the CPU 11 again executes the subroutine SBR17. The processing proceeds, this time, through the steps Se1, Se21 and Se23 to the step Se24. Since the result of the determination at the step Se24 is "No" (see the step Se25), the processing proceeds to step Se28. At this step Se28, the tremolo speed menu flag TSPF is rendered "1", while the tremolo depth menu flag TDPF is rendered "0". At the next step Se29, the tremolo speed is displayed on the LC display unit 19. Then, the processing proceeds to the main routine.

Thus, when the switch 20U is turned on once after the tremolo depth parameter PTDP has been set, the tremolo speed menu flag TSPF is rendered "1" and at the same time the tremolo speed menu is displayed. In this condition, the player sets the tremolo speed parameter PTSP by operating the data switches 21U and 21D in a manner described above for the tremolo depth parameter PTDP. In this case, the result of the determination at the step Sd23 is "Yes", so that the processing of the step Sd24 is performed.

In this manner, the parameters PTSP and PTDP are set to respective desired values.

If the switch 20U is again turned on after the tremolo speed parameter PTSP has been set, the processing proceeds through the steps Se1, Se21, Se23, Se24 and Se25 to the step Se26, so that the tremolo depth menu is displayed and the instrument $10_3$ is brought into the tremolo depth parameter setting mode. Thus, the tremolo depth menu and the tremolo speed menu are alternately displayed each time the switch 20U is turned on.

(II-iii-9) Menu Selection Switch 20D

Each time the switch 20D is turned on, the menu displayed on the LC display unit 19 is changed in the reversed order, that is to say, from the delay menu to the depth menu, from the depth menu to the speed menu, from the speed menu to the delay menu, and so on in the case of the vibrato menu flag VF being "1". On the other hand, when the vibrato menu flag VF and the tremolo menu flag TF are "0" and "1", respectively, the speed menu and the depth menu are alternately displayed each time the switch 20D is turned on. The processing performed by the CPU 11 in response to each ON event of the switch 20D is substantially the same as that of the subroutine SBR17 of FIG. 32, and therefore the detailed description thereof is omitted.

(III-iv) Multi-Menu Switch Unit Scanning Processing $S3_3$

In this processing $S3_3$, ON events of the switches of the multi-menu switch unit 24 by scanning these switches. When an ON event of any of the switches is detected, the CPU 11 executes a subroutine SBR18 which is similar to the subroutine SBR8 of FIG. 12 but further comprises step Sf3 between the steps Sf1 and Sf2. At this step Sf3, all the flags relating to the tremolo, namely, the tremolo flag TF, the tremolo copy menu flag TCF, tremolo copy yes flag TCYF, tremolo speed menu flag TSPF and the tremolo depth menu flag TDPF, are rendered "0". This processing prevents the tremolo parameter from being further set.

(III-v) Control Unit Scanning Processing S4

This processing S4 is identical to that in the first embodiment.

(III-vi) Key Scanning Processing S5

This processing S5 is also identical to that in the first embodiment.

The foregoing is the operation of the instrument $10_3$ according to the third embodiment of the invention.

With the arrangement of this third embodiment, after the vibrato switch 40 is turned on, it is first determined by the player whether the factory-preset vibrato parameter is to be copied, and then the actual control parameters such as the delay time are changed. This system may be modifies so that immediately after the vibrato switch 40 is turned on, the parameters such as the delay time can be changed.

This embodiment may also be modified so that other musical effects such as a symphonic chorus, a chorus, a glide and a phaser are controlled in accordance with speed and depth data. A portamento can be controlled in accordance with speed data.

In this embodiment, two switches (the vibrato switch 40 and the tremolo switch 41) are provide on the control panel $16_3$ for selecting the kind of the musical effect to be controlled. Alternatively, a vibrato depth control switch and a tremolo depth control switch may be provided. In this case, when either of the two switches is turned on, the system is brought into a mode for changing the corresponding depth parameter. Alternatively, a vibrato ON/OFF switch and a depth control switch may be provided on the control panel. In this case, the other musical effects are controlled by a common switch.

In the third embodiment, the four parameters, namely, the ON/OFF state, the delay time, the speed and the depth are controlled with respect to the vibrato effect. The embodiment may be modified so that only two parameters are controlled with respect to each of the musical effects. In this case, ON/OFF control switches are provided respectively for the musical effects and a common switch is provided for controlling the speed of each of the musical effects.

With this third embodiment, when neither the vibrato effect nor the tremolo effect is selected, the system is not brought into the mode for changing the parameters. The embodiment may be modified so that the parameters can be changed even in such condition.

A fourth embodiment of the invention will now be described.

Figure 34:
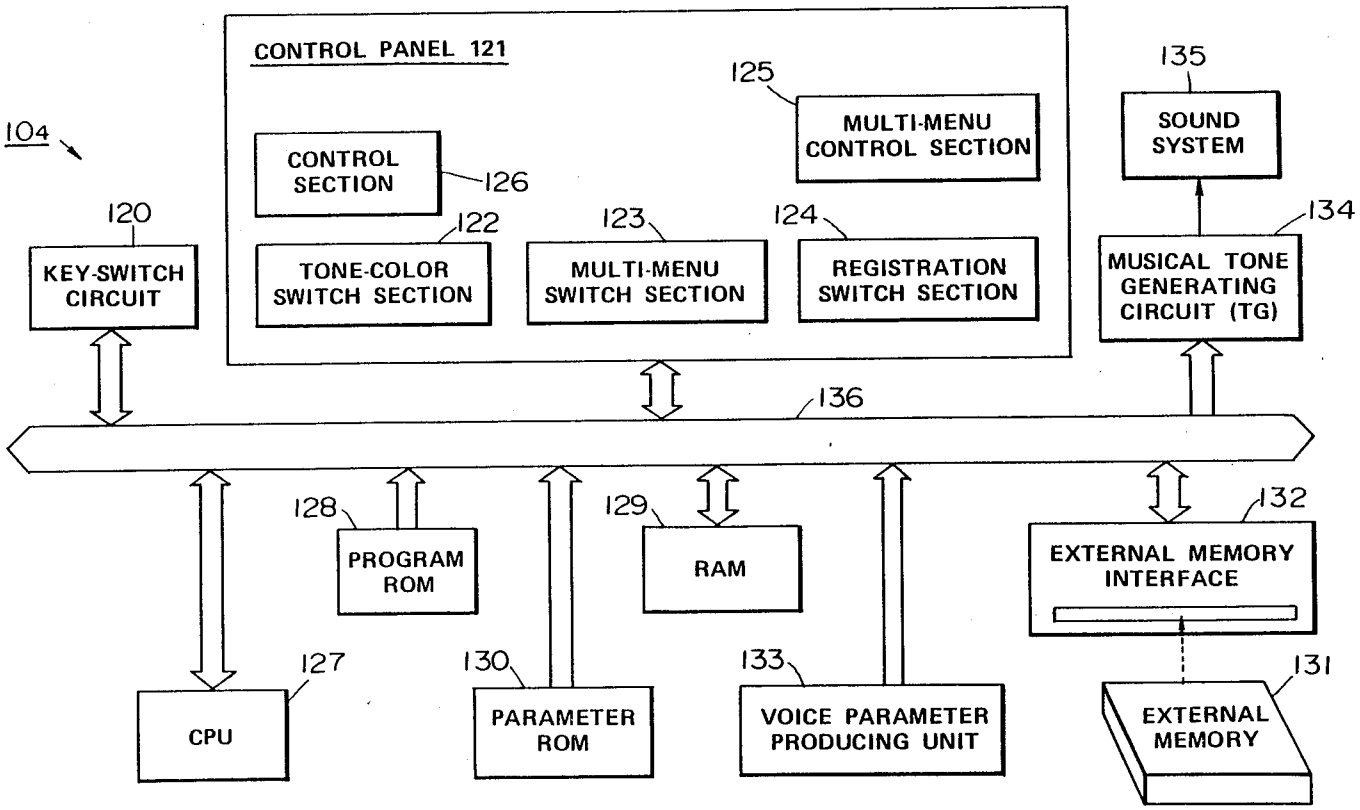
FIG. 34 is a block diagram of an electronic musical instrument $10_4$ incorporating a parameter setting system provided in accordance with a fourth embodiment of the invention.

FIG. 34 shows an electronic musical instrument $10_4$ incorporating a parameter setting system according to the fourth embodiment of the present invention. The electronic musical instrument $10_4$ comprises a key-switch circuit 120 having a plurality of key-switches provided correspondingly to keys of a keyboard (not shown). The instrument $10_4$ further comprises a control panel 121 which includes various kinds of switches, setting devices, knobs, display devices and the like for setting and controlling characteristics of a musical tone to be generated. More specifically, the control panel 121 comprises tone-color switch section 122, a multi-menu switch section 123, a registration switch section 124, a multi-menu control section 125 and a control section 126. The tone-color switch section 122 has a plurality of switches for selecting tone colors. The multi-menu switch section 123 includes a display unit and a multi-purpose switch means for setting characteristics of a musical tone, an automatic playing function and other functions. The registration switch section 124 includes switches for selecting and setting preset data and various switches for editing parameters. The multi-menu switch section 123 is used with the tone-color switch section 122 and the registration switch section 124. The multi-menu control section 125 includes other switches which are used with the multi-menu switch section 123, and is operated, for example, when the multi-menu switch section 123 is used to set vibrato data or envelope parameters.

In this embodiment, processings for detecting ON/-OFF operations of the switches and processings of data responsive to the detections are performed by a microcomputer which includes a CPU 127, a program ROM 128, and a RAM 129 for storing data and for providing a working area. The RAM 129 stores in a data storage area thereof various parameters for setting the characteristics of the musical tone. A parameter ROM 130 also stores therein various parameters for setting the characteristics of the musical tone.

An external memory 131 can be detachably connected through an external memory interface 132 to the electronic musical instrument $10_4$. The external memory 131 is provided for storing parameters for setting the characteristics of the musical tone, and is composed, for example, of a rewritable nonvolatile storage medium such as a battery-backed-up semiconductor memory, an EPROM, a bubble memory, a magnetic card, and a magnetic disc. The external memory 131 will be referred to as a "memory pack" or simply as a "pack".

A voice parameter producing unit 133 is a device with which the player can produce parameters corresponding to a desired tone color or voice, the parameters being hereinafter referred to as "voice parameters". Such a voice parameter producing unit is disclosed, for example, in Japanese Patent Application Laid-Open No. 56-52800.

A musical tone generating circuit 134 has a plurality of tone generating channels, each of which generates a musical tone signal in accordance with key-depression information assigned thereto. The characteristics of the musical tone signal generated by each tone generating channel is determined by various parameters supplied to the tone generating channel through a data bus 136. The musical tone signal thus produced by the musical tone generating circuit 134 is supplied to a sound system and is outputted from the sound system as a musical tone.

(IV-i) Switch Sections

Figure 35:
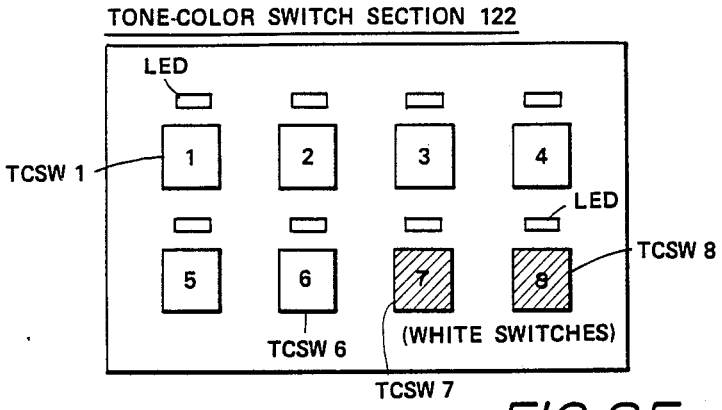
FIG. 35 is an illustration showing the tone color switch section 122 of the electronic musical instrument $10_4$ of FIG. 34.
Figure 36:
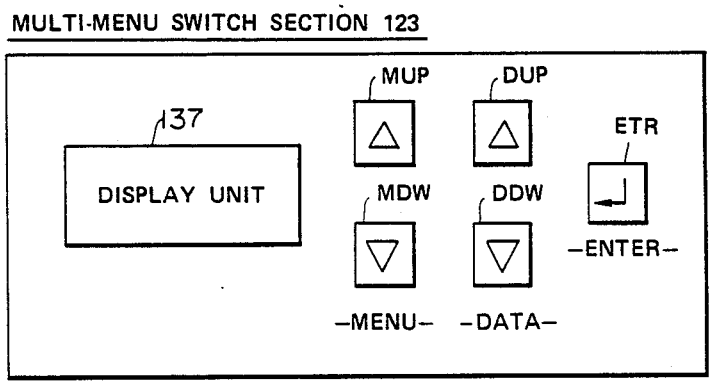
FIG. 36 is an illustration showing the multi-menu switch section 123 of the electronic musical instrument $10_4$ of FIG. 34.
Figure 37:
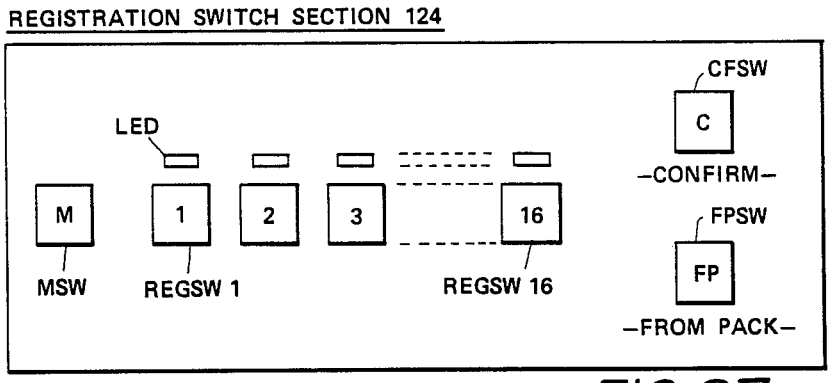
FIG. 37 is an illustration showing the registration switch section 124 of the electronic musical instrument $10_4$ of FIG. 34.

FIG. 35, 36 and 37 show in detail the tone-color switch section 122, the multi-menu switch section 12 and the registration switch section 124, respectively.

The tone-color switch section 122 comprises eight pieces of push-button type tone-color switches TCSW1 to TCCSW8 and eight LED indicators respectively disposed just above the tone-color switches TCSW1 to TCSW8. The tone-color switches TCSW1 to TCSW6 correspond respectively to predetermined particular tone colors, and when each of the switches TCSW1 to TCSW6 is depressed, parameters necessary for creating the corresponding particular tone color are supplied to the musical tone generating circuit 134. The last two tone-color switches TCSW7 and TCSW8 are reserved so as to be assigned desired tone colors. When any of the tone-color switches TCSW7 and TCSW8 is depressed, parameters necessary for creating the tone color assigned thereto are supplied to the musical tone generating circuit 134. These two tone-color switches are colored differently from the other tone-color switches to indicate that these switches can be assigned desired tone colors. In FIG. 35, the switches TCSW7 and TCSW8 are shaded to indicate that they have a different color. Actually however, the switches TCSW7 and TCSW8 have a color of white or gray, so that these switches are hereinafter referred to as "white switches".

The multi-menu switch section 123 comprises a display unit 137 composed, for example, of a liquid crystal display device, a menu-up switch MUP for changing the information displayed on the display unit 137 in the forward order as later described, a menu-down switch MDW for changing the information displayed on the display unit 137 in the reverse order, data-up and data-down switches DUP and DDW for numerically increasing and decreasing the data displayed on the display unit 137, and an enter switch ETR. To select tone colors to be assigned to the white switches TCSW7 and TCSW8, the menu-up switch MUP or the menu-down switch MDW is operated so that the name of the desired tone color is displayed on the display unit 137. It is not necessary to provide a particular switch for selecting mode for assigning desired tone colors to the white switches TCSW7 and TCSW8, since the system is so arranged that such a mode is automatically selected when any of the white switches TCSW7 and TCSW8 is depressed.

The registration switch section 124 comprises sixteen pieces of registration switches (preset switches) REGSW1 to REGSW16 corresponding respectively to sixteen groups of preset data, sixteen LED indicators each disposed just above a respective one of the registration switches REGSW1 to REGSW16, a confirmation switch CFSW, a memory switch MSW, and a from-pack switch FPSW. Each of the registration switch REGSW1 to REGSW16 is to select the number of the preset data, and is depressed to read or write the desired preset data. Each preset data may be produced in accordance with a known manner. For example, various parameters constituting one group of preset data (registration data) are set by operating predetermined switches and other control means on the control panel 121. The number of the registration of the preset data is selected by depressing the corresponding registration switch REGSW, and the preset data is registered correspondingly to the selected registration number by depressing the switch MSW. The memory switch MSW thus serves as a switch for commanding a writing of the preset data. This memory switch MSW also serves as a to-pack switch (i.e., a switch for commanding a transfer of the parameters stored in the internal memory to the external memory) when depressed simultaneously with the confirmation switch CFSW. The from-pack switch FPSW serves, when depressed simultaneously with the confirmation switch CFSW, as a switch for commanding a transfer of the parameters stored in the external memory to the internal memory.

(IV-2) Memories

Figure 38:
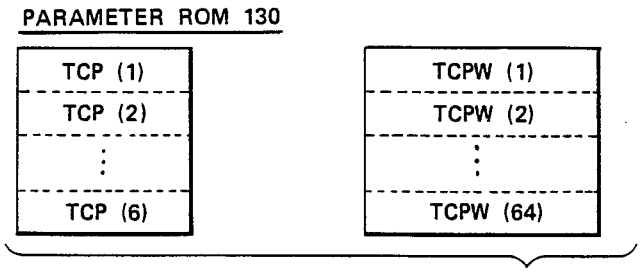
FIG. 38 is a memory map of the parameter ROM 130 of the electronic musical instrument $10_4$ of FIG. 34.

The ROM 130 stores, as shown in FIG. 38, tone-color parameters TCP(1) to TCP(6) corresponding respectively to the tone-color switches TCSW1 to TCSW6, and parameters TCPW(1) to TCPW(64) corresponding respectively to 64 kinds of tone colors which can be assigned to the white switches TCSW7 and TCSW8. Each of the parameters TCPW(1) to TCPW(64) includes a tone-color parameter and tone-color name data of the corresponding tone color. The tone-color parameter is a parameter for setting a tone color of the musical tone, and the tone-color name data is data needed to display the tone-color name of the musical tone on the display unit 137.

The tone colors assignable to the white switches TCSW7 and TCSW8 include, in addition to the 64 kinds of tone colors stored in the parameter ROM 130, eight kinds of tone colors produced by the player himself with the voice parameter producing unit 133. The eight kinds of tone colors produced by the player are shown as parameters TCPW(65) to TCPW(72) in FIG. 39. Each of these parameters TCPW(65) to TCPW(72) includes a tone-color parameter and tone-color name data and is stored in the RAM 129.

Thus, those of the 72 kinds of parameters assignable to the white switches TCSW7 and TCSW8 which have fixed values are stored in the ROM 130 as the parameters TCPW(1) to TCPW(64), and those of the 72 kinds of parameters which can be modified are stored in the RAM 129 as the parameters TCPW(65) to TCPW(72).

Figure 39:
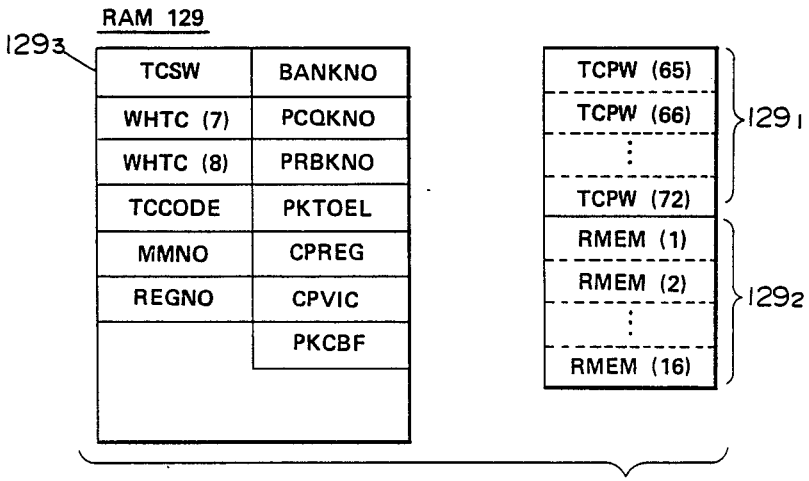
FIG. 39 is a memory map of the RAM 129 of the electronic musical instrument $10_4$ of FIG. 34.

As shown in FIG. 39, the RAM 129 comprises a voice parameter memory bank $129_1$, a registration data memory bank $129_2$ and a register memory bank $129_3$. The voice parameter memory bank $129_1$ stores the above-described parameters TCPW(65) to TCPW(72), and the registration data memory bank $129_2$ stores registration data (or the preset data) RMEM(1) to RMEM(16) corresponding respectively to the registration switches REGSW1 to REGSW16. The register memory bank $129_3$ provides various registers which will be described hereunder.

TCSW

The register TCSW stores data representative of the result of scanning of the tone-color switches TCSW1 to TCSW8.

WHTC(7)

The register WHTC(7) is a register for storing a tone-color code representative of the tone color presently assigned to the white switch TCSW7.

WHTC(8)

The register WHTC(8) is a register for storing a tone-color code representative of the tone color presently assigned to the white switch TCSW8.

TCCODE

The register TCCODE is a register for storing a tone-color code representative of the tone color whose name is currently displayed on the display unit 137.

MMNO

The register MMNO is a register for storing a multi-menu number representing the function which is under processing with the multi-menu switch section 123.

REGNO

The register REGNO is a register for storing the number of the registration switch REGSW (FIG. 37) which has been depressed.

BANKNO

The register BANKNO is a register for storing a bank number designating the bank of the external memory 131 with which the internal memory (RAM 129) transfers parameters. As more fully described later, the external memory 131 has a plurality of banks for storing parameters, and each transfer of parameters is performed on a bank-unit basis.

PCBKNO

The register PCBKNO is a register for storing a bank number designating the bank, with respect to which a partial copy operation is to be performed. As later described, each bank is composed of a plurality of different kinds of parameters, that is, the voice parameters and the registration data. The partial copy is a processing by which whole parameters within a bank are not transferred from the bank to another but only predetermined kinds of parameters within the bank are transferred to another bank.

PRBKNO

The register PRBKNO is a register for storing a bank number designating the bank, with respect to which a bank protection (a write inhibit on a bank-unit basis) is performed.

PKTOEL

The register PKTOEL is a register for storing data representative of the direction of the transfer of data performed in the partial copy. The data PKTOEL (pack to electronic musical instrument) is rendered "1" when the data is transferred from the external memory to the internal memory, and is rendered "0" when the data is transferred from the internal memory to the external memory.

CPREG and CPVIC

The registers CPREG and CPVIC are registers for storing data representative of the kinds of the parameters which are to be transferred to achieve the partial copy. The register CPREG stores "1" when the registration data (the preset data) are selectively copied, and stores "0" when no copy is performed. The register CPVIC stores "1" when the voice parameters are selectively copied, and stores "0" when no copy is performed.

PKCBF

The register PKCBF is a buffer register for storing data representative of the kind of the parameters which are stored into the external memory 131, the data being hereinafter referred to as a "pack code".

The RAM 129 includes, in addition to the above registers, a data storage area for storing data obtained as a result of scanning of the keys, data for assigning the key data to the tone generating channels, data obtained as a result of scanning of the other switches and control means of the control panel 121, and so on. The RAM 129 also includes a working area.

The external memory 131 comprises a pack-code memory PKCODE, a bank-protect memories BKPRO(1) to BKPRO(16), and a parameter memory section 310. The parameter memory section 310 is accessed so that data is read therefrom or written thereinto on a bank-unit basis. However, in the case of the partial copy, data can be selectively read from or written into a bank of the parameter memory section 310.

The parameter memory section 310 stores one or more kinds of parameters, wherein the parameters of each kind are stored into sixteen banks. In this embodiment, two kinds of parameters, namely, the registration data and the voice parameters, are stored in the parameter memory section 310. PACKR(1) to PACKR(16) are banks for storing the registration data, and PACKV(1) to PACKV(16) are banks for storing voice parameters, wherein the numerals within the parentheses represent the bank numbers. Each of the registration data banks PACKR(1) to PACKR(16) stores sixteen sets of registration data, each set corresponding to a respective one of the RMEM(1) to RMEM(16) stored in the registration data memory bank $\mathbf{129}_2$ of the RAM 129 of FIG. 39. Each of the voice parameter banks PACKV(1) to PACKV(16) stores eight sets of voice parameters, each set corresponding to a respective one of the TCPW(65) to TCPW(72) stored in the voice parameter memory bank $\mathbf{129}_1$ of the RAM 129 of FIG. 39. The external memory 131 may provide, in the parameter memory section 310, either of the group of the registration data banks PACKR(1) to PACKR(16) and the group of the voice parameter banks PACKV(1) to PACKV(16). Usually, those parameters belonging to the banks having the same bank number are read or written in a unit, even if the parameters are different in kind. For example, when the bank bearing the bank number "1" is accessed to read, the registration data contained in the bank PACKR(1) and the voice parameters contained in the bank PACKV(1) are read from the external memory 131. However, in the case of the partial copy, parameters of the same kind are read from or written into the bank of the same bank number.

The pack-code memory PKCODE stores a pack code (identification data) which indicates the kind of the external memory 131, for example, in accordance with the kind of the parameters stored in the external memory 131. For example, the pack code is "1" when the external memory 131 stores only the registration data, "2" when the external memory 131 stores only the voice parameters, and "3" when the external memory 131 stores both of the registration data and the voice parameters.

Each of the bank-protect memories BKPRO(1) to BKPRO(16) stores data representative of whether the data stored in those banks bearing the corresponding bank number are to be protected from alteration. Each bank-protect memory whose corresponding banks must be protected stores "1", and each bank-protect memory whose corresponding banks need not be protected stores "0".

(IV-3) Operation

The operation of the electronic musical instrument $\mathbf{10}_4$ will now be described with reference to flow charts of the programs executed by the CPU 127.

When power is supplied to the instrument $\mathbf{10}_4$, the CPU 127 starts to execute a main routine shown in FIG.

Figure 42:
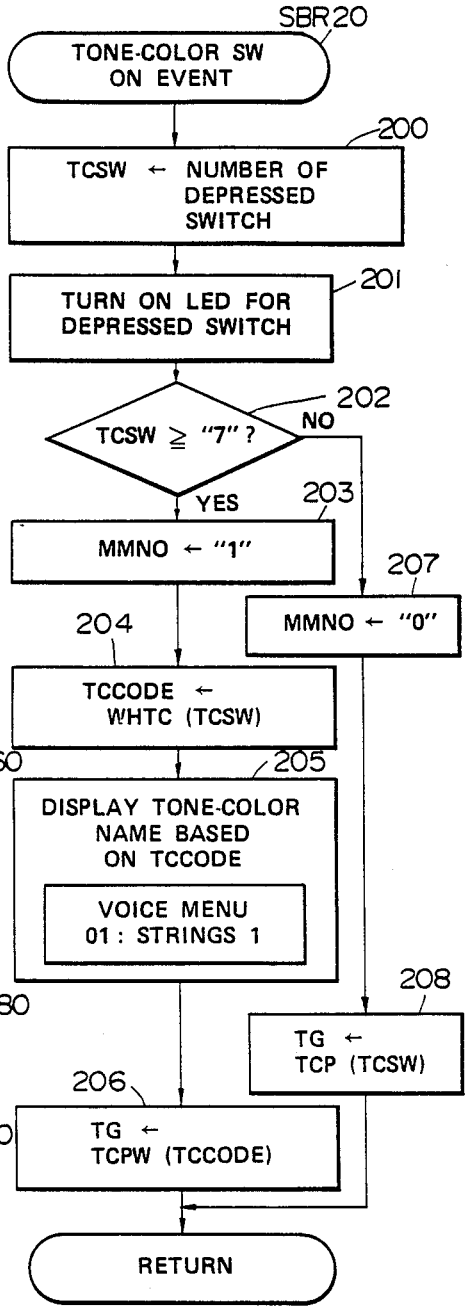
FIG. 42 is a flow chart of the subroutine SBR20 executed by the CPU 127 of FIG. 34.

41. The CPU 127 first initializes the registers in the RAM 129 at step S10. At the next step S20, the CPU 127 performs a processing for scanning the tone-color switch section 122. If an ON event of any of the tone-color switches TCSW1 to TCSW8 is detected in the step S20, a subroutine SBR20 shown in FIG. 42 is executed. The CPU 127 then performs at step S30 a processing for determining whether the external memory 131 is connected to the interface 132. If it is determined at the step S30 that the external memory 131 is connected to the interface, a subroutine SBR21 shown in FIG. 43. Then, the CPU 127 performs at step S40 a processing for scanning the multimenu switch section 123. If an ON event of the menu-up switch MUP is detected at the step S40, the CPU 127 executes a subroutine SBR22 shown in FIGS. 44(A) and 44(B). If an ON event of the menu-down switch MDW is detected at the step S40, the CPU 127 executes a subroutine SBR26 shown in FIGS. 45(A) and 45(B). If an ON event of the data-up switch DUP is detected at the step S40, the CPU 127 executes a subroutine SBR30 shown in FIGS. 46(A), 46(B) and 46(C). If an ON event of the data-down switch DDW is detected at the step S40, the CPU 127 executes a subroutine SBR35 shown in FIGS. 47(A) and 47(B). If an ON event of the enter switch ETR is detected at the step S40, the CPU 127 executes a subroutine SBR38 shown in FIGS. 48(A) and 48(B).

The CPU 127 then performs at the next step S50 a processing for scanning the registration switch section 124. If an ON event of any of the registration switches REGSW1 to REGSW16 is detected, the CPU 127 executes a subroutine SBR42 shown in FIG. 49. If an ON event of the from-pack switch FPSW is detected at the step S50, the CPU 127 executes a subroutine SBR43 shown in FIG. 50. On the other hand, if an ON event of the confirmation switch CFSW is detected, a subroutine SBR44 shown in FIGS. 51(A) and 51(B) is executed.

The CPU 127 then performs a processing for scanning the multi-menu control section 125 at step S60, and subsequently performs a processing for scanning the control section 126 at the next step S70. Then, the CPU 127 performs a processing for the voice parameter producing unit 133 at step S80. By this processing, the voice parameters produced in accordance with the player's preference are stored into the RAM 129 as the voice parameters TCPW(65) to TCPW(72). Finally, the CPU 127 performs a processing for scanning the key-switch circuit 120 and for assigning the key information to the tone generating channels.

The subroutine SBR20 will now be described with reference to the flow chart of FIG. 42.

When an ON event of one of the tone-color switch TCSW1 to TCSW8 is detected, the number of the depressed tone-color switch is stored into the register TCSW at step 200. Then, the LED indicator corresponding to the depressed tone-color switch is turned on at step 201. It is then determined whether the number stored in the register TCSW is more than or equal to "7" at step 202. If the number is more than or equal to "7", the depressed switch is the white switch TCSW7 or TCSW8, and if the number is less than "7", the depressed switch is one of the tone-color switches TCSW1 to TCSW6.

If it is determined that one of the white switches has been depressed, the processing proceeds to step 203, at which the multi-menu number in the register MMNO is set to "1". At the next step 204, the tone-color code stored in one of the registers WHTC(7) and WHTC(8) designated by the switch number ("7" or "8") contained in the register TCSW, that is, the tone-color code stored in the register WHTC(TCSW), is read and stored into the register TCCODE. At the next step 205, the name of the tone color designated by the tone-color code stored in the register TCCODE is displayed on the display unit 137, as shown in the block of the step 205. The upper portion of the display, "VOICE MENU", is the menu corresponding to the multi-menu number MMNO of "1", and means that the multi-menu switch section 123 is used as means for selecting a tone color to be assigned to the white switch. The lower portion of the display represents the tone-color name corresponding the tone-color code in the register TCCODE. The example shown in the block of the step 205 is the case where the tone-color code is "01", in which case the corresponding tone-color name is "STRINGS 1". Thus, the upper portion of the display is changed in accordance with the contents of the register TCCODE. By the above-described processing, the tone-color name of the tone color currently assigned to the white switch TCSW7 or TCSW8 is displayed on the display unit 137. At the next step 206, one of the voice parameters TCPW(1) to TCPW(72) corresponding to the tone-color code in the register TCCODE, that is to say, the voice parameter TCPW(TCCODE), is read from the RAM 129 or the ROM 130, and is supplied to the musical tone generating circuit (or simply TG) 134. As a result, the tone color of the musical tone signal generated by the musical tone generating circuit 134 is determined by the voice parameter assigned to the depressed white switch. Then, the processing returns to the main routine.

If the depressed switch is not the white switch, the processing proceeds from the step 202 to step 207 at which the register MMNO is cleared. At the next step 208, one of the voice parameters TCP(1) to TCP(6) corresponding to the switch number (any one of "1" to "6") in the register TCSW, that is to say, the voice parameter TCP(TCSW), is read from the ROM 130, and is supplied to the musical tone generating circuit 134. Then, the processing returns to the main routine.

The subroutine SBR21 will now be described with reference to FIG. 43.

When the connection of the external memory 131 is detected, the multi-menu number register MMNO is set to "2" at step 210. At the next step 211, the pack code is read from the memory PKCODE of the external memory 131. At the next step 212, data representative of the kind of the external memory (or the pack) is displayed on the display unit 137 based on the read pack code. One example of such display is shown in the block of the step 212. The upper portion of the display, "RAM PACK", indicates that the external memory is composed of a RAM. The lower portion of the display, "-REGIST & VOICE-" indicates that the kinds of the parameters stored in the external memory are the registration data and the voice parameter. In the case where the external memory is composed of a ROM, "ROM PACK" is displayed at the upper portion of the display. When the external memory stores only the registration data as the parameters, "-REGIST-" is displayed at the lower portion of the display, while when the external memory stores only the voice parameters, "-VOICE-" is displayed at the lower portion of the display. In this embodiment, three kinds of RAM-type external memories are provided, so that one of the displays shown in FIGS. 52(A), 52(B) and 52(C) is made. Thus, with this embodiment, the data representative of kind of the external memory is automatically displayed when the external memory is connected to the instrument $10_4$, so that any particular operation by the player is not necessary.

The subroutines SBR22, SBR26, SBR30, SBR35, SBR38, SBR43 and SBR44 will now be described with respect to each function of the electronic musical instrument $10_4$.

Assignment of Tone-Color to White Switch

When any of the white switches TCSW7 and TCSW8 is depressed, the multi-menu number MMNO is rendered "1" by the processing of the step 203 of FIG. 42. As a result, the voice parameter of the tone color assigned to the depressed white switch is supplied to the musical tone generating circuit 134 to set the tone color of the musical tone signal, and, at the same time, the instrument $10_4$ is automatically brought into a mode for assigning a new tone color to this white switch. The flow of information in this processing is shown in FIG. 53.

As described earlier with respect to the steps 202 to 206 of FIG. 42, when any of the white switches TCSW7 and TCSW8 is depressed, the code of the tone color currently assigned thereto is read from one of the registers WHTC(7) and WHTC(8) corresponding to the depressed white switch, and is stored into the register TCCODE. Then, one of the groups of voice parameters TCPW(1) to TCPW(72) is read in accordance with the tone-color code in the register TCCODE and supplied to the musical tone generating circuit 134. At the same time, the tone color name is displayed on the display unit 137. The voice parameter is read in this manner.

In this mode, by changing the contents of the register TCCODE through the operation of the menu-up switch MUP or the menu-down switch MDW, a desired one of the 72 kinds of tone colors corresponding respectively to the voice parameters TCPW(1) to TCPW(72) can be selected, wherein the name of the selected tone color is displayed on the display unit 137. At the same time, the tone color to be assigned to the white switch is changed by storing the contents of the register TCCODE into the register WHTC(7) or WHTC(8).

The above operation is accomplished in the following manner.

Figure 44A:
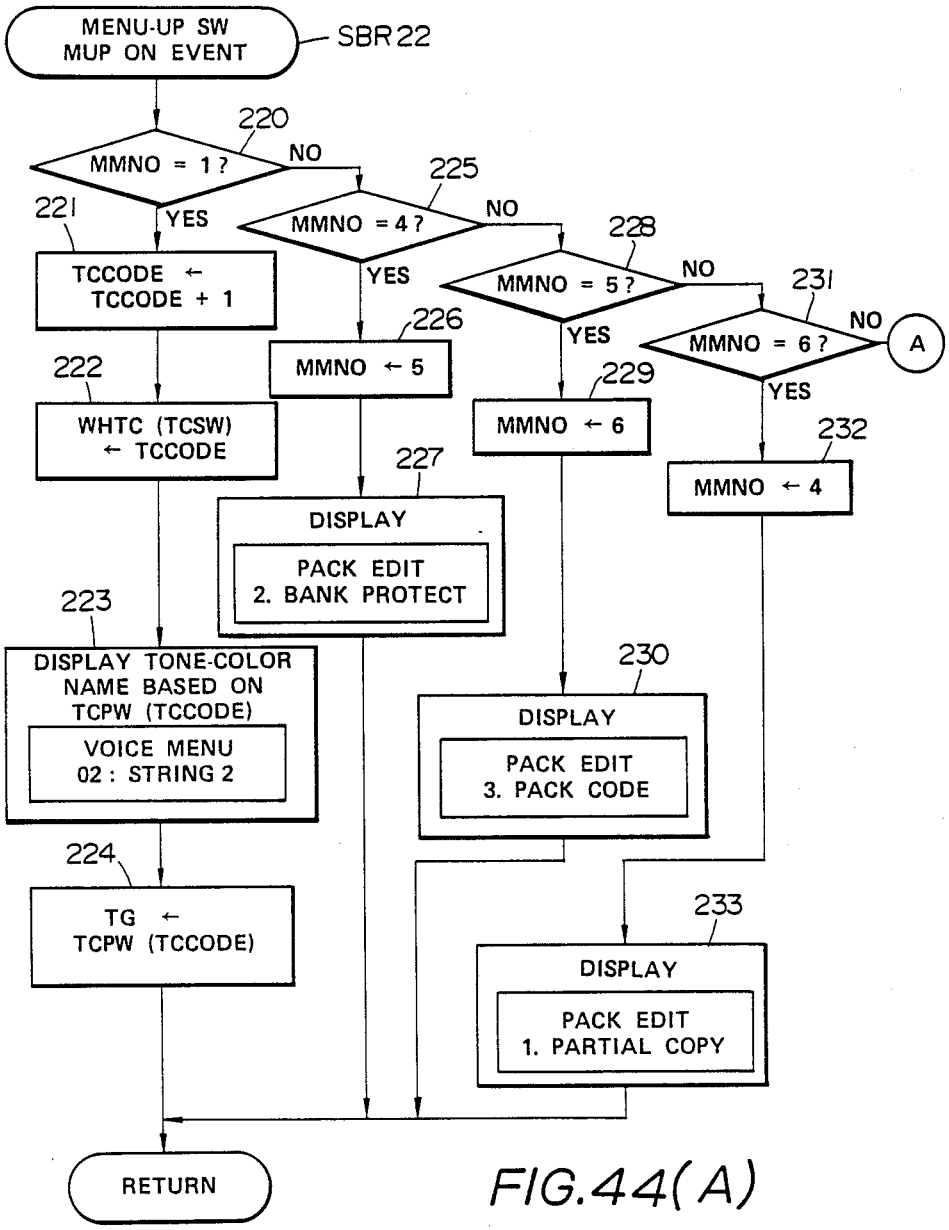
FIG. 44(A) is a flow chart of the subroutine SBR22 executed by the CPU 127 of FIG. 34.
Figure 44B:
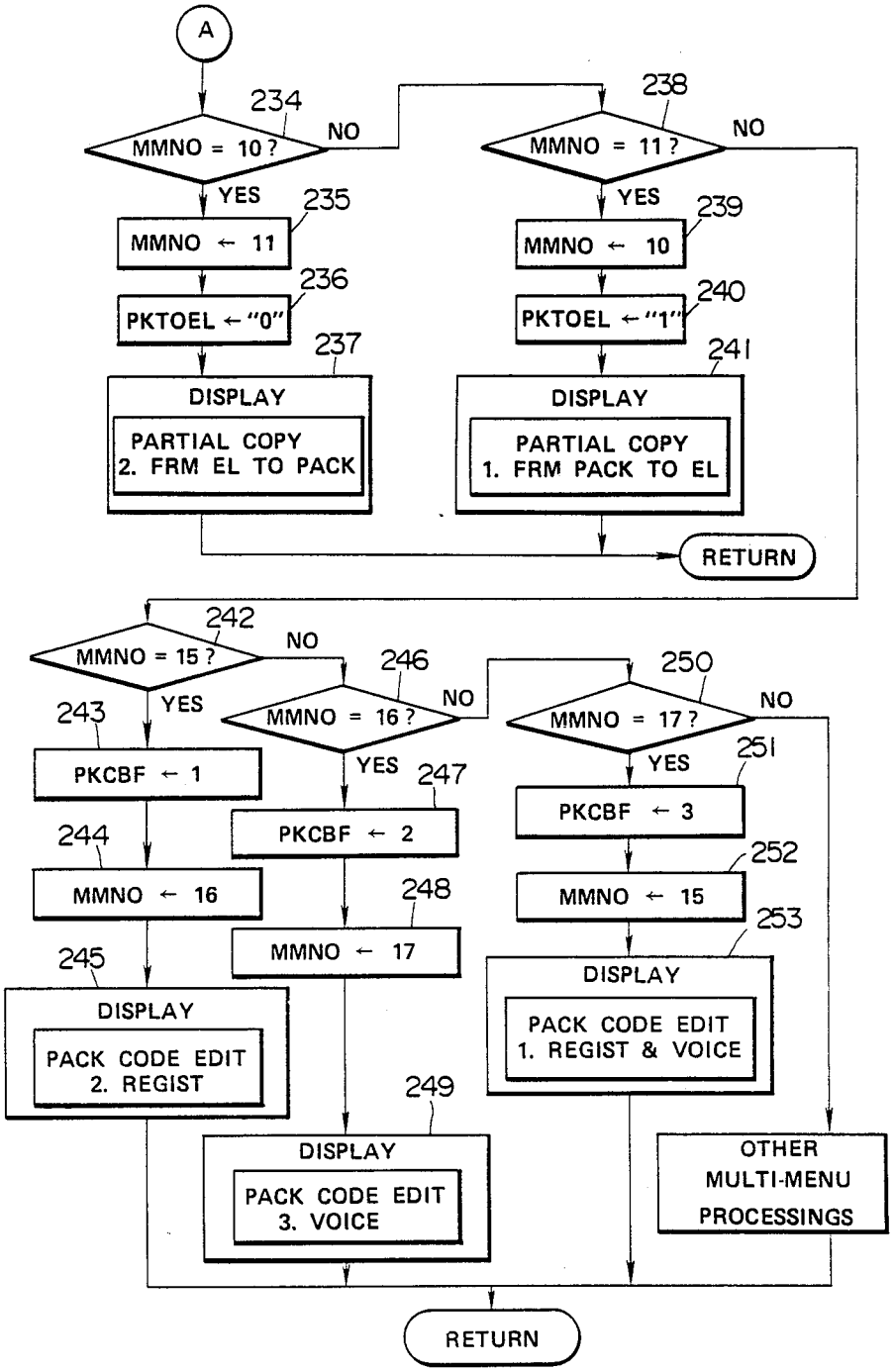
FIG. 44(B) is a continuation of the flow chart of FIG. 44(A)

When the menu-up switch MUP is depressed, the subroutine SBR22 (FIGS. 44(A) and 44(B)) is started. The processing proceeds through step 220 (MMNO="1") to step 221 at which the tone-color code in the register TCCODE is incremented by one. The maximum value of the tone-color code is "72", so that when the result of the increment exceeds "72", the tone-color is set to the minimum value of "1". At the next step 222, the tone-color code in the register TCCODE is stored into the register WHTC(TCSW) corresponding to the depressed white switch to thereby register the tone-color code. At the next step 223, the voice parameter TCPW(TCCODE) corresponding to the tone-color code in the register TCCODE is read from among the voice parameters TCPW(1) to TCPW(72), and the name of the tone color is displayed on the display unit 137. At the next step 224, the voice parameter TCPW(TCCODE) is supplied to the musical tone generating circuit 134. Then, the processing returns to the main routine.

Figure 45A:
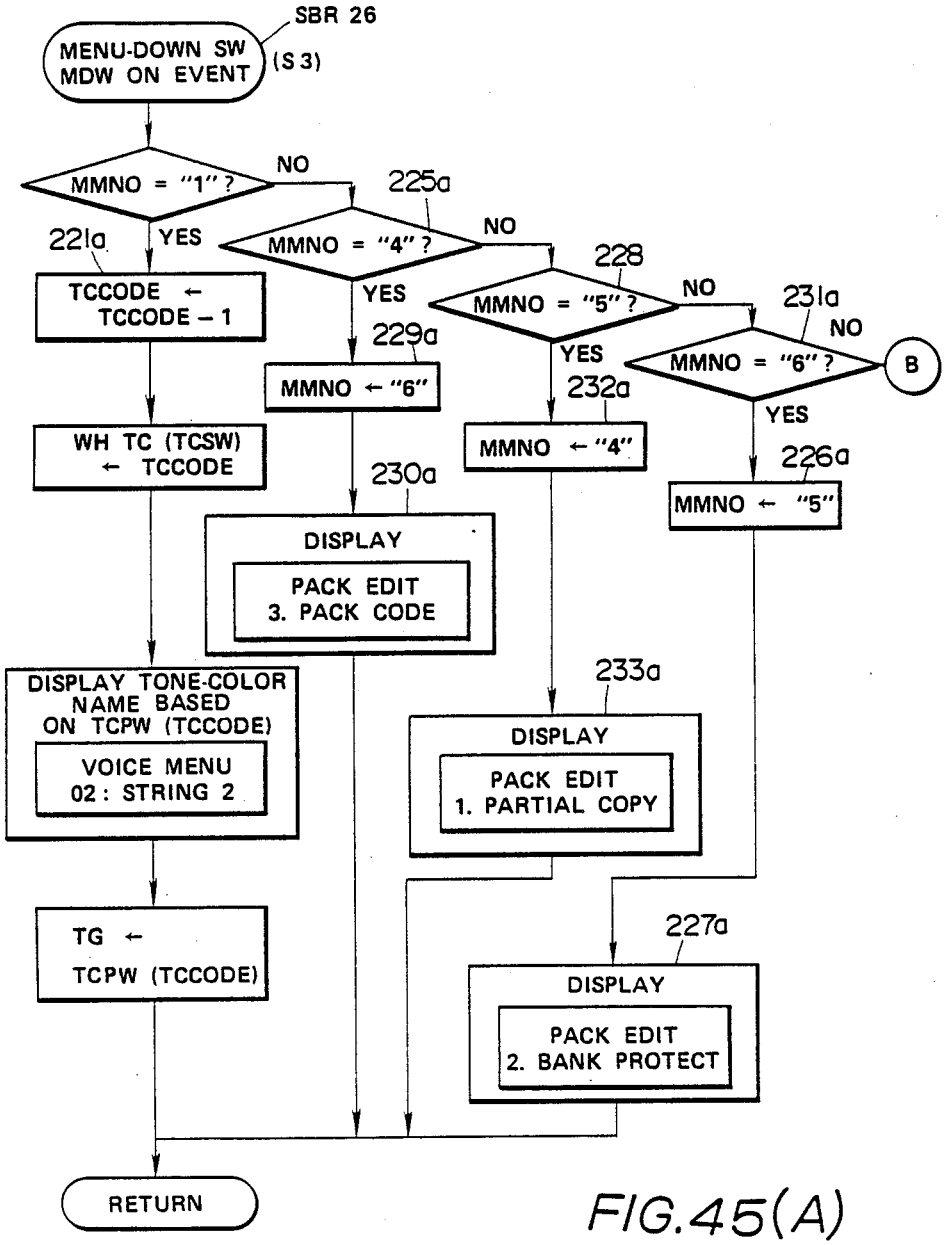
FIG. 45(A) is a flow chart of the subroutine SBR26 executed by the CPU 127 of FIG. 34.
Figure 45B:
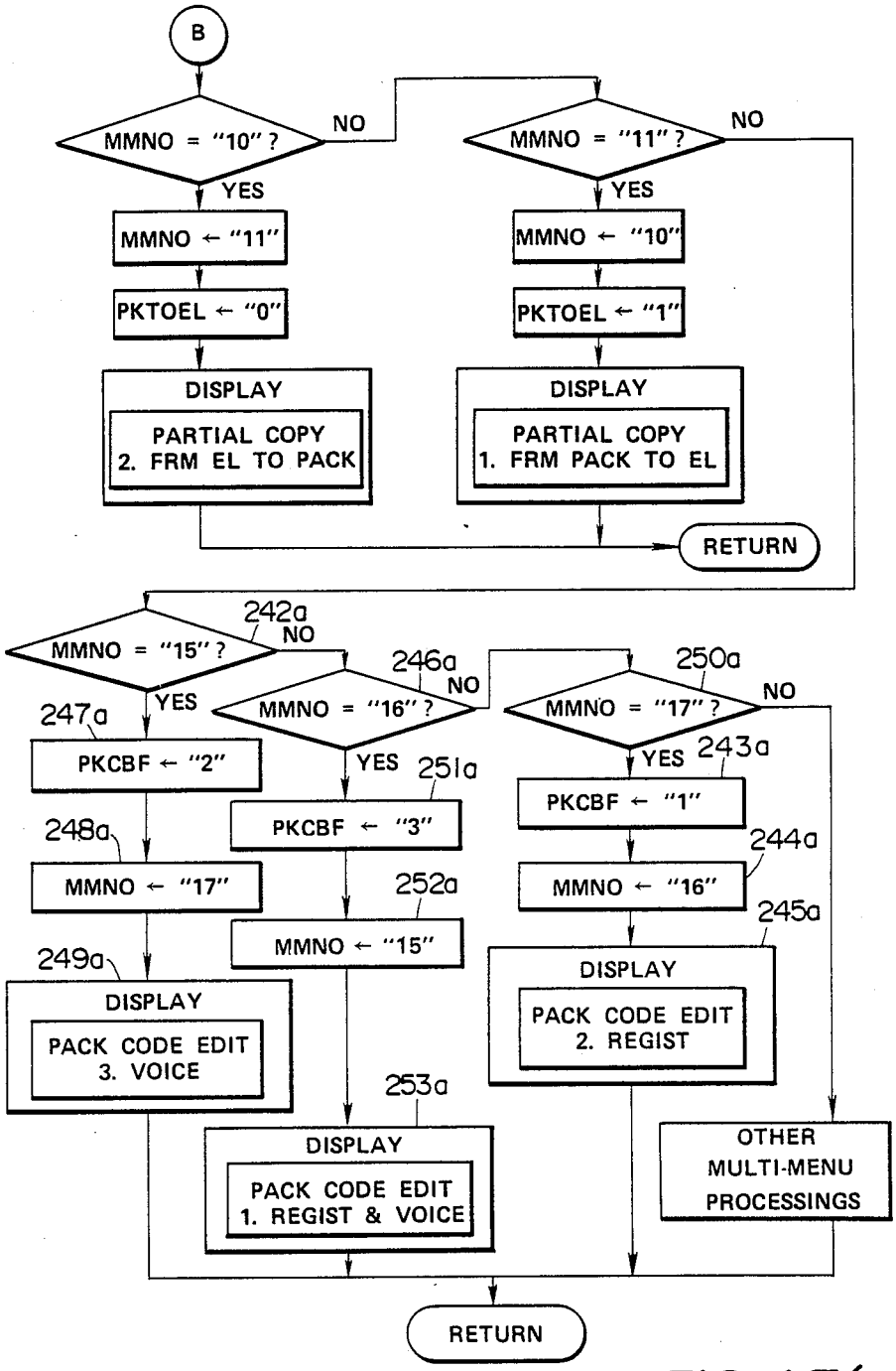
FIG. 45(B) is a continuation of the flow chart of FIG. 45(A)

The subroutine SBR26 of FIGS. 45(A) and 45(B), which is executed when the menu-down switch MDW is depressed, is similar to the subroutine SBR22 of FIGS. 44(A) and 44(B), but has step 221*a* different from the step 221 of FIG. 44(A). At the step 221*a*, the tone-color code in the register TCCODE is decremented by one. The minimum value of the tone-color code is "1", so that if the tone-color code becomes less than "1", the tone-color code is set to the maximum value of "72".

Connection of External Memory

Figure 43:
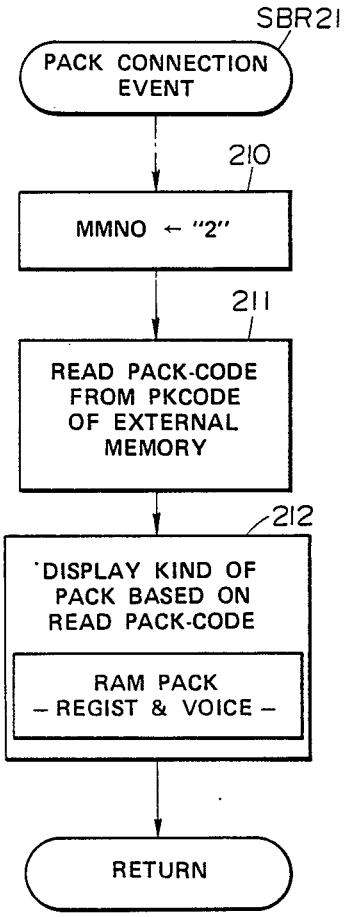
FIG. 43 is a flow chart of the subroutine SBR21 executed by the CPU 127 of FIG. 34.

When the external memory 131 is connected to the instrument $10_4$, MMNO is rendered "2" by the aforesaid processing executed at the step 210 of FIG. 43. At this time, the data identifying the external memory is displayed on the display unit 137 as described above.

When the confirmation switch CFSW or the from-pack switch FPSW is depressed during the time when MMNO is "2", the contents of the register MMNO are changed to "3" to bring the instrument $10_4$ into a mode where a desired bank number can be selected by operating the multi-menu switch section 123. The selection of the bank number is performed by depressing the data-up switch DUP or the data-down switch DDW.

Figure 50:
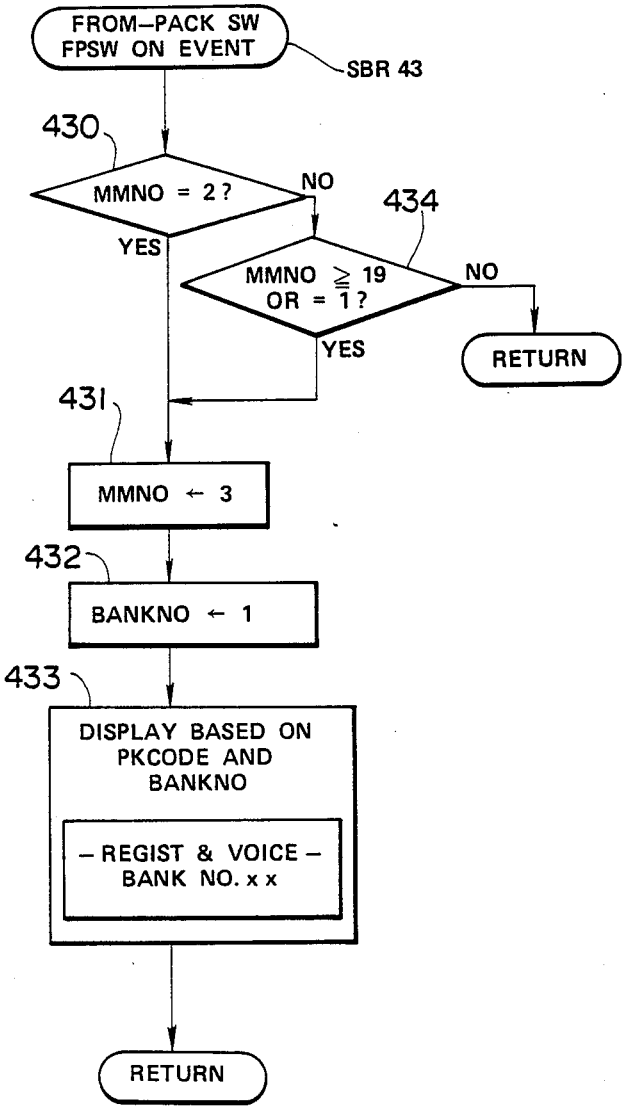
FIG. 50 is a flow chart of the subroutine SBR43 executed by the CPU 127 of FIG. 34.
Figure 51A:
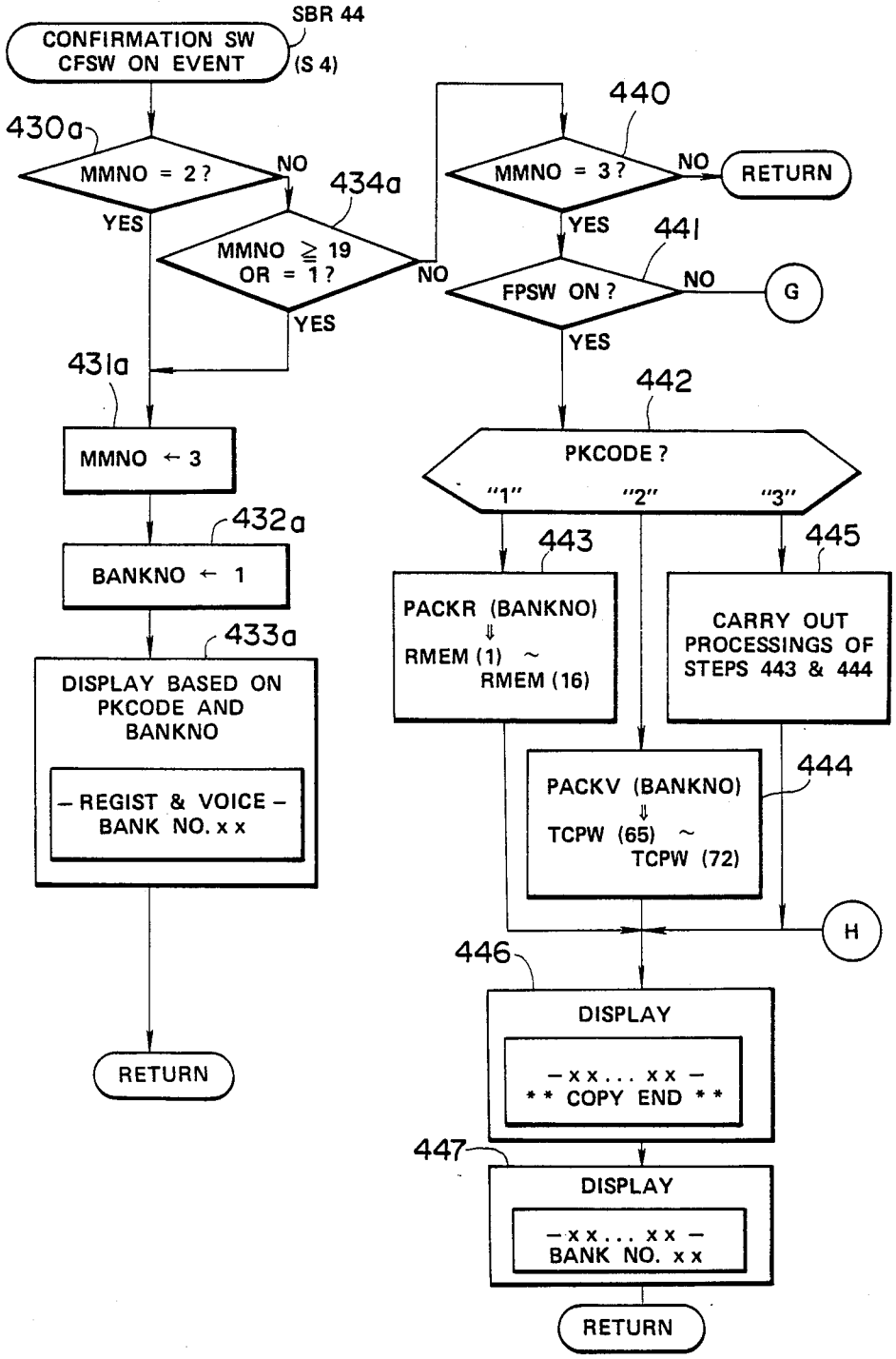
FIG. 51(A) is a flow chart of the subroutine SBR44 executed by the CPU 127 of FIG. 34.
Figure 51B:
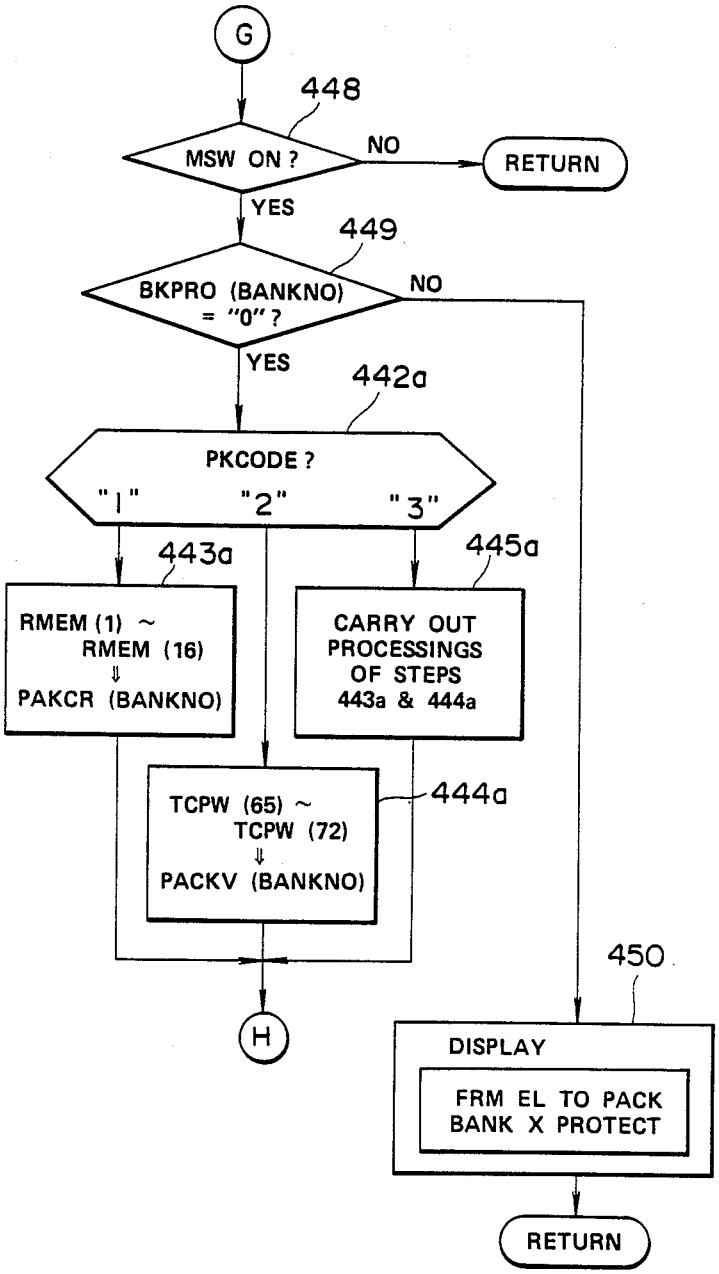
FIG. 51(B) is a continuation of the flow chart of FIG. 51(A)

When the from-pack switch FPSW is depressed during the time when MMNO is "2", the result of determination at step 430 of FIG. 50 becomes "Yes", so that MMNO is rendered "3" at the next step 431. Then, "1" is stored into the bank number register BANKNO as the initial value at step 432. At the next step 433, the identification data corresponding to the pack code stored in the register PKCODE is displayed on the display unit 137 at the upper portion, and the bank number stored in the register BANKNO is displayed on the display unit 137 at the lower portion. Shown in the block of the step 433 is one example of such display, wherein the characters "XX" may be numerical data corresponding to the contents of the bank number register BANKNO. Then, the processing returns to the main routine.

When the confirmation switch CFSW is depressed during the time when MMNO is "2", processings of steps 430*a* to 433*a* shown in FIG. 51 are carried out in a manner described above for the steps 430 to 433 of FIG. 50.

Even when MMNO is not "2", MMNO is set to "3" through step 434 (FIG. 50) or 434*a* (FIG. 51) at the step 431 or 431*a* if the instrument $10_4$ is in a mode other than the mode for editing the parameters. Where MMNO is more than or equal to "19", the multi-menu is used for a purpose other than the edition of parameters.

Figure 46A:
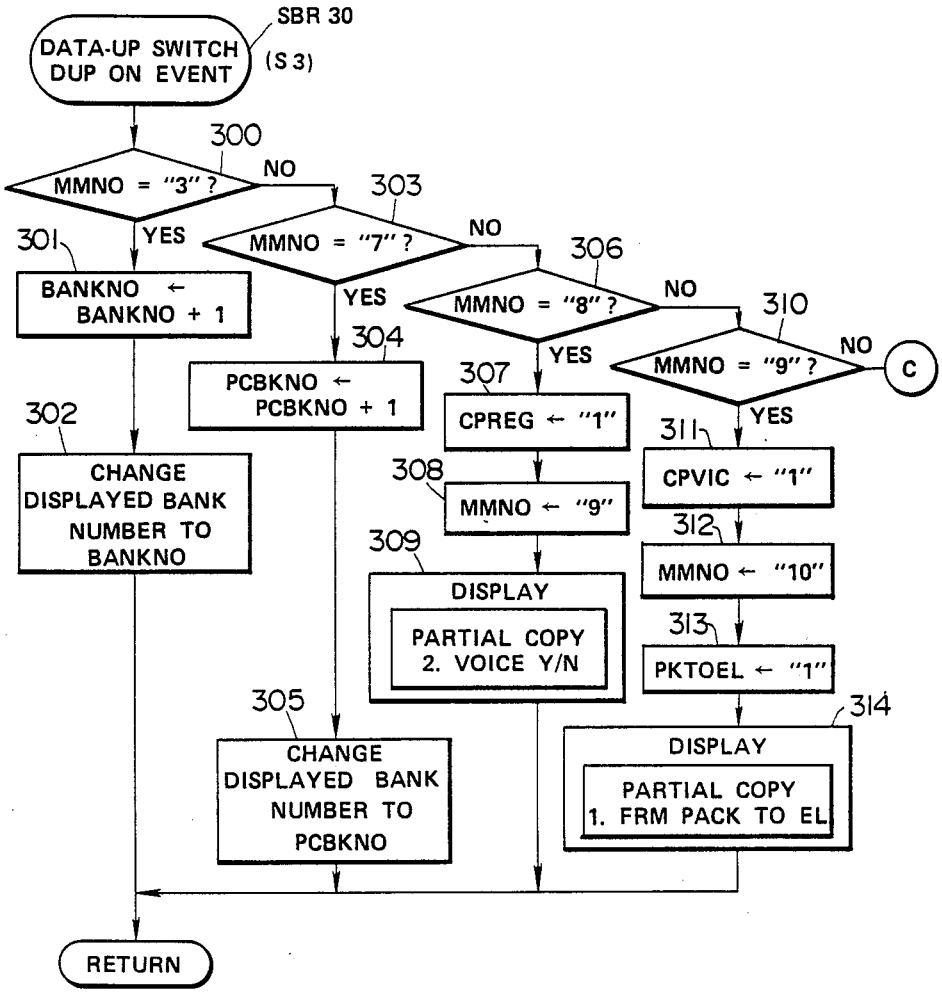
FIG. 46(A) is a flow chart of the subroutine SBR30 executed by the CPU 127 of FIG. 34.
Figure 46B:
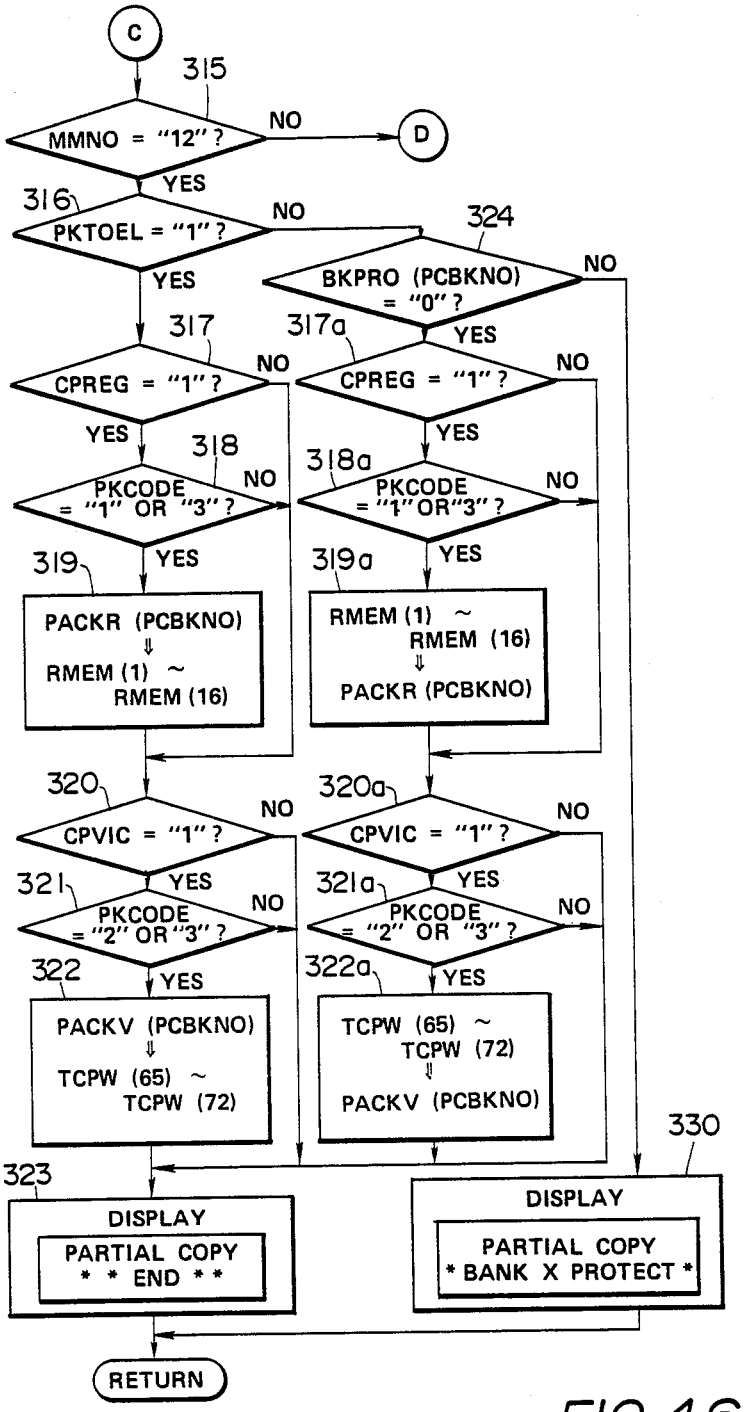
FIG. 46(B) is a continuation of the flow chart of FIG. 46(A)
Figure 46C:
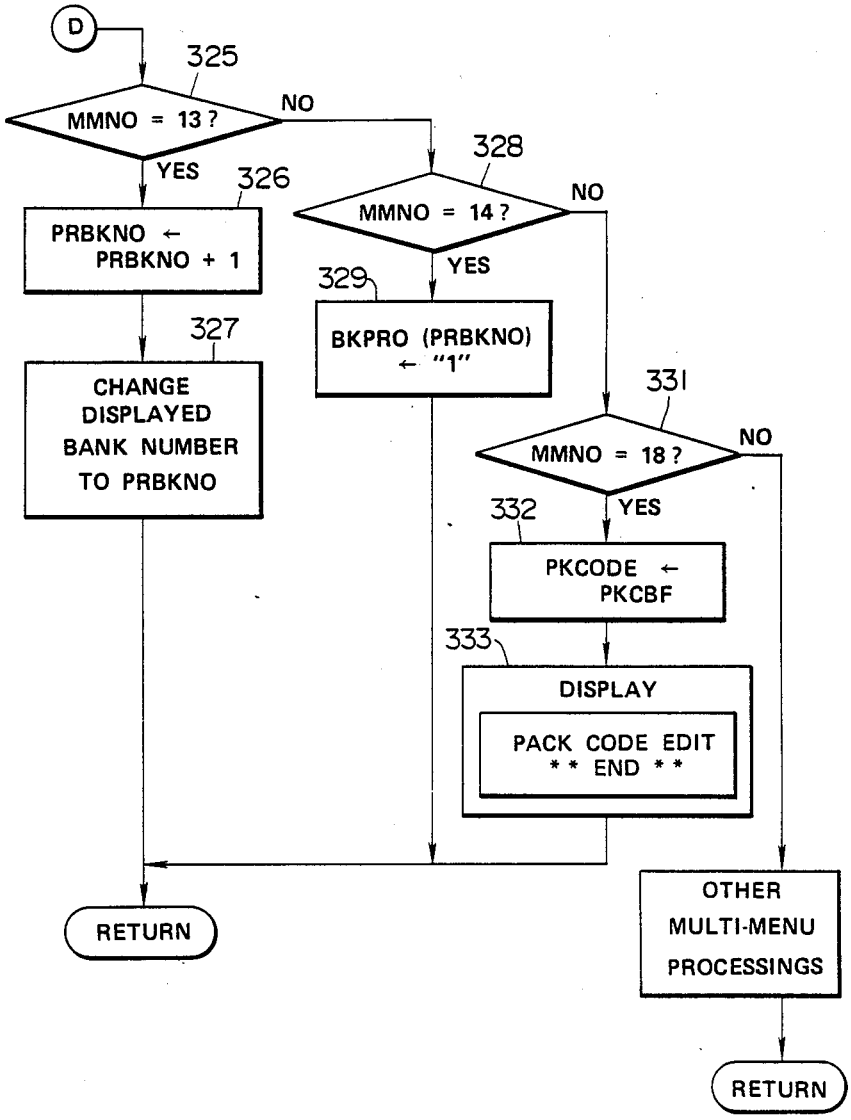
FIG. 46(C) is a continuation of the flow chart of FIG. 46(B)

When MMNO is "3", the value of BANKNO is changed by operating the switches DUP and DDW. When the data-up switch DUP is depressed, the subroutine SBR30 of FIGS. 46(A), 46(B) and 46(C) is executed. In this case, the processing proceeds through step 300 (FIG. 46(A)) to step 301 at which the bank number in the register BANKNO is incremented by one. The maximum value of the bank number is "16", so that if the result of the increment exceeds "16", the bank number is set to "1". At the next step 302, the bank number displayed on the display unit 137 at the lower portion is changed to the value contained in the register BANKNO. Then, the processing returns to the main routine. On the other hand, when the data-down switch DDW is depressed, processings similar to those performed at the steps 300 to 302 of FIG. 46(A) are performed at steps 300*a* to 302*a* of the subroutine SBR35 shown in FIG. 47(A). In this case, however, the bank number in the register BANKNO is decremented by one at the step 301*a*. If the bank number becomes less than the minimum value of "1", the bank number is set to "16".

As described above, when MMNO is "3", a desired bank number can be selected by operating the switches DUP and DDW, and the selected bank number is stored into the register BANKNO. The bank number stored in the register BANKNO designates the number of the bank of the external memory, with which the internal memory transfers data, on a bank-unit basis in the normal mode.

Normal Edition of Parameters

When it is desired to transfer the parameters defined by the bank number in the register BANKNO from the external memory to the internal memory at once, the confirmation switch CFSW is turned on with the from-pack switch being depressed. As described earlier, hen a desired bank number is stored in the register BANKNO, the data contained in the register MMNO is "3", and the result of determination at step 440 of the subroutine SBR44 (FIG. 51(A)), which is executed when the confirmation switch CFSW is depressed, becomes "Yes", so that the processing proceeds to step 441 of FIG. 51(A). If the from-pack switch FPSW is depressed at this time, the result of the determination at the step 441 is "Yes", so that the processing proceeds to step 442.

At this step 442, the pack code stored in the register PKCODE is examined, and the processing proceeds to one of steps 443 to 445 in accordance with the pack code. If the pack code indicates only the registration data, the processing proceeds to the step 443. At this step 443, the registration data in the amount of one bank are read from the registration data bank PACKR-(BANKNO) of the external memory corresponding to the bank number in the register BANKNO and stored into the registration data memories RMEM(1) to RMEM(16) of the RAM 129. If the pack code indicates only the voice parameters, the processing proceeds from the step 442 to the step 444. At this step 444, the voice parameters in the amount of one bank are read from the voice parameter bank PACKV(BANKNO) of the external memory and stored into the voice parameter memories TCPW(65) to TCPW(72) of the RAM 129. If the pack code indicates both of the registration data and the voice parameters, the processing proceeds from the step 442 to step 445. At the step 445, the registration data and the voice parameters each in the amount of one bank are read from the bank PACKR-(BANKNO) and the bank PACKV(BANKNO) of the external memory, and stored respectively into the bank RMEM(1) to RMEM(16) and the bank TCPW(65) to TCPW(72) of the RAM 129. Then, the processing proceeds from the step 443, 444 or 445 to step 446.

At the step 446, a display is made on the display unit 137. More specifically, a message "COPY END" indicating that the block copy is completed is displayed for a predetermined period, as shown in the block of the step 446. At the next step 447, the bank number is displayed, as shown in the block of the step 447. What is displayed at the upper portion of each block of the steps 446 and 447 is determined by the pack code.

When it is desired to copy the parameters of the internal memory, that is, when it is desired to transfer the parameters contained in the bank of the internal memory designated by BANKNO to the external memory in a block, the confirmation switch is turned on with the memory switch MSW being depressed. In this case, the processing proceeds from the step 441 (FIG. 51(A)) through step 448 (FIG. 51(B)) to step 449. At this step 449, it is determined whether the bank designated by BANKNO is protected from alteration. More specifically, the data in the bank-protect memory BKPRO(-BANKNO) corresponding to the bank number contained in the register BANKNO is read, and it is determined whether the read data is "0", that is, whether the bank is not protected. If the bank is not protected, processings similar to those of the steps 442 to 445 are performed at steps 442*a* to 445*a*. Then, the processing proceeds to the step 446 (FIG. 51(A)). It should be noted that the transfer of data effected at each of the steps 443*a* to 445*a* is opposite in direction to that effected at each of the steps 443 to 445.

Selection of Special Function for Editing Parameters

This embodiment provide three kinds of special parameter editing functions, namely, a partial copy, a bank protection and a writing of pack-code. The instrument $10_4$ is brought into a mode for selecting these functions when the enter switch ETR is depressed with the contents of the multi-menu number register MMNO being "2", that is, with the external memory being connected.

Figure 48A:
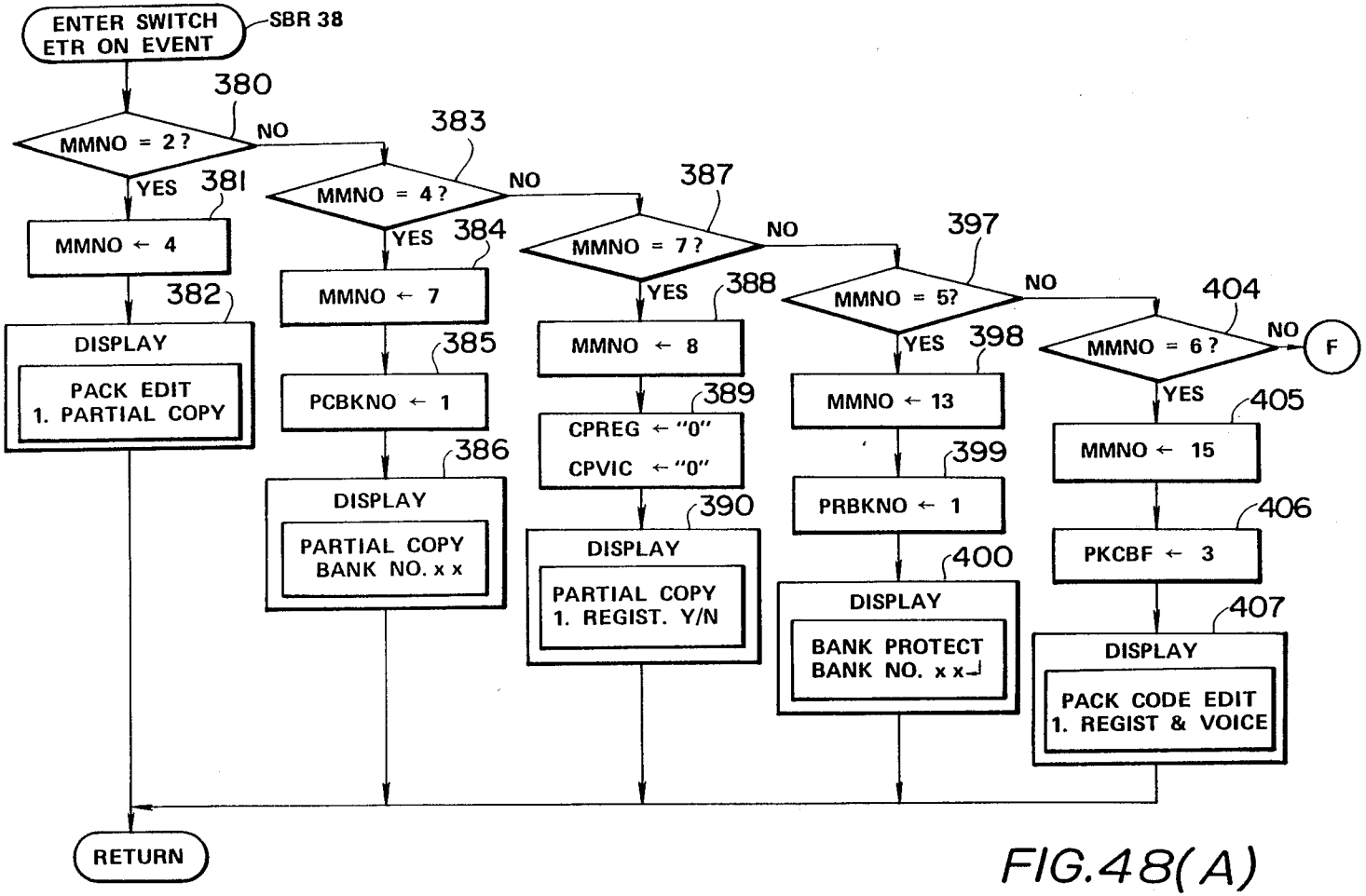
FIG. 48(A) is a flow chart of the subroutine SBR38 executed by the CPU 127 of FIG. 34.
Figure 48B:
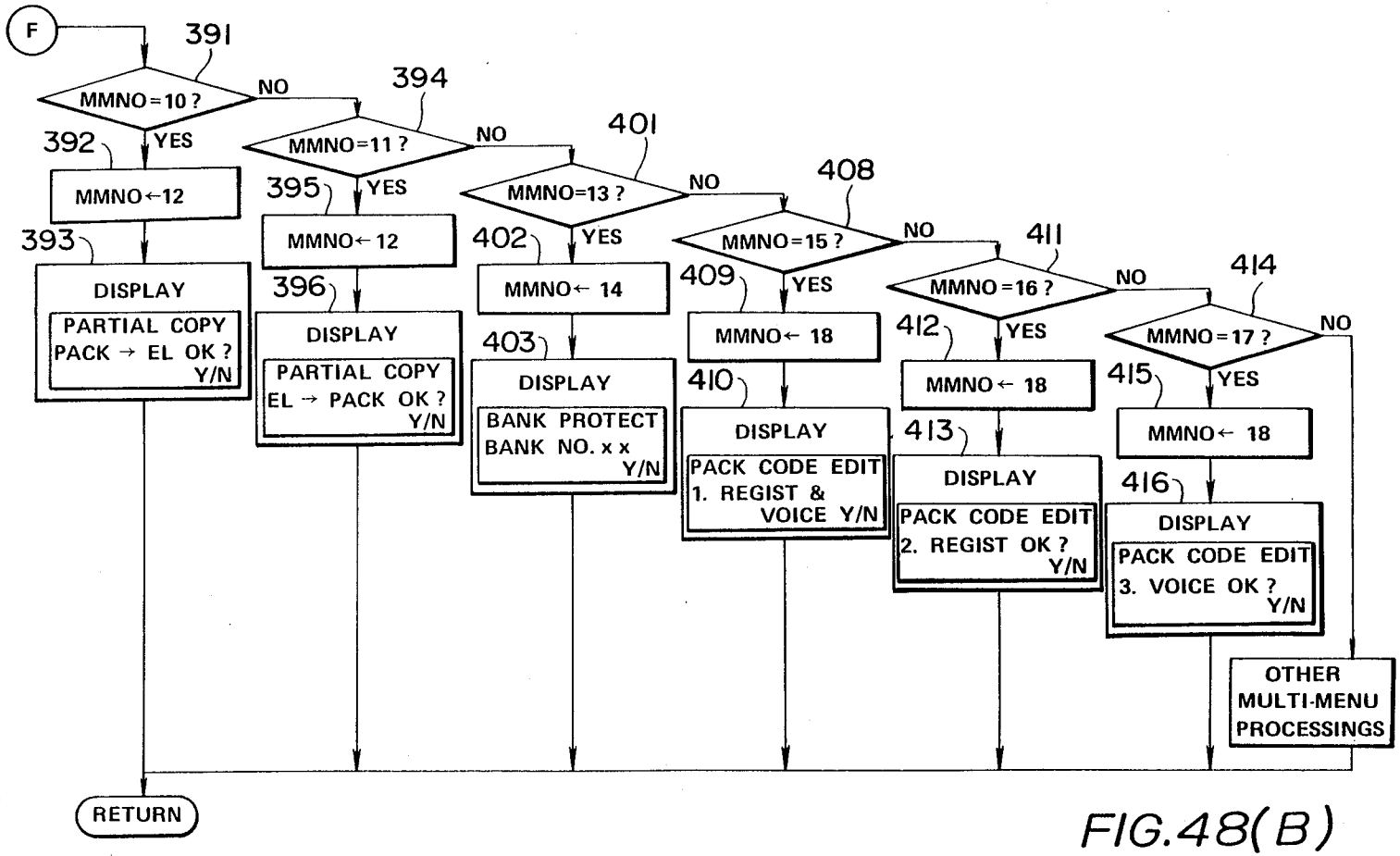
FIG. 48(B) is a continuation of the flow chart of FIG. 48(A)

When the enter switch ETR is depressed with MMNO being "2", the subroutine SBR38 of FIGS. 48(A) and 48(B) starts to be executed. Since the result of determination at step 380 (FIG. 48(A)) is "Yes", the processing proceeds to step 381 at which the contents of the register MMNO are rendered "4". The value "4" in the register MMNO corresponds to the function of "partial copy". At the next step 382, a message "PACK EDIT" is displayed on the display unit 137 at the upper portion, and another message "1. PARTIAL COPY" is displayed on the display unit 137 at the lower portion. The display thus made on the display unit 137 means that the parameter editing function of the "partial copy" has been selected. In this condition, the contents of the register MMNO can be sequentially changed to "4", "5" or "6" by operating the menu-up switch MUP or the menu-down switch MDW.

The value "5" in the register MMNO corresponds to the function of "bank protection". When this function is selected, a message "PACK EDIT" is displayed on the display unit 137 at the upper portion, and another message "BANK PROTECT" is displayed on the display unit 137 at the lower portion. One example of such display is shown in the block of step 227 of FIG. 44(A).

The value "6" in the register MMNO corresponds to the function of "writing of pack-code". When this function is selected, a message "PACK EDIT" is displayed on the display unit 137 at the upper portion, and another message "3. PACK CODE" is displayed on the display unit 137 at the lower portion. One example of such display is shown in the block of step 230 of FIG. 44(A).

As will be appreciated from the steps 225 to 227, the steps 228 to 230 and steps 231 to 233 of FIG. 44(A), each time the menu-up switch MUP is depressed, the data in the register MMNO is changed from "4" to "5", from "5" to "6", or from "6" to "4". Thus, any of the three functions can be selected. The processings performed at steps 225*a* 233*a* of FIG. 45(A) correspond to those performed at the steps 225 to 233 of FIG. 44(A), but the order of execution of the processings is different as shown. As will be appreciated from the processings at the steps 225*a*, 229*a*, 230*a*, 228*a*, 232*a*, 233*a*, 231*a*, 226*a* and 227*a*, each time the menu-down switch MDW is depressed, the data in the register MMNO is changed from "4" to "6", from "6" to "5" or from "5" to "4". Thus, any one of the three functions can be selected.

Partial Copy

Figure 54:
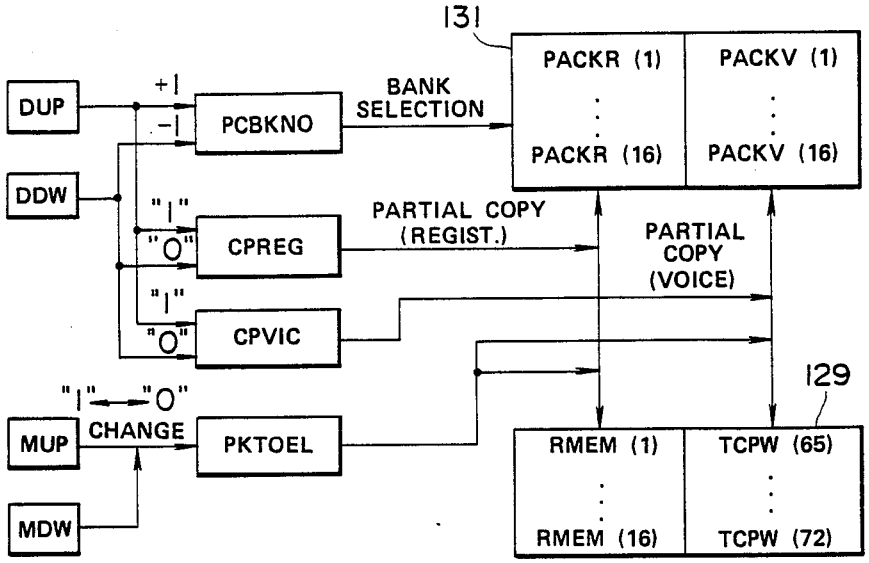
FIG. 54 is a diagrammatic illustration showing the flow of information when the partial copy is performed.

A processing for performing the partial copy is initiated when the enter switch ETR is depressed with the MMNO being "4". In this case, the result of determination at step 383 of FIG. 48(A) becomes "Yes", so that the processing proceeds to step 384 at which the data in the register MMNO is rendered "7" to bring the instrument $10_4$ into a mode for performing the partial copy. The flow of information in the external memory (PACKR(1) to PACK(16) and PACKV(1) to PACKV(16)), the internal memory (RMEM(1) to RMEM(16) and TCP W(65) to TCPW(72)), the registers and the switches in this mode is diagrammatically shown in FIG. 54.

When MMNO is "7", a processing for selecting the bank to be partially copied is performed. At step 385 of FIG. 48(A), the data in the partial copy bank-number register PCBKNO is set to the initial value of "1". At the next step 386, the bank number stored in the register PCBKNO is displayed on the display unit 137 at the lower portion, and a message "PARTIAL COPY" is displayed on the display unit 137 at the upper portion. One example of such display is shown in the block of the step 386.

When MMNO is "7", the value of PCBKNO can be changed by operating the data-up switch DUP and the data-down switch DDW. When the data-up switch DUP is depressed, the result of determination at step 303 of FIG. 46(A) becomes "Yes", so that the processing proceeds to step 304, at which the bank number in the register PCBKNO is incremented by one. The maximum value of the bank number is "16", so that if the result of the increment exceeds "16", the bank number is set to the minimum value of "1". At the next step 305, the bank number displayed on the display unit 137 at the lower portion is changed to the new bank number contained in the register PCBKNO. When the data-down switch DDW is depressed, processings similar to those performed at the steps 303 to 305 are carried out at steps 303*a* to 305*a* of FIG. 47(A). The step 304*a* is different from the step 304 in that the bank number in the register PCBKNO is decremented by one. In this case, the minimum value of the bank number is "1", so that if the result of the decrement is less than "1", the bank number is set to the maximum value of "16". Thus, the bank number with respect to which the partial copy is to be performed is selected and stored into the register PCBKNO.

When data in any one of the other registers exceeds its maximum value or its minimum value as a result of increment or decrement thereof in steps other than the steps 303 and 303*a*, the data is set to the minimum value or the maximum value in a manner described above for the steps 303 and 303*a*.

When the selection of the bank number is finished, the enter switch ETR is depressed to change MMNO to "8" (steps 387 and 388 of FIG. 48(A)). At the next step 389, the contents of the registers CPREG and CPVIC are both rendered "0". At the next step 390, an interrogatory message "PARTIAL COPY, 1. REGIST Y/N" is displayed on the display unit 137 to ask the player if the partial copy is to be performed or not (Y/N) with respect to the registration data.

If the answer is "Yes", then the player depresses the data-up switch DUP. On the other hand, if the answer is "No", the player depresses the data-down switch DDW.

When the data-up switch DUP is depressed with MMNO being "8", the partial copy of the registration data is selected. In this case, the result of determination at step 306 of FIG. 46(A) becomes "Yes", so that the processing proceeds to step 307, at which the data in the register CPREG for commanding the partial copy of the registration data is rendered "1". At the next step 308, the data contained in the register MMNO is rendered "9".

At the next step 309, an interrogatory message "PARTIAL COPY, 2. VOICE Y/N" is displayed on the display unit 137 to ask the player if the partial copy is to be performed with respect to the voice parameters. Then, the processing returns to the main routine.

When the data-up switch DUP is depressed with MMNO being "9", the partial copy of the voice parameters is selected. In this case, the result of determination at step 310 of FIG. 46(A) becomes "Yes", so that the processing proceeds to step 311, at which the data contained in the register CPVIC for commanding the partial copy of the voice parameters is rendered "1". At the next step 312, MMNO is rendered "10", and then the data in the copy direction register PKTOEL is set to "1" at step 313. At the next step 314, a message indicating that data are transferred from the external memory to the internal memory for performing the partial copy is displayed on the display unit 137.

Figure 47:
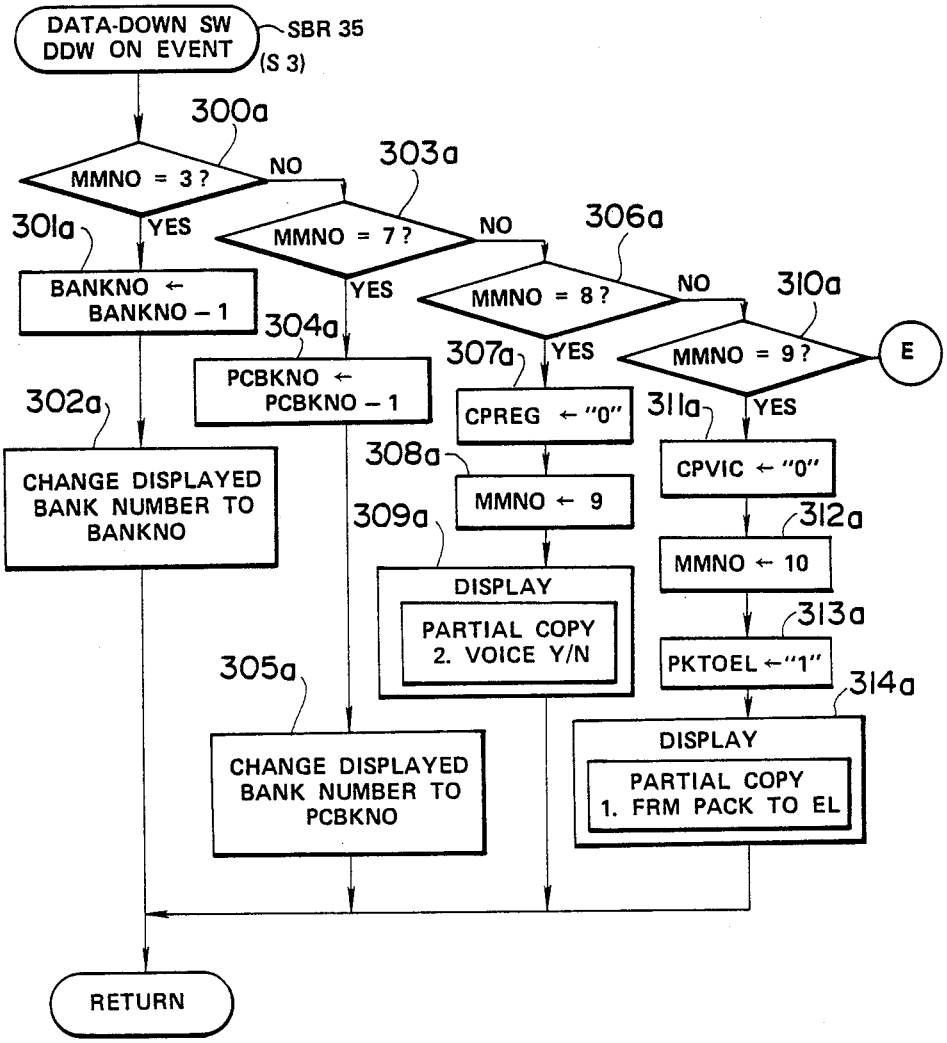
FIG. 47(A) is a flow chart of the subroutine SBR35 executed by the CPU 127 of FIG. 34.
FIG. 47(B) is a continuation of the flow chart of FIG. 47(A)

When the data-down switch DDW is depressed with MMNO being "8" or "9", processings similar to those performed at the steps 306 to 314 of FIG. 46(A) are carried out at steps 306*a* to 314*a* of FIG. 47(A). In this case, at the steps 307*a* and 311*a*, CPREG and CPVIC are both set to "0" to prevent the partial copy from being performed.

The direction of transfer of data in the partial copy can be changed by depressing the menu-up and menu-down switches MUP and MDW during the time when MMNO is "10" or "11". By the processings performed at steps 234 to 241 of FIG. 44(B), the copy direction is changed each time the menu-up switch MUP is depressed. The copy direction can also be changed by the similar processings shown in FIG. 45(B) each time the menu-down switch MDW is depressed. When MMNO is rendered "11", the data contained in the register PKTOEL is rendered "0", and a message indicating that data are transferred from the internal memory to the external memory to perform the partial copy is displayed on the display unit 137 (steps 235 to 237 of FIG. 44(B)).

When the enter switch ETR is depressed with MMNO being "10" or "11", MMNO is changed to "12". In this case, a message for confirming the copy direction is displayed on the display unit 137 (steps 391 to 396 of FIG. 48(B)). If the copy direction displayed on the display unit 137 need not be changed, the player depresses the data-up switch DUP, while if the copy direction should be changed, the player depresses the data-down switch DDW.

When the data-up switch DUP is depressed with MMNO being "12", the result of determination at step 315 of FIG. 46(B) becomes "Yes", so that the processing proceeds to step 316 at which it is determined whether the data contained in the register PKTOEL is "1". If the result of this determination is "Yes", then the processing proceeds to step 317 to transfer data from the external memory to the internal memory for performing the partial copy. More specifically, at this step 317, it is determined whether CPREG is "1". If the result of this determination is "Yes", the processing proceeds to step 318 at which it is further determined whether the pack code in the register PKCODE is "1" (registration data only) or "3" (both of the registration data and the voice parameters). When CPREG is "1", the partial copy of the registration data is requested, so that it is determined at the step 318 whether the registration data are present in the external memory. If the result of the determination at the step 318 is "Yes", the processing proceeds to step 319, at which the registration data are read from that bank PACKR(PCBKNO) of the external memory which corresponds to the bank number in the register PCBKNO, and stored into the registration data memories RMEM(1) to RMEM(16) of the RAM 129.

At the next step 320, it is determined whether CPVIC is "1". If the result of this determination is "Yes", the processing proceeds to step 321 at which it is further determined whether the pack code stored in the register PKCODE is "2" (the voice parameters only) or "3" (both of the registration data and the voice parameters). CPVIC in the state of "1" indicates that the partial copy of the voice parameters is requested, so that it is determined at the step 321 whether the voice parameters are present in the external memory. If the result of the determination at the step 321 is "Yes", the processing proceeds to step 322 at which the voice parameters stored in that bank PACKV(PCBKNO) of the external memory which corresponds to the bank number contained in the register PCBKNO are read and stored into the voice parameter memories TCPW(65) to TCPW(72) of the RAM 129.

At the next step 323, a message indicating that the partial copy has been finished is displayed on the display unit 137.

When data are transferred from the internal memory to the external memory to perform the partial copy, the result of the determination at the step 316 of FIG. 46(B) becomes "No", so that the processing proceeds to step 324. At this step 324, it is determined whether the bank of the external memory, with respect to which the partial copy is to be performed, is protected from alteration. More specifically, the bank-protect data corresponding to the bank number stored in the register PCBKNO is read from the bank-protect memories BKPRO(1) to BKPRO(16), and it is determined whether the read bank-protect data is "0", that is, whether the bank is not protected. If the result of the determination at this step 324 is "Yes", processing similar to those performed at the steps 317 to 322 are carried out at steps 317*a* to 322*a*. Then, the processing proceeds to step 323. At the steps 319*a* and 322*a*, data are transferred in a direction opposite to that at the steps 319 and 322. More specifically, at the step 319*a*, the sixteen sets of registration data RMEM(1) to RMEM(16) are read from the registration data memory bank of the internal memory 129, and stored into the registration data bank PACKR(PCBKNO) of the external memory designated by PCBKNO. At the step 322*a*, the eight sets of voice parameters TCPW(65) to TCPW(72) are read from the voice parameter memory bank of the internal memory, and stored into the voice parameter bank PACKV(PCBKNO) of the external memory designated by PCBKNO.

Figure 47B:
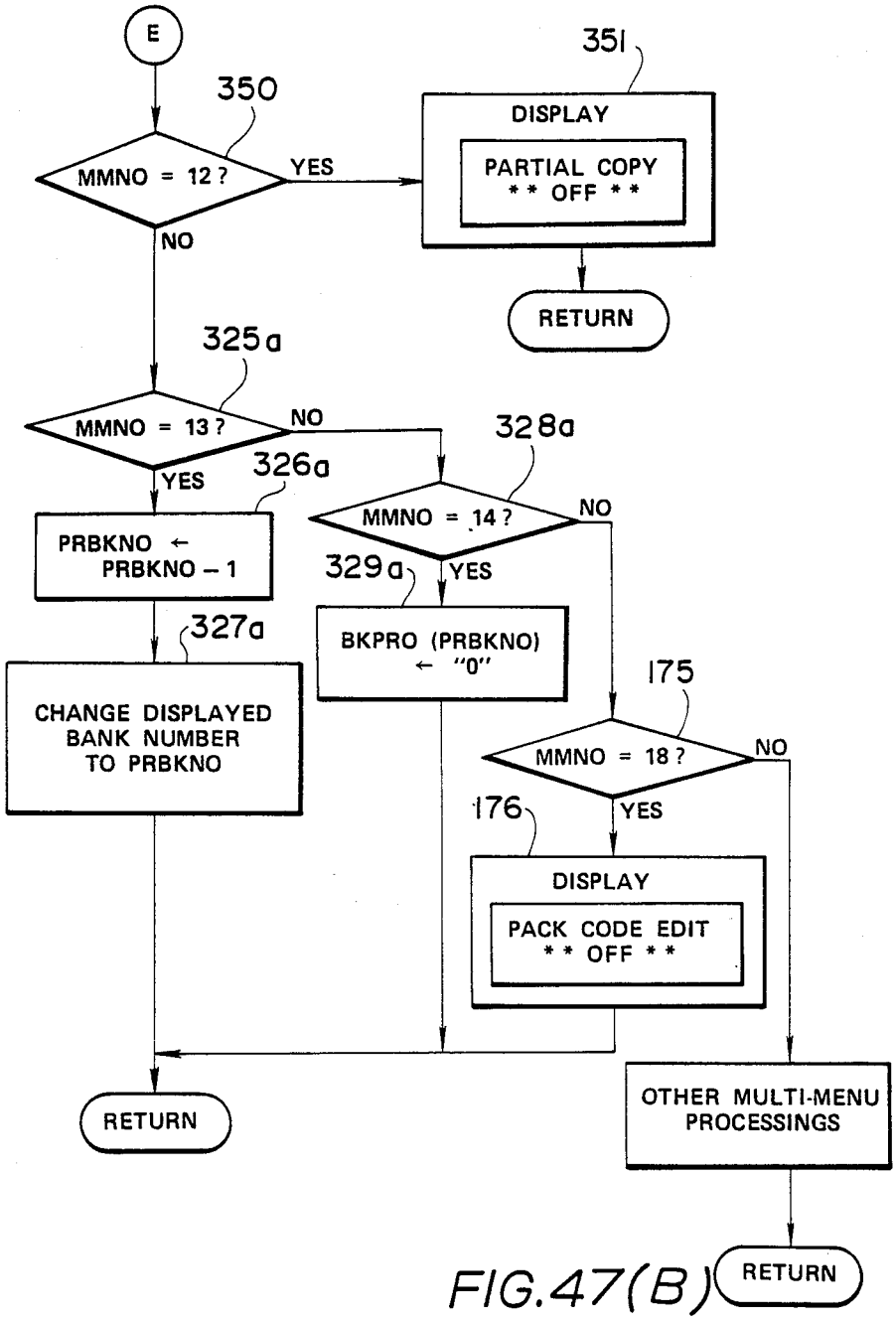

When the data-down switch DDW is depressed with MMNO being "12", the result of determination at step 350 of FIG. 47(B) becomes "Yes", so that the processing proceeds to step 351. At this step 351, a message indicating that the partial copy is not performed is displayed on the display unit 137.

Bank Protect

Figure 55:
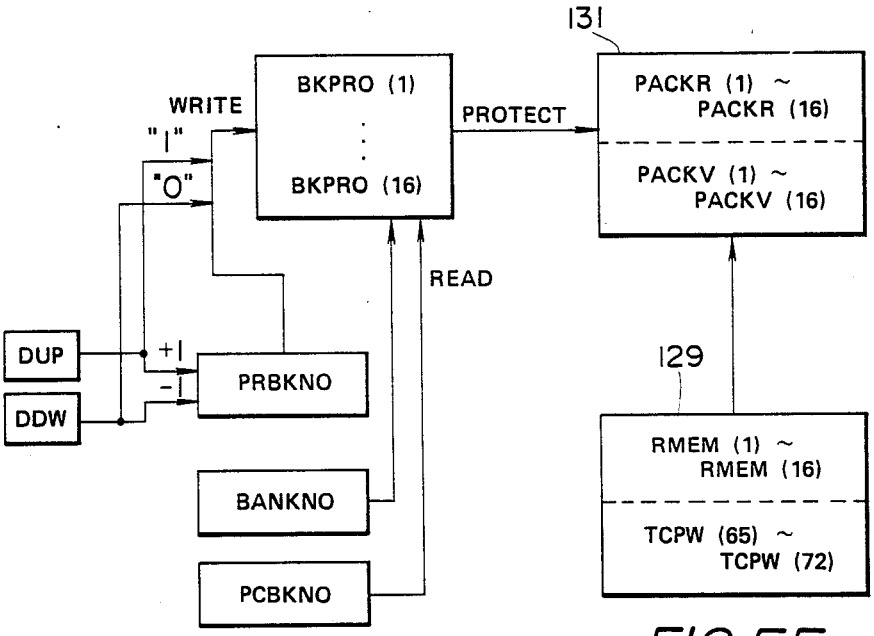
FIG. 55 is a diagrammatic illustration showing the flow of information when the bank protecting processing is performed.

When the enter switch ETR is depressed with MMNO being "5", it is confirmed that a processing for the bank protection must be performed. In this case, the result of determination at step 397 of FIG. 48(A) becomes "Yes", so that the processing proceeds to step 398. At this step 398, the data in the register MMNO is set to "13" whereupon a processing for the bank protection is started. The flow of information in this bank protection processing is diagrammatically shown in FIG. 55.

A processing for selecting the number of the bank which must be protected is performed during the time when MMNO is "13". At step 399 of FIG. 48(A), the data in the protection bank-number register PRBKNO is set to the initial value of "1". At the next step 400, the bank number stored in the register PRBKNO is displayed on the display unit 137. One example of such display is shown in the block of the step 400, wherein "BANK PROTECT" is displayed at the upper portion, and the bank number is displayed at the lower portion.

When MMNO is "13", the value of PRBKNO can be changed by operating the data-up and data-down switches DUP and DDW. When the data-up switch DUP is depressed, the result of determination at step 325 of FIG. 46(C) becomes "Yes", so that processings of steps 326 and 327 are sequentially performed. These processings are similar to those of the steps 304 and 305 of FIG. 46(A), and cause the bank number in the register PRBKNO to be incremented by one and displayed on the display unit 137. On the other hand, when the data-down switch DDW is depressed, processings similar to those performed at the steps 325 to 327 of FIG. 46(C) are carried out at steps 325*a* to 327*a* of FIG. 47(B). In this case, however, the bank number in the register PRBKNO is decremented by one at the step 326*a*.

When the selection of the bank number is completed, the enter switch ETR is depressed to change MMNO to "14" (steps 401 and 402 of FIG. 48(B)). At the next step 403, the number of the bank to be protected (i.e., the bank number stored in the register PRBKNO) is displayed on the display unit 137 to ask the player if the bank protection is to be performed.

Figure 40:
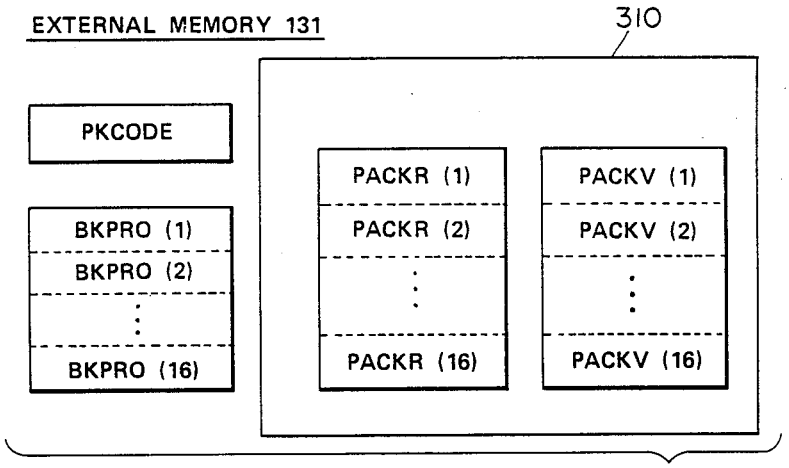
FIG. 40 is an illustration showing the arrangement of the external memory 131 for the electronic musical instrument $10_4$ of FIG. 34.
Figure 41:
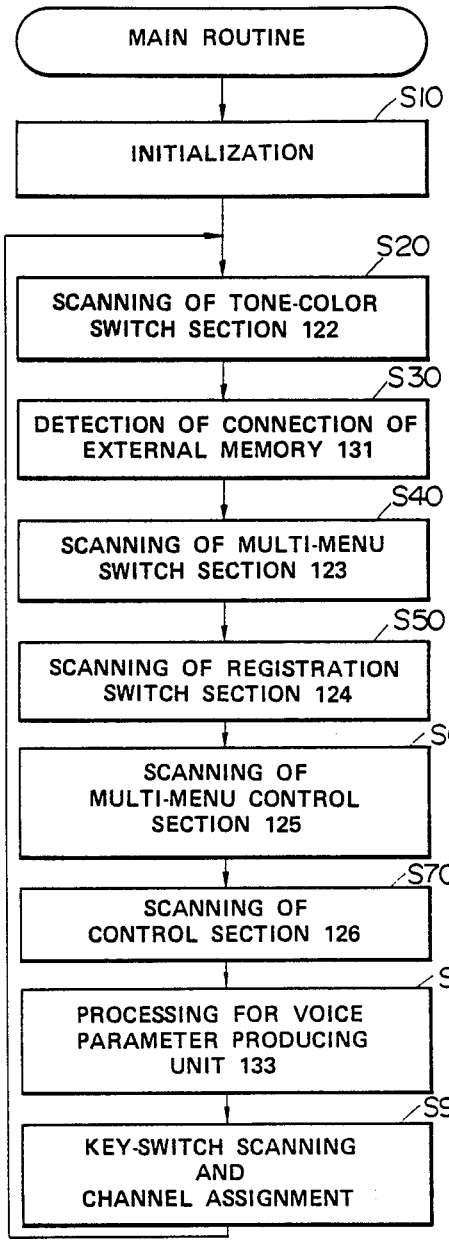
FIG. 41 is a flow chart of the main routine executed by the CPU 127 of the electronic musical instrument $10_4$ of FIG. 34.

When the data-up switch DUP is depressed with MMNO being "14", the bank protection is selectively performed with respect to the bank designated by the bank number stored in the register PRBKNO. In this case, the result of determination at step 328 of FIG. 46(C) becomes "Yes", so that the processing proceeds to step 329, at which "1" is stored in one of the bank-protection memories BKPRO(1) to BKPRO(16) of the external memory 131 (FIG. 40) which is designated by the bank number in the register PRBKNO, i.e., the bank-protection memory BKPRO(PRBKNO). Thus, data indicating that the bank protection is to be performed with respect to the bank designated by the bank number is stored in the external memory. On the other hand, when the data-down switch DDW is depressed, the data in the designated bank-protection memory BKPRO(PRBKNO) of the external memory is reset to "0" by the processings performed at steps 328*a* and 329*a* of FIG. 47(B). Thus, the designated bank is released from the protection.

When a transfer of data to the protected bank is attempted to perform a full copy or the partial copy, the result of the determination at the step 324 of FIG. 46(B) becomes "No" in the case of the partial copy to prevent the writing of data from being performed. In the case of the full copy, the result of the determination at the step 449 of FIG. 51(B) becomes "No" to prevent the writing of data from being performed. If the result of the determination at the step 324 of FIG. 46(B) is "No", the processing proceeds to step 330 of FIG. 46(B). At this step 330, a message "PARTIAL COPY" indicating the partial copy, a message "BANK X" indicating the selected bank number and a message "PROTECT" indicating that the bank is protected are displayed on the display unit 137. If the result of the determination at the step 449 of FIG. 51(B) is "No", the processing proceeds to step 450. At this step 450, a message "FROM EL TO PACK" indicating that the copy is performed by transferring data from the electronic musical instrument $10_4$ to the external memory, a message "BANK X" indicating the bank number and a message "PROTECT" indicating that the bank is protected are displayed on the display unit 137.

Storing of Pack Code

When the enter switch ETR is depressed with MMNO being "6", it is confirmed that a processing for storing the pack code is to be performed. In this case, the result of determination at step 404 of FIG. 48(A) becomes "Yes", so that the processing proceeds to step 405 at which the data in the register MMNO is set to "15". Thus, the processing for storing the pack code is started.

At the next step 406, the data in the pack-code buffer PKCBF of RAM 129 is set to the initial value of "3". The pack code of "3" indicates that both of the registration data and the voice parameters are stored in the external memory 131. Alternatively, the pack code presently stored in PKCODE of the external memory 131 may be stored into the pack-code buffer PKCBF as the initial value.

At the next step 407, a message "PACK CODE EDIT" is displayed on the display unit 137 at the upper portion, and an identification information corresponding to the pack code stored in the buffer PKCBF, e.g., a message "REGIST & VOICE" in the case of the pack code being "3", is displayed on the display unit 137 at the lower portion. In this condition, the player can change the pack code in the buffer PKCBF by operating the menu-up switch MUP and the menu-down switch MDW.

As will be appreciated from the processings performed at steps 242 to 245, steps 246 to 249 and steps 250 to 253 of FIG. 44(B), each time the menu-up switch MUP is depressed, the data contained in the register MMNO is changed from "15" to "16", from "16" to "17", or from "17" to "15". As the data in the register MMNO is so changed, the pack code in the buffer PKCBF is changed from "3" (both of the registration data and the voice parameters) to "1" (the registration data only), from "1" to "2" (the voice parameters only) or from "2" to "3". Thus, any of the pack codes can be selected. Then, identification information corresponding to the selected pack code is displayed on the display unit 137 (the step 245, 249 or 253 of FIG. 44(B)).

When the menu-down switch MDW is depressed, processings of steps 242*a*, 247*a* to 249*a*, 246*a*, 251*a* to 253*a*, 250*a* and 243*a* to 245*a* of FIG. 45(B) are performed. In this case, each time the menu-down switch MDW is depressed, the data in the register MMNO is changed from "15" to "17", from "17" to "16", or from "16" to "15" (see steps 242*a* to 245*a* of FIG. 45(B)). As the data in the register MMNO is so changed, the pack code in the buffer PKCBF is changed from "3" to "2", from "2" to "1" or from "1" to "3". Thus, any of the pack codes can be selected.

When it is desired to store the pack code contained in the buffer PKCBF of the RAM 129 into the pack-code memory PKCODE of the external memory 131, the enter switch ETR is depressed. When the enter switch ETR is depressed with MMNO being any one of "15", "16" and "17", the data in the register MMNO is changed to "18" (steps 409, 412 and 415 of FIG. 48(B)). At the same time, a message corresponding to the pack code stored in the buffer PKCBF is displayed on the display unit 137 to ask the player if the desired pack code has been selected (steps 410, 413 and 416 of FIG. 48(B)). If the displayed message corresponds to the desired pack code, the player depresses the data-up switch DUP. In this case, the result of determination at step 331 of FIG. 46(C) becomes "Yes" (MMNO="18"), so that the processing proceeds to step 332 at which the pack code in the buffer PKCBF is stored into the pack-code memory PKCODE of the external memory. At the next step 333, a message indicating the end of the storing of the pack code is displayed on the display unit 137.

Figure 49:
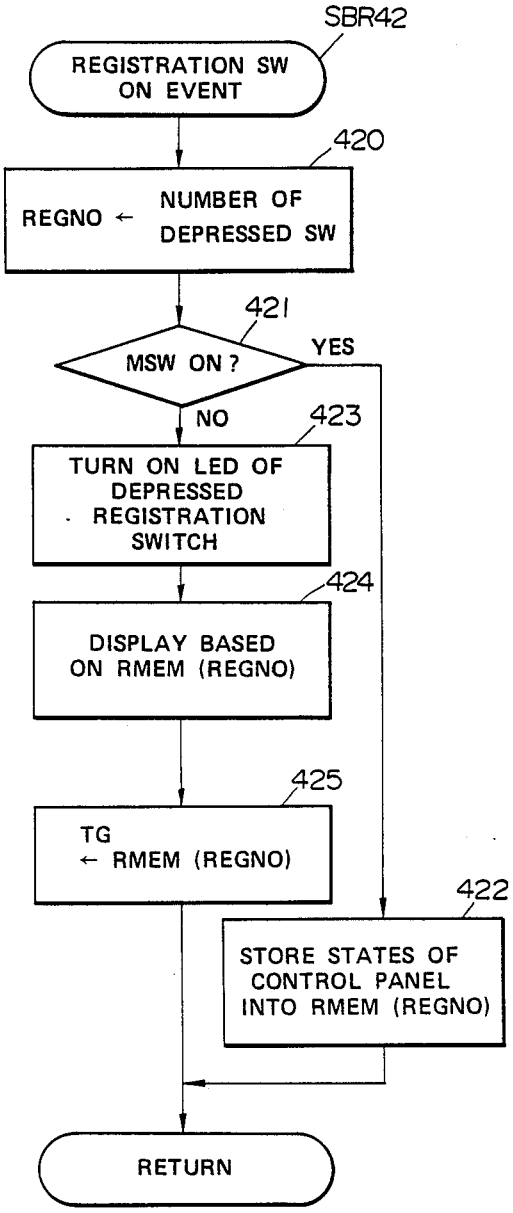
FIG. 49 is a flow chart of the subroutine SBR42 executed by the CPU 127 of FIG. 34.

The subroutine SBR42 for processing an ON event of each of the registration switches REGSW1 to REGSW16 will now be described with reference to FIG. 49.

When one of the switches REGSW1 to REGSW16 is depressed, the number of the depressed registration switch REGSW is stored into the register REGNO (step 420). At the next step 421, it is determined whether the memory switch MSW is in the depressed state. If the result of this determination is "Yes", the processing proceeds to step 422, at which a set of registration data is stored into RMEM(REGNO). On the other hand, if the result of the determination is "No", the processing proceeds to steps 423 and 424 to read a set of registration data from RMEM(REGNO). At the step 422, the states of predetermined switches and control means of the control panel 121 for setting the registration data are stored into RMEM(REGNO) of the RAM 129 as the set of registration data.

At the step 423, the LED indicator corresponding to the depressed registration switch REGSW is turned on. At the next step 424, the registration data contained in RMEM(REGNO) designated by the switch number in the register REGNO is read from the RAM 129, and a display is made on the display unit 137 based on the read registration data to inform the player of the contents of the registration data. Then, the parameters corresponding to the registration data read from RMEM(REGNO) are supplied to the musical tone generating circuit 134, at the step 425. Thus, the characteristic of the musical tone is controlled in accordance with the registration data selected by the registration switch REGSW.

A fifth embodiment of the present invention will now be described.

Figure 56:
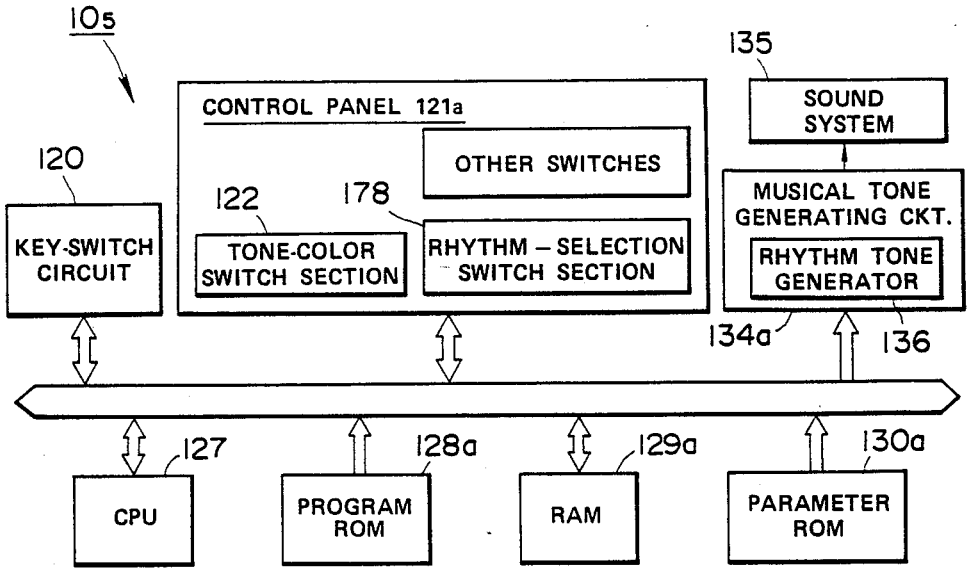
FIG. 56 is a block diagram of an electronic musical instrument $10_5$ incorporating a parameter setting system provided in accordance with a fifth embodiment of the invention.

FIG. 56 shows an electronic musical instrument $10_5$ incorporating a parameter setting system provided in accordance with the fifth embodiment of the invention. This embodiment is so designed that rhythm selection switches are used in place of the aforesaid multi-menu switch section 123 to select a tone color to be assigned to each white switch, and differs from the fourth embodiment only in the following respects.

Figure 57:
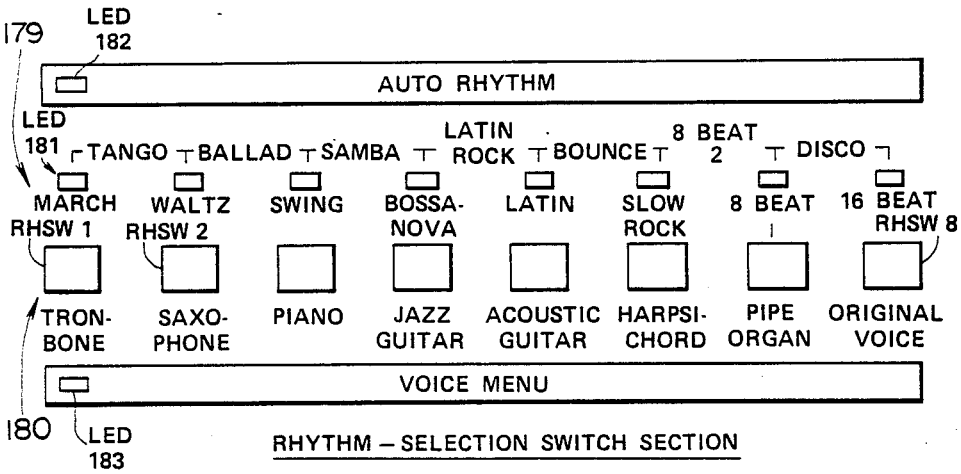
FIG. 57 is an illustration showing the arrangement of the rhythm-selection switch section 122 of the control panel 121*a* of the electronic musical instrument $10_5$ of FIG. 56.

A control panel 121*a* of this electronic musical instrument $10_5$ comprises a rhythm-selection switch section 178 which includes, as shown in FIG. 57, eight rhythm selection switches RHSW1 to RHSW8. Names of rhythms assigned respectively to the switches RHSW1 to RHSW8 are put in line on the surface of the control panel 121*a* above the switches RHSW1 to RHSW8, respectively, as shown at 179. A LED indicator 181 is provided adjacent to each of the rhythm names put on the surface of the panel. Names of tone colors assignable to the white switches by the switches RHSW1 to RHSW8 are put in line on the surface of the control panel 121*a* under the switches RHSW1 to RHSW8, respectively, as shown at 180. Thus, each of the rhythm selection switches RHSW1 to RHSW8 has two functions, namely, the function of selecting a rhythm and the function of selecting a tone color to be assigned to the white switch. When the rhythm selection switches RHSW1 to RHSW8 are given the rhythm selecting function (this mode will be hereinafter referred to as a "rhythm selection mode"), a LED indicator 182, to which a label indicating "AUTO RHYTHM" is attached, is lit. If any of the rhythm selection switches RHSW1 to RHSW8 is depressed in this mode, the rhythm corresponding to the depressed switch is selected, and one of the LED indicators 181 corresponding to the depressed switch is lit. On the other hand, when the rhythm selection switch RHSW1 to RHSW8 are given the tone-color selecting function (this mode will be hereinafter referred to as a "voice menu mode"), a LED indicator 183, to which a label indicating "VOICE MENU" is attached, is lit. If any of the rhythm selection switches RHSW1 to RHSW8 is depressed in this mode, the tone color designated by the tone-color name corresponding to the depressed switch is selected, and one of the LED indicators 181 corresponding to the depressed switch is lit.

Usually, the LED indicator 182 is lit, and the rhythm-selection switch section 178 operates in the rhythm selection mode. If any of the white switches TCSW7 and TCSW8 of the tone-color switch section 122 is depressed in this mode, the LED indicator 183 comes on while the LED indicator 182 goes out, and the rhythm-selection switch section 178 is brought into the voice menu mode. If the player depresses a desired one of the rhythm selection switches RHSW1 to RHSW8, the tone color corresponding to the depressed rhythm selection switch is assigned to the depressed one of the white switches TCSW7 and TCSW8.

The operation of the instrument $10_5$ performed when such an assignment of tone color is effected will now be more fully described.

Figure 58:
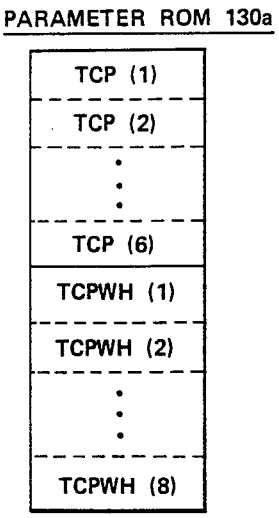
FIG. 58 is a memory map of the parameter ROM 130*a* of the electronic musical instrument $10_5$ of FIG. 56.

As shown in FIG. 58, the parameter ROM 130*a* stores tone-color parameters TCP(1) to TCP(6) corresponding respectively to the tone-color switches TCSW1 to TCSW6 of the tone-color switch section 122, and eight kinds of tone-color parameters TCPWH(1) to TCPWH(8) corresponding respectively to the rhythm selection switches RHSW1 to RHSW8.

Figure 59:
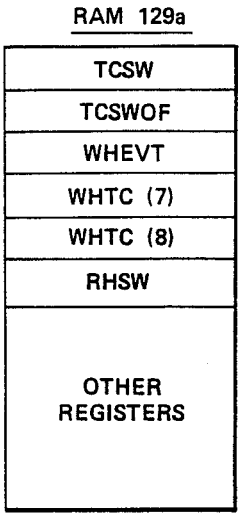
FIG. 59 is a memory map of the parameter ROM 129*a* of the electronic musical instrument $10_5$ of FIG. 56.

The RAM 129*a* provides, as shown in FIG. 59, a register TCSW for storing the number of the depressed one of the tone-color switches TCSW1 to TCSW8 detected in accordance with the scanning of these switches. A register TCSWOF provided in the RAM 129*a* stores the number of that tone-color switch whose change of state from ON to OFF has been detected in accordance with the above scanning.

A white switch event register WHEVT stores data of "1", when any of the white switches TCSW7 and TCSW8 is depressed, to indicate that the instrument $10_5$ is in the voice menu mode, wherein a desired one of the tone colors can be assigned to the depressed white switch.

Registers WHTC(7) and WHTC(8) store codes representative of the tone colors currently assigned respectively to the white switches TCSW7 and TCSW8.

A register RHSW stores the number of the depressed one of the rhythm selection switches RHSW1 to RHSW8.

Figure 60:
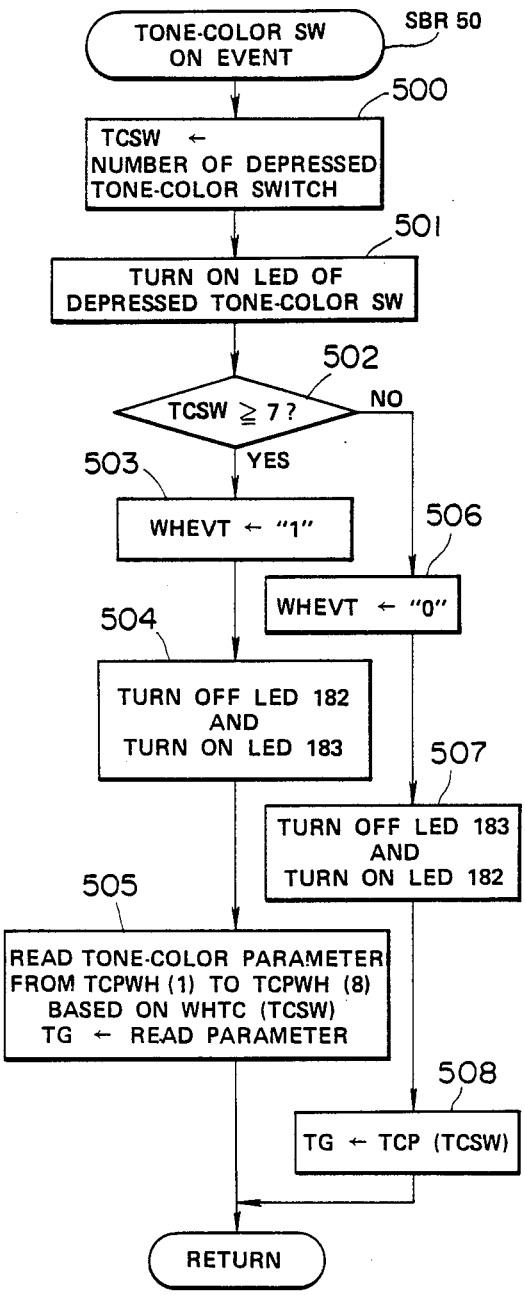
FIG. 60 is a flow chart of the subroutine SBR50 executed by the CPU 127 of the electronic musical instrument $10_5$ of FIG. 56.
Figure 61:
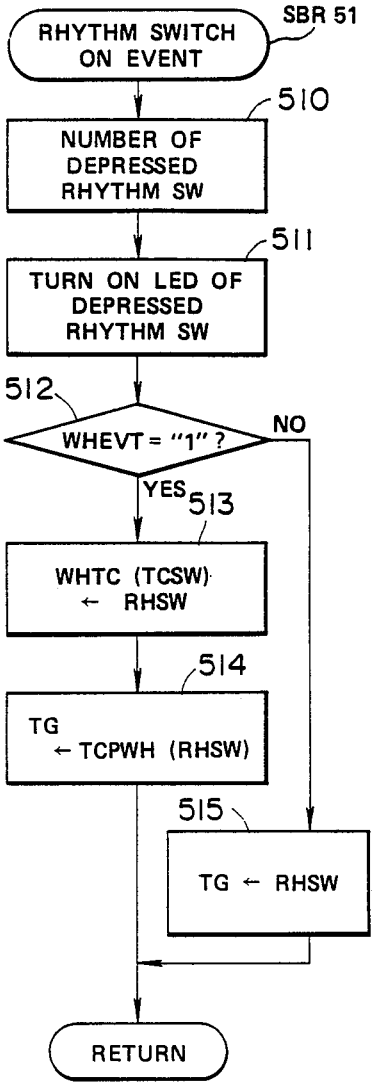
FIG. 61 is a flow chart of the subroutine SBR51 executed by the CPU 127 of FIG. 56.
Figure 62:
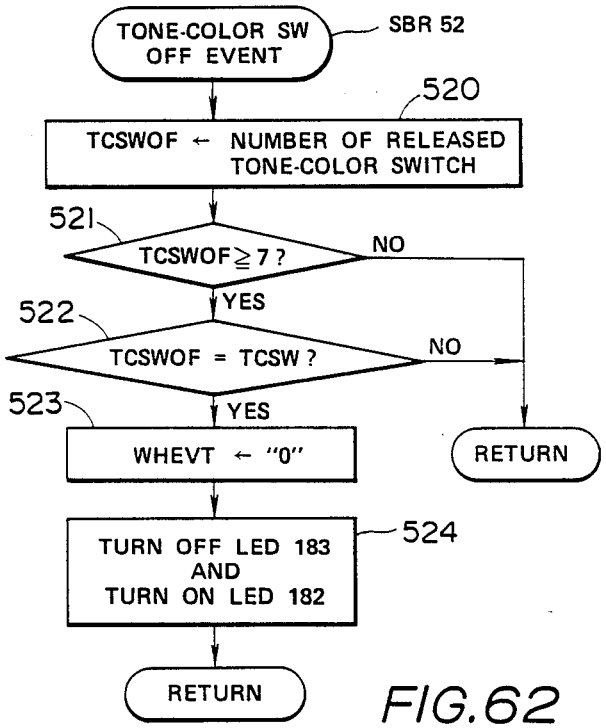
FIG. 62 is a flow chart of the subroutine SBR52 executed by the CPU 127 of FIG. 56.

The CPU 127 performs the scanning of the switches of the control panel 121*a* and other processings in accordance with the programs stored in the program ROM 128*a*. When a depression (or an ON event) of any one of the tone-color switches TCSW1 to TCSW8 is detected, a tone-color switch ON-event subroutine SBR50 shown in FIG. 60 is executed. When an ON event of any one of the rhythm selection switches RHSW1 to RHSW8 is detected, a rhythm switch ON-event subroutine SBR51 shown in FIG. 61 is executed. On the other hand, when an OFF event of any one of the tone-color switches TCSW1 to TCSW8 is detected, a tone-color OFF-event subroutine SBR52 shown in FIG. 62 is executed.

In FIG. 60, when one of the tone-color switches TCSW1 to TCSW8 is depressed, the number of the depressed tone-color switch is stored into the register TCSW (step 500), and then the LED indicator corresponding to the depressed tone-color switch is tuned on (step 501). At the next step 502, it is determined whether the depressed tone-color switch is the white switch. If it is determined that the white switch has been depressed, the data in the register WEVT is set to "1" (step 503). Then, the LED indicator 182 (AUTO RHYTHM) of the rhythm selection switch section 178 is turned off, while the LED indicator 183 (VOICE MENU) is turned on (step 504). At the next step 505, the code of the tone color currently assigned to the depressed white switch is read from the register WHTC(7) or WHTC(8), i.e., the register WHTC(TCSW), and the tone-color parameter (one of the tone-color parameters TCPWH(1) to TCPWH(8)) corresponding to the read tone-color code is read from the parameter ROM 130*a*. The tone-color parameter thus read from the ROM 130*a* is supplied to the musical tone generating circuit 134*a*.

If the depressed tone-color switch is not the white switch, the data in the register WHEVT is reset to "0" (step 506). Then, the LED indicator 183 (VOICE MENU) is turned off, while the LED indicator 182 (AUTO RHYTHM) is turned on (step 507). At the next step 508, the tone-color parameter TCP(TCSW) corresponding to the depressed tone-color switch is read from the parameter ROM 130*a* and supplied to the musical tone generating circuit 134*a*.

In FIG. 61, when one of the rhythm selection switches RHSW1 to RHSW8 is depressed, the number of the depressed rhythm selection switch is stored into the register RHSW (step 510), and then the LED indicator 181 corresponding to the depressed rhythm selection switch is turned on (step 511). At the next step 512, it is determined whether the data in the register WHEVT is "1". If the result of this determination is "Yes", the number stored in the register RHSW, that is, the code representative of one of the eight kinds of tone colors, is stored into the register WHTC(TCSW) corresponding to the depressed white switch (step 513). Then, the tone-color parameter TCPW(RHSW) corresponding to the stored tone-color code, that is, the one of TCPWH(1) to TCPWH(8), is read from the parameter ROM 130*a* and supplied to the musical tone generating circuit 134 (step 514).

If WHEVT is "0", the processing proceeds from the step 512 to step 515, at which the data stored in the register RHSW, that is, the rhythm code, is supplied to a rhythm tone generator 136 provided in the musical tone generating circuit 134*a*. In the rhythm selection mode, rhythms other than those corresponding respectively to the rhythm selection switches RHSW1 to RHSW8 can also be selected by simultaneously depressing adjoining two of the rhythm selections switches RHSW1 to RHSW8. However, a subroutine for performing such a selection of rhythms will not be described here.

In FIG. 62, when a tone-color switch of the tone-color switch section 122 is released, the number of the released tone-color switch is stored into the register TCSWOF (step 520). Then, it is determined whether the released switch is the white switch (step 521). If the released switch is the white switch, it is further determined at step 522 whether the released white switch is the same as the last depressed tone-color switch, that is, whether the data in the register TCSWOF is identical in value to the data in the register TCSW. In the case where more than two tone-color switches have been depressed, the white switch just released may not be the last depressed tone-color switch. In such case, the result of the determination at the step 522 becomes "No", so that the the processing is returned to the main routine. If the white switch just released is the last depressed tone-color switch, that is to say, if the instrument $\mathbf{10}_5$ has been in the voice menu mode due to the last depression of the white switch just released, the processing proceeds to step 523. At this step 523, the data in the register WHEVT is reset to "0". Then, at the next step 524, the LED indicator 183 of the rhythm selection switch section 178 is turned off, and instead of this the LED indicator 182 is turned on in a manner described above for the step 507 of FIG. 60.

As will be appreciated from the foregoing, with the arrangement of this fifth embodiment, the white switches can be assigned desired tone colors. When the white switch is depressed, the parameters assigned to the depressed white switch is supplied to the musical tone generating circuit 134*a*, and the instrument $\mathbf{10}_5$ is automatically brought into a mode wherein the tone color assigned to the depressed white switch can be changed.

With the arrangement of each of the fourth and fifth embodiments, only two white switches are provided. It will be evident that more than two white switches may be provided. The embodiment comprises only one the tone-color switch section, but a plurality of tone color switch sections may be provided for a plurality of groups of musical tones, respectively. In such a case, the parameters to be assigned to the white switches may be stored in a common memory.

With the arrangement of the fourth embodiment, the white switches are assigned the voice parameters inputted from the external memory or those produced by the player. Such an arrangement is not essential, but the white switches may be assigned only parameters previously stored in the ROM or the RAM.

With the arrangement of the above embodiment, the code of tone color assigned to the white switch is stored in the register corresponding to the white switch, and the voice parameter is read from the memory based on the tone-color code stored in the register. However, the embodiment may be modified so that the voice parameter per se is stored in the register.

With the fifth embodiment, the tone color to be assigned to the white switch is selected by operating the rhythm selection switches. However, other switches on the control panel may be used to select the tone color to be assigned to the white switch.

What is claimed is:

1. A parameter setting system for an electronic musical instrument having tone generating means for generating a musical tone of a selectable characteristic, wherein selection of a selectable characteristic causes the selectable characteristic to be imparted to the musical tone, comprising:

first memory means for storing a parameter of certain value for controlling a first characteristic of the musical tone which corresponds to the selectable characteristic;

parameter value changing means, automatically responsive to the selection of the selectable characteristic, having a manually operable member for causing said parameter in said first memory means to change in value in accordance with an operation of said member;

reading means for reading said parameter from said first memory means; and tone control means responsive to said read parameter for cooperating with the tone generating means to control said first characteristic of the musical tone.

2. A parameter setting system according to claim 1 further comprising:

second memory means for storing a predetemrined parameter for determining the first characteristic of the musical tone; and copying means for storing said predetermined parameter contained in said second memory means into said first memory means as said parameter.

3. A parameter setting system according to claim 1, wherein said parameter changing means further comprises display means for displaying the parameter stored in the first memory means.

4. A parameter setting system according to claim 1, wherein said manually operable member comprises a pair of switches, and wherein said parameter changing means further comprises:

increasing means responsive to an actuation of one of said pair of switches for increasing the value of said parameter in said first memory means; and decreasing means responsive to an actuation of the other of said pair of switches for decreasing the value of said parameter in said first memory means.

5. A parameter setting system according to claim 1, wherein said parameter stored in said first memory means comprises a plurality of parameter elements, and wherein said parameter setting system further comprises element selection means for selecting a desired one of said plurality of parameter elements to output an element selection signal indicative of the selected parameter element, said parameter changing means being responsive to said element selection signal for changing said selected parameter element of said parameter in said first memory means.

6. A parameter setting system according to claim 5, wherein said parameter changing means further comprises display means for displaying the selected parameter element to be changed.

7. A parameter setting system according to claim 1, wherein said first memory means stores a plurality of parameters each for determining the first characteristic of the musical tone, and wherein said parameter setting system further comprises parameter selection means for selecting a desired one of said plurality of parameters to output a parameter selection signal representative of the selected parameter, said parameter changing means bring responsive to said parameter selection signal for causing the selected parameter in said first memory means to change in value in accordance with the operation of said member, said reading means being responsive to said parameter selection signal for reading the selected parameter from said first memory means.

8. A parameter setting system according to claim 7, wherein said selectable characteristic is tone color and wherein said parameter selection means comprises tone-color selection means for selecting a desired one of a plurality of tone colors to be given to the musical tone, said plurality of tone colors corresponding respectively to said plurality of parameters, said tone-color selection means outputting a tone-color selection signal indicative of the selected tone color as said parameter selection signal.

9. A parameter setting system according to claim 1 further comprising:

second memory means;

first switch means for outputting a first operation signal when manually operated;

first transfer means responsive to said first operation signal for transferring said parameter stored in said first memory means to said second memory means;

second switch means for outputting a second operation signal when manually operated; and second transfer means responsive to said second operation signal for transferring said parameter contained in said second memory means to said first memory means.

10. A parameter setting system according to claim 9 further comprising:

third memory means for storing a predetermined parameter for determining the first characteristic of the musical tone; and copying means for storing said predetermined parameter contained in said third memory means into said first memory means as said parameter.

11. A parameter setting system according to claim 9, wherein said parameter changing means further comprises display means for displaying the parameter stored in the first memory means.

12. A parameter setting system according to claim 9, wherein said manually operable member comprises a pair of switches, and wherein said parameter changing means further comprises:

increasing means responsive to an actuation of one of said pair of switches for increasing the value of said parameter in said first memory means; and decreasing means responsive to an actuation of the other of said pair of switches for decreasing the value of said parameter in said first memory means.

13. A parameter setting system according to claim 9, wherein said parameter stored in said first memory means comprises a plurality of parameter elements, and wherein said parameter setting system further comprises element selection means for selecting a desired one of said plurality of parameter elements to output an element selection signal indicative of the selected parameter element, said parameter changing means being responsive to said element selection signal for changing said selected parameter element of said parameter in said first memory means.

14. A parameter setting system according to claim 13, wherein said parameter changing means further comprises display means for displaying the selected parameter element to be changed.

15. A parameter setting system according to claim 9, wherein said first memory means comprises a plurality of storage areas for respectively storing a plurality of parameters each for determining the first characteristic of the musical tone, and wherein said parameter setting system further comprises parameter selection means for selecting a desired one of said plurality of storage areas to output a parameter selection signal representative of the selected storage area, said parameter changing means being responsive to said parameter selection signal for causing the parameter contained in the selected storage area to change in value in accordance with the operation of said member, said first transfer means being further responsive to said parameter selection signal for transferring said parameter contained in said selected storage area to said second memory means, said second transfer means being further responsive to said selection signal for transferring said parameter contained in said second memory means to said selected storage area, said reading means being responsive to said selection signal for reading the parameter from said selected storage area.

16. A parameter setting system according to claim 15, wherein said selectable characteristic is tone color and wherein said parameter selection means comprises tone-color selection means for selecting a desired one of a plurality of tone colors to be given to the musical tone, said plurality of tone colors corresponding respectively to said plurality of parameters, said tone-color selection means outputting a tone-color selection signal indicative of the selected tone color as said parameter selection signal.

17. A parameter setting system for an electronic musical instrument having tone generating means for generating a musical tone comprising:

a plurality of tone control means cooperative with the tone generating means for respectively controlling different characteristics of the musical tone;

first memory means having a plurality of storage areas corresponding respectively to said plurality of tone control means, each storage area for storing a parameter of certain value for determining a respective one of said characteristics of the musical tone;

characteristic selection means, having a plurality of manually operable members corresponding respectively to said storage areas and each member selecting whether or not a particular one of said characteristics is to be imparted to a tone, said selection means for outputting a characteristic selection signal corresponding to the last operated one of said plurality of manually operable members;

parameter value changing means having switch means and responsive to said characteristic selection signal for causing the parameter in a particular one of said plurality of storage areas corresponding to said last operated member to change in value in accordance with a manual operation of said switch means; and reading means responsive to said characteristic selection signal for reading the parameter from said particular one storage area and for supplying the read parameter to a corresponding one of a plurality of tone control means to thereby control that characteristic of the musical tone corresponding to said last operated member.

18. A parameter setting system according to claim 17 further comprising:

second memory means having a plurality of storage areas corresponding respectively to said plurality of tone control means each for storing a predetermined parameter for determining a respective one of said characteristics of the musical tone; and copying means responsive to said characteristic selection signal for storing the predetermined parameter contained in the storage area of said second memory means corresponding to the last operated member into said particular one storage area of said first memory means as said parameter.

19. A parameter setting system according to claim 17, wherein said parameter changing means further comprises display means responsive to said characteristic selection signal for displaying the parameter in said particular one storage area of said memory means.

20. A parameter setting system according to claim 17, wherein said switch means comprises a pair of switches, and wherein said parameter changing means further comprises:

increasing means responsive to said characteristic selection signal and an actuation of one of said pair of switches for increasing the value of the parameter in said particular one storage area; and decreasing means responsive to said characteristic selection signal and an actuation of the other of said pair of switches for decreasing the value of the parameter in said particular one storage area.

21. A parameter setting according to claim 17, wherein said parameter stored in each of said plurality of storage areas comprises a plurality of parameter elements, and wherein said parameter setting system further comprises element selection means for selecting a desired one of said plurality of parameter elements of each parameter to output an element selection signal indicative of the selected parameter element, said parameter changing means being further responsive to said element selection signal for changing the selected parameter element of the parameter in said particular one storage area.

22. A parameter setting system according to claim 21, wherein said parameter changing means further comprises display means for displaying said selected parameter element of said parameter in said particular one storage area of said memory means.

23. A parameter setting system according to claim 17, wherein each of said plurality of storage areas stores a plurality of parameters each for determining the characteristic of the musical tone, and wherein said parameter setting system further comprises parameter selection means responsive to said characteristic selection signal for selecting a desired one of the plurality of parameters in said particular one storage area to output a parameter selection signal representative of the selected parameter, said parameter changing means being further responsive to said parameter selection signal for causing the selected parameter in said particular one storage area to change in value in accordance with the operation of said switch means, said reading means being further responsive to said parameter selection signal for reading the selected parameter from said particular one storage area of said memory means.

24. A parameter setting system according to claim 23, wherein said parameter selection means comprises tone-color selection means for selecting a desired one of a plurality of tone colors to be given to the musical tone, said plurality of tone colors corresponding respectively to said plurality of parameters in each storage area, said tone-color selection means outputting a tone-color selection signal indicative of the selected tone color as said parameter selection signal.

25. A parameter setting system for an electronic musical instrument having tone generating means for generating a musical tone comprising:

memory means for storing a plurality of parameters each for determining a characteristic of the musical tone;

on/off parameter switch means for providing a selection output when turned on;

assigning means for assigning a desired one of said plurality of parameters to said parameter switch means, said assigning means automatically being rendered operable in response to the selection output every time the switch means is turned on;

reading means, responsive to the selection output of said parameter switch means, every time the switch means is turned on, for reading the parameter assigned to aid parameter switch means from said memory means; and tone control means cooperative with the tone generating means for controlling the characteristic of the musical tone in accordance with said read parameter.

26. A parameter setting system according to claim 25, wherein said plurality of parameters are designated respectively by different values within a range, and wherein said assigning means comprises register means for storing data and data changing means having a manually operable member for changing said data in said register means within said range in accordance with an operation of said member, said assigning means assigning said desired one parameter to said switch means in accordance with said data in said register means.

27. A parameter setting system according to claim 25 further comprising detachable memory means for storing said plurality of parameters contained in said memory means and for storing data contained therein into said memory means as said plurality of parameters.

28. A parameter setting system according to claim 25 further comprising:

mode selection means for selecting one of at least two modes;

rhythm switch means having a plurality of switch positions one of which is to be selected at a time, said plurality of switch positions corresponding to a plurality of rhythms and to said plurality of parameters, respectively, said rhythm switch means outputting a position selection signal representative of a selected one of said plurality of switch positions; and rhythm tone generating means responsive to said position selection signal for generating a tone of the rhythm corresponding to the selected switch position when a first one of said at least two modes is selected;

said assigning means being responsive to said position selection signal for assigning that parameter corresponding to the selected switch position to said parameter switch means when a second one of said at least two modes is selected.

* * * * *